US007544457B2

(12) United States Patent
Hashimoto et al.

(10) Patent No.: US 7,544,457 B2
(45) Date of Patent: Jun. 9, 2009

(54) COLOR TONER AND TWO-COMPONENT DEVELOPER

(75) Inventors: Akira Hashimoto, Shizuoka (JP); Yojiro Hotta, Chiba (JP); Wakashi Iida, Ibaraki (JP); Kazuhiko Hayami, Ibaraki (JP); Yasuhiro Ichikawa, Kanagawa (JP); Hirohide Tanikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 10/980,197

(22) Filed: Nov. 4, 2004

(65) Prior Publication Data

US 2005/0100808 A1 May 12, 2005

(30) Foreign Application Priority Data

Nov. 6, 2003 (JP) ..... 2003-377289

(51) Int. Cl.
*G03G 9/087* (2006.01)

(52) U.S. Cl. ..... 430/108.8; 430/108.1; 430/111.4; 430/109.4

(58) Field of Classification Search ..... 430/108.8, 430/111.4, 108.1, 109.4
See application file for complete search history.

(56) References Cited

U.S. PATENT DOCUMENTS

| | | | | |
|---|---|---|---|---|
| 5,866,291 | A * | 2/1999 | Ikegami et al. | 430/108.8 |
| 6,051,356 | A * | 4/2000 | Nishihara et al. | 430/108.8 |
| 6,232,027 | B1 | 5/2001 | Matsunaga et al. | 430/109 |
| 6,235,441 | B1 | 5/2001 | Tanikawa et al. | 430/106 |
| 6,528,222 | B2 | 3/2003 | Kohtaki et al. | 430/108.21 |
| 6,586,147 | B2 | 7/2003 | Iida et al. | 430/45 |
| 6,808,852 | B2 | 10/2004 | Hotta et al. | 430/108.22 |
| 2002/0034703 | A1 * | 3/2002 | Yamazaki et al. | 430/109.1 |
| 2002/0051924 | A1 | 5/2002 | Iida et al. | 430/45 |
| 2002/0098433 | A1 | 7/2002 | Matsunaga et al. | 430/108.8 |
| 2003/0129517 | A1 | 7/2003 | Hotta et al. | 430/108.22 |
| 2003/0134215 | A1 | 7/2003 | Kashiwabara et al. | 430/108.4 |
| 2003/0198883 | A1 | 10/2003 | Hiratsuka et al. | 430/109.3 |
| 2004/0005509 | A1 | 1/2004 | Moribe et al. | 430/109.4 |
| 2004/0209178 | A1 | 10/2004 | Itakura et al. | 430/45 |

FOREIGN PATENT DOCUMENTS

| | | | |
|---|---|---|---|
| EP | 1205810 | | 5/2000 |
| EP | 1283451 | | 2/2003 |
| EP | 1455239 | | 9/2004 |
| JP | 58080652 | A * | 5/1983 |
| JP | 3-225889 | | 10/1991 |
| JP | 11-352720 | | 12/1999 |
| JP | 2003/076056 | | 3/2003 |
| JP | 2003/076065 | | 3/2003 |
| JP | 2003/076066 | | 3/2003 |
| JP | 2004286807 | A * | 10/2004 |

OTHER PUBLICATIONS

English translation of JP 2004-286807 (2004).*

* cited by examiner

*Primary Examiner*—Christopher RoDee
(74) *Attorney, Agent, or Firm*—Fitzpatrick, Cella, Harper & Scinto

(57) ABSTRACT

The present invention relates to a toner which has good property such as fixability, coloring power, developability, durability, and environmental stability and so on. More specifically, the present invention relates to a color toner containing at least a binder resin, a colorant, and a wax, in which: a wax concentration of an extract obtained by dispersing the toner into n-hexane at a concentration of 15 mg/cm$^3$ at 23° C. and by subjecting the resultant dispersion to extraction treatment at 23° C. for 1 minute is in the range of 0.080 to 0.500 mg/cm$^3$; an average circularity of particles each having a circle-equivalent diameter of 3 μm or more in the toner is in the range of 0.925 to 0.965; and a content of the wax is in the range of 1 to 15 parts by mass with respect to 100 parts by mass of the binder resin.

5 Claims, 7 Drawing Sheets

(a)

(b)

COLOR TONER AND TWO-COMPONENT DEVELOPER

FIELD OF THE INVENTION AND RELATED ARTS

The present invention relates to a color toner for use in an image forming method such as an electrophotographic method, an electrostatic recording method, an electrostatic printing method, or a toner jet method, a color toner particularly suitable for oilless fixation, and a two-component developer containing the color toner.

BACKGROUND ART

In recent years, a small size, a light weight, a high speed, high image quality, and high reliability have been severely pursued for electrophotographic image forming apparatuses including a copying machine and a laser beam printer to meet the requirements of space savings, energy savings, and the like. Therefore, the image forming apparatuses have been structured with simple components in various parts. As a result, the performance demanded for toner has become more sophisticated so that a more excellent image forming apparatus cannot be established unless an improvement in toner performance is achieved. In addition, with the advent of recent various needs, the demand for full-color image output has been surging. In view of the above circumstances, additional increases in image quality, resolution, and the like have been demanded.

An improvement in color reproducibility and transparency of an OHP image are important for a color toner to be mounted on a typical full-color copying machine. Therefore, a sharp-melt and low-molecular-weight polyester resin or the like is used as a binder resin and the color toners of the respective colors are designed to be sufficiently mixed in a fixing step. However, such a resin having sharp-melt property poses a problem in that a hot offset phenomenon in which a molten toner adheres to a fixing roller or the like occurs owing to weak self-cohesive force of the resin. Silicone oil or the like has been conventionally uniformly applied to the fixing roller for the purpose of preventing the hot offset phenomenon. However, an image obtained with this arrangement has excessive silicone oil or the like adhering to the surface of the image. Therefore, the image is not preferable because a user has a feeling of discomfort particularly when using the image in an OHP image.

On the other hand, a black toner for a monochrome copying machine and a monochrome printer, which is widely used in the market, often contains a wax for preventing offset to eliminate the need for applying silicone oil to a fixing roller. Attempts have been recently made to allow a toner for full-color to contain a wax. However, as described above, a toner for full-color has poor compatibility with a wax because the toner is generally composed of a polyester resin. As a result, the wax is insufficiently dispersed so that the fixing performance becomes insufficient. In addition, various problems associated with the developability, durability, storage stability, and the like of the toner occur.

Various propositions have been made to such a problem of insufficient dispersion of a wax into a polyester resin.

For example, JP 11-352720 A proposes a toner in which the dispersibility of a wax into a binder resin has been improved by using a hybrid resin synthesized from a mixture composed of a vinyl-based monomer for forming a vinyl-based copolymer, acid and alcohol components for forming a polyester resin, and the wax.

In addition, JP 2003-076066 A proposes a toner containing at least: a wax dispersant obtained by grafting a copolymer, which consists of styrene, a nitrogen-containing vinyl monomer, and a (meth)acrylic acid-based monomer, into a polyolefin; a hydrocarbon-based wax; and a hybrid resin, the toner having good dispersibility of the wax and satisfying a high gloss excellent in color mixability and permeability.

Furthermore, JP 2003-076056 A proposes a toner having a main peak in the molecular weight region of 5,000 to 70,000 and Mw/Mn of 100 or more. In the toner, the formation of a domain of 0.01 to 5 μm by primary dispersed particles containing a wax each having a dispersion particle size in the range of 0.001 to 4 μm can be observed by cross-section observation of the toner with a focused ion beam (FIB). In addition, JP 2003-076056 A proposes a toner having an average circularity in the range of 0.92 to 0.96 and a precipitation starting point at a methanol hydrophobing in the range of 35 to 60 vol %. In the toner, primary dispersed particles containing a wax each having a dispersion particle size in the range of 0.005 to 4 μm form a domain of 0.01 to 5 μm.

Furthermore, JP 3225889 B proposes a toner which is allowed to contain 0.1 to 40 mass % of wax and to have a presence ratio of wax exposed to the toner surface in the range of 1 to 10 mass % by mixing a solution of a polyester resin dissolved in a solvent with slurry of a fine-particle-state wax and pigment slurry, granulating the mixture in water, and then distilling off the solvent at room temperature. In the toner, the shape of the wax is a flaky shape and the number average dispersion size of the wax is in the range of 0.1 to 2 μm.

However, it still cannot be said that those toners with improved wax dispersibility have fully optimized their wax dispersibility. Therefore, there has been demanded a toner in which the fixing performance (such as low-temperature fixability or hot offset resistance) has been further improved by making a wax finer and uniformer, in other words, by dispersing at least part of a wax uniformly at a molecular level into a binder resin.

SUMMARY OF THE INVENTION

An object of the present invention is to provide a color toner capable of stably forming an image that has satisfied a high definition and a two-component developer containing the color toner.

More specifically, an object of the present invention is to provide a color toner which not only expresses excellent low-temperature fixability and excellent hot offset resistance but also has good developability, good durability, and good environmental stability, and to provide a two-component developer containing the color toner.

Another object of the present invention is to provide a color toner which has good coloring power and which is excellent in color mixability, transfer efficiency, and gradation, and to provide a two-component developer containing the color toner.

DETAILED DESCRIPTION OF THE INVENTION

Figure 1:
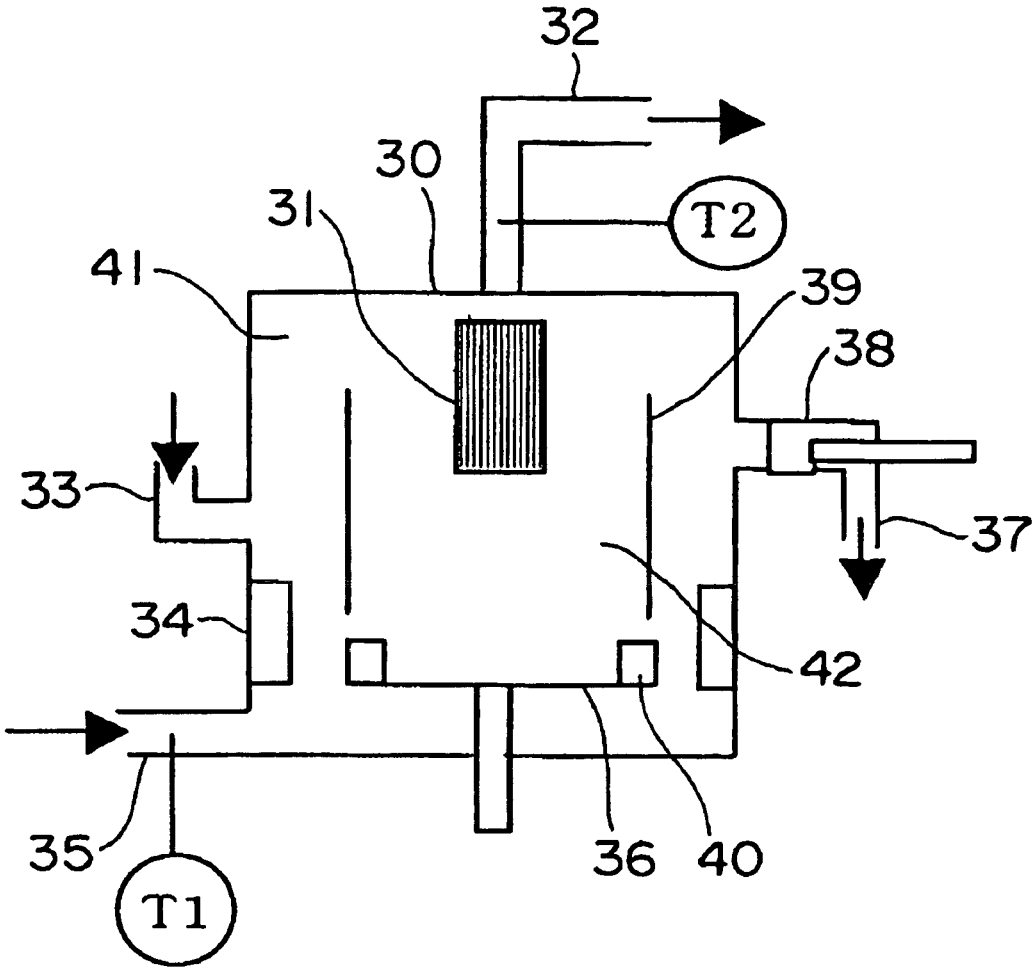
FIG. 1 is a schematic sectional drawing of an example of a surface modification apparatus to be used in a surface modification step in producing a toner of the present invention.

As a result of extensive studies, the inventors of the present invention have found that there is a correlation between the degree of dispersion of a wax into a toner and the rate of elution of the wax into n-hexane from the toner when the toner is dispersed into n-hexane. That is, it has been found that the rate of elution of the wax into n-hexane from the toner increases when the presence amount of wax particles or wax domains in the toner is small and at least part of the wax is uniformly dispersed at a molecular level into a binder resin. Thus, the inventors have achieved the present invention.

That is, the present invention is as follows.

(1) A color toner, including at least a binder resin, a colorant, and a wax, in which:

a wax concentration C[01] of an extract obtained by dispersing the toner into n-hexane at a concentration of 15 mg/cm$^3$ at 23° C. and by subjecting the resultant dispersion to an extraction treatment at 23° C. for 1 minute is in the range of 0.080 to 0.500 mg/cm$^3$;

an average circularity of particles each having a circle-equivalent diameter of 3 μm or more in the toner is in the range of 0.925 to 0.965; and a content of the wax is in the range of 1 to 15 parts by mass with respect to 100 parts by mass of the binder resin.

(2) A color toner according to (1), in which the toner satisfies the following relationship.

$$B/A \leqq 2.0$$

(In the formula:

A (%) denotes a degree of agglomeration when the toner is left under an environment of 23° C. and 50% RH for 24 hours; and B (%) denotes a degree of agglomeration when the toner is left under an environment of 50° C. and 12% RH with a load of 1.56 kPa applied for 24 hours and then left under an environment of 23° C. and 50% RH for 24 hours without the load.)

(3) A color toner according to (1) or (2), in which the toner satisfies the following relationships (i) to (iii).

$$C[01] \geqq D \times 0.2 \quad \text{(i)}$$

$$C[01] \geqq C[20] \times 0.6 \quad \text{(ii)}$$

$$C[20] \geqq C[90] \times 0.8 \quad \text{(iii)}$$

(In the formulae:

C[01] denotes a wax concentration (mg/cm$^3$) of an extract obtained by dispersing the toner into n-hexane at a concentration of 15 mg/cm$^3$ at 23° C. and by subjecting the resultant dispersion to an extraction treatment at 23° C. for 1 minute;

C[20] denotes a wax concentration (mg/cm$^3$) of an extract obtained by dispersing the toner into n-hexane at a concentration of 15 mg/cm$^3$ at 23° C. and by subjecting the resultant dispersion to an extraction treatment at 23° C. for 20 minutes;

C[90] denotes a wax concentration (mg/cm$^3$) of an extract obtained by dispersing the toner into n-hexane at a concentration of 15 mg/cm$^3$ at 23° C. and by subjecting the resultant dispersion to an extraction treatment at 23° C. for 90 minutes; and D denotes a wax concentration (mg/cm$^3$) of an extract obtained by dispersing the toner into toluene at a concentration of 15 mg/cm$^3$ at 23° C. and by subjecting the resultant dispersion to an extraction treatment at 23° C. for 12 hours.)

(4) A color toner according to any one of (1) to (3), in which an endothermic curve in differential scanning calorimetry (DSC) measurement of the toner has one or multiple endothermic peaks in the temperature range of 30 to 200° C. and a peak temperature of a highest endothermic peak out of the one or multiple endothermic peaks is in the temperature range of 60 to 105° C.

(5) A color toner according to (4), in which the peak temperature of the highest endothermic peak is in the temperature range of 70 to 90° C.

(6) A color toner according to any one of (1) to (5), in which the wax is an aliphatic hydrocarbon-based wax.

(7) A color toner according to (6), in which the wax is a paraffin wax.

A color toner according to any one of (1) to (7), in which the binder resin is a resin having at least a polyester unit.

(9) A color toner according to any one of (1) to (8), further including a metal compound of an aromatic carboxylic acid.

(10) A color toner according to any one of (1) to (9), in which an average circularity of particles each having a circle-equivalent diameter of 3 μm or more in the toner is in the range of 0.930 to 0.965.

(11) A color toner according to any one of (1) to (10), in which a weight average particle diameter (D4) of the toner is in the range of 4 to 9 μm.

(12) A color toner according to any one of (1) to (11), in which a storage elastic modulus at a temperature of 80° C. (G'80) of the toner is in the range of $1\times10^5$ to $1\times10^8$ (Pa).

(13) A color toner according to any one of (1) to (12), in which a storage elastic modulus at a temperature of 160° C. (G'160) of the toner is in the range of 10 to $1\times10^4$ (Pa).

(14) A color toner according to any one of (1) to (13), in which a ratio (G"/G'=tan δ) of a loss elastic modulus (G") to a storage elastic modulus (G') of the toner is in the range of 0.5 to 5.0 at any temperature between 120 and 150° C.

(15) A two-component developer, including at least a toner and a magnetic carrier, wherein: the toner is the color toner according to any one of (1) to (14); and the magnetic carrier is a resin-coated carrier a surface of which is coated with a resin.

Hereinafter, the present invention will be described in detail.

The toner of the present invention is a color toner containing at least a binder resin, a colorant, and a wax. It is an essential condition for the toner that a wax concentration of an extract obtained by dispersing the toner into n-hexane at a concentration of 15 mg/cm$^3$ at 23° C. and by subjecting the resultant dispersion to an extraction treatment at 23° C. for 1 minute is in the range of 0.080 to 0.500 mg/cm$^3$. A wax concentration out of the range precludes the expression of excellent low-temperature fixability or excellent hot offset resistance.

To meet the above essential condition, the toner of the present invention is produced in such a manner that the wax is made fine and uniform. In other words, the toner of the present invention is produced in such a manner that at least part of the wax is uniformly dispersed at a molecular level into the binder resin in the toner.

In addition, in the present invention, a polyester-based resin is mainly suitably used as the binder resin. The term "polyester-based resin" as used herein refers to a resin having a polyester unit.

Specific examples of such a resin include: 1) a hybrid resin having a polyester unit and a vinyl-based copolymer unit; 2) a polyester resin; and 3) a mixture of these resins and a vinyl-based copolymer. A hybrid resin is suitably used in the present invention. In addition, the binder resin preferably have a polyester unit accounting for 50 mass % or more of the whole resin, and more preferably have a polyester unit accounting for 70 mass % or more of the whole resin is more preferable.

The inventors of the present invention have adjusted the kind, composition, and production condition of a binder resin, the kind, melting point, and addition amount of a wax, the kind and addition amount of another toner raw material, the production conditions of a toner, and the like to uniformly and finely disperse the wax into the toner, thereby producing the toner. Then, the resultant toner has examined for fixability. As a result, it has been found that finer dispersion of the wax leads to better low-temperature fixability and better hot offset resistance.

The inventors have also found the following. When the wax is finely dispersed and at least part of the wax is uniformly dispersed at a molecular level into the binder resin, an image defect due to peeling of a fixed image hardly occurs even if, for example, a full-color image outputted onto cardboard as a transfer material is bent. Therefore, a beautiful image is held on the transfer material, that is, unconventional excellent fixability is expressed.

It has also been found that there is a correlation between the degree of dispersion of the wax into the toner and the rate of elution of the wax into n-hexane from the toner when the toner is dispersed into n-hexane. That is, it has been found that the rate of elution of the wax into n-hexane from the toner increases when the wax is highly dispersed at a molecular level into the toner and the presence amount of wax particles or wax domains in the toner is small.

Then, the inventors have made studies on a method of easily quantifying the degree of dispersion of a wax with good reproducibility. As a result, it has been found that the degree of dispersion of the wax into the toner can be easily determined with good reproducibility according to a method involving quantifying a wax concentration of an extract by means of gas chromatography, the extract being obtained by dispersing the toner into n-hexane at a concentration of 15 mg/cm$^3$ at 23° C. and by subjecting the resultant dispersion to an extraction treatment at 23° C. for 1 minute.

Various toners have been examined for relationship between a wax concentration C[01] of an extract obtained by dispersing each of the toners into n-hexane at a concentration of 15 mg/cm$^3$ at 23° C. and by subjecting the resultant dispersion to an extraction treatment at 23° C. for 1 minute and toner fixability. As a result, it has been found that at least part of the wax in a toner having a wax concentration C[01] of the extract of 0.080 mg/cm$^3$ or more, preferably 0.120 mg/cm$^3$ or more is uniformly dispersed at a molecular level into the binder resin in the toner. And it has also been found that the presence amount of wax particles or wax domains in the toner reduces.

It has been found that such a toner quickly allows the wax to exude even from the inside of the toner through a fixation step of an image forming process to enable maximum expression of an effect of adding the wax. It has also been found that the use of such a toner hardly causes an image defect due to peeling of a fixed image even if a full-color image formed on cardboard as a transfer material is bent as described above, with the result that a beautiful image is held on the transfer material. Furthermore, it has been found that such a toner has unconventional excellent low-temperature fixability.

The fixability is improved as a wax concentration C[01] of an extract increases. However, when a toner the wax content of which has significantly increased (for example, a toner having a wax concentration C[01] of an extract in excess of 0.500 mg/cm$^3$) is left under a high-temperature and high-humidity environment, the wax uniformly dispersed at a molecular level into the binder resin tends to agglomerate. As a result, the degree of dispersion can be rapidly reduced, and excellent fixability may not be expressed in some cases. Therefore, in order to obtain a toner capable of expressing excellent fixability for a long period of time regardless of environmental variation, the wax concentration C[01] of an extract must be 0.500 mg/cm$^3$ or less. The wax concentration C[01] of an extract is preferably set to 0.400 mg/cm$^3$ or less, whereby a toner capable of expressing excellent fixability with good reproducibility can be obtained.

From the above reason, it is an essential condition for the toner of the present invention that a wax concentration C[01] of an extract obtained by dispersing the toner into n-hexane at a concentration of 15 mg/cm$^3$ at 23° C. and by subjecting the wax to extraction treatment at 23° C. for 1 minute is in the range of 0.080 to 0.500 mg/cm$^3$. It is more preferable that the wax concentration C[01] be in the range of 0.120 to 0.400 mg/cm$^3$.

The reason why the rate of elution of a wax into n-hexane as an extraction solution increases when at least part of the wax is uniformly dispersed at a molecular level into a binder resin in a toner is not necessarily clear. However, the reason is probably as follows.

The saturated solubility of a wax, which has lower polarity than that of a binder resin and has a lower melting point than that of the binder resin, in n-hexane as a nonpolar solvent is relatively high (several mass %) at room temperature. However, the rate of solution of the wax is extremely low so that the wax is gradually dissolved at a constant velocity after the wax has swelled over several hours. The rate of solution strongly depends on the particle size of the wax. The rate of solution increases at an increasingly fast pace with decreasing the particle size of the wax.

The same is expected to hold true for a wax in a toner. The rate of elution of the wax into n-hexane may increase with decreasing dispersion particle size of the wax in the toner. The sate where the dispersion particle size of the wax decreases to the limit can be a state where the wax is uniformly dispersed at a molecular level. In addition, when the wax is finely dispersed into the toner, a binder resin which essentially has nearly no interaction with n-hexane conforms to n-hexane owing to an influence of the wax finely dispersed at a molecular level into the binder resin.

From the above reason, the toner of the present invention in which at least part of the wax is finely dispersed at a molecular level into the binder resin may extremely quickly elute the wax even from the inside of the toner when the toner is dispersed into n-hexane.

As described above, several toners each of which has improved dispersibility of a wax into a binder resin have been known. However, a conventional wax-containing toner was found to have a wax concentration C[01] of an extract of less than 0.080 mg/cm$^3$, the extract being obtained by dispersing the toner into n-hexane at a concentration of 15 mg/cm$^3$ at 23° C. and by subjecting the wax to extraction treatment at 23° C. for 1 minute. In addition, the conventional wax-containing toner was evaluated for fixing performance to find that its low-temperature fixability and hot offset resistance were susceptible to improvement.

That is, a wax concentration C[01] of an extract, which is a characteristic of the present invention, of a toner adjusted to fall within a certain range (0.080 to 0.500 mg/cm$^3$) has not been known, the extract being obtained by dispersing the toner into n-hexane at a concentration of 15 mg/cm$^3$ at 23° C. and by subjecting the resultant dispersion to an extraction treatment at 23° C. for 1 minute.

For example, when a hybrid resin synthesized from a mixture composed of a vinyl-based monomer, acid and alcohol components, and a wax described in JP 11-352720 A is used as a toner raw material, the reagglomeration of the wax particles dispersed into the resin easily occurs through melting and kneading. As a result, the wax concentration C[01] of an extract becomes less than 0.080 mg/cm$^3$.

In addition, a toner produced by using a wax dispersant obtained by grafting a copolymer, which consists of styrene, a nitrogen-containing vinyl monomer, and a (meth)acrylic acid-based monomer, into a polyolefin described in JP 2003-076066 A or JP 2003-076056 A, or a toner produced through stepwise repeated kneading described in JP 2003-076065 A has a fine primary average dispersion particle size of the wax. However, as the production of such a toner passes the step of mixing a wax and a binder resin, dispersed particles of the wax inevitably come close to each other and agglomerate to form large number of wax domains. In addition, the particle sizes of the wax domains become excessively large depending on melting and kneading conditions, and, in some cases, the reagglomeration of the dispersed particles of wax occurs to result in an oversize wax dispersion particle size. As a result, the wax concentration C[01] of an extract becomes less than 0.080 mg/cm$^3$.

Furthermore, JP 3225889 B describes a toner produced by: mixing a solution of polyester in a solvent with slurry of a fine-particle-state wax and pigment slurry; granulating the mixture in water; and distilling off the solvent at room temperature. The production of the toner involves: mechanically bringing a wax into a fine-particle state; and mixing the fine-particle-state wax with a liquid-state binder resin. However, the number average dispersion particle size of the wax mixed with the binder resin is about 1 μm. Therefore, it is hard to say that the wax is finely dispersed. In addition, the wax concentration C[01] of an extract is less than 0.080 mg/cm$^3$.

In order that the wax concentration C[01] of an extract obtained by dispersing a toner into n-hexane at a concentration of 15 mg/cm$^3$ at 23° C. and by subjecting a wax to extraction treatment at 23° C. for 1 minute is in the range of 0.080 to 0.500 mg/cm$^3$, it is preferable that at least part of the wax in the toner be uniformly dispersed at a molecular level into a binder resin.

In the present invention, examples of a method of uniformly dispersing at least part of a wax in a toner at a molecular level into a binder resin include the following methods.

When a hybrid resin is synthesized from a monomer mixture containing: a wax; a vinyl-based monomer for forming a vinyl-based copolymer unit; and acid and alcohol components for forming a polyester unit, a polymerization reaction of the vinyl-based monomer is performed by using a polymerization initiator having a relatively high hydrogen abstraction ability (for example, di-t-butylperoxide which generate t-butoxy radical by decomposition) at a relatively high temperature to allow the vinyl-based monomers to polymerize with each other. At the same time, graft polymerization of the vinyl-based monomer with part of the wax is intentionally caused. A component subjected to graft modification with the vinyl-based monomer has a high affinity for both of the binder resin and the wax. Therefore, the component subjected to graft modification acts as a wax dispersant for favorably dispersing the wax into the toner particles, whereby the wax can be dispersed at a molecular level into the binder resin.

A method of uniformly dispersing a wax at a molecular level into the binder resin involving: adding a solvent that dissolves the wax and the hybrid resin well to the monomer mixture; and synthesizing the hybrid resin in a state where the mixture is completely dissolved, a method involving removing a solvent from a uniform mixture of a wax and a hybrid resin dissolved into the solvent at a low temperature to maintain high dispersibility of the wax, and the like are also applicable. A combination of those methods is also applicable.

The inventors of the present invention have made additional studies on a toner in which a wax concentration C[01] of an extract obtained by dispersing the toner into n-hexane at a concentration of 15 mg/cm$^3$ at 23° C. and by subjecting the resultant dispersion to an extraction treatment at 23° C. for 1 minute is in the range of 0.080 to 0.500 mg/cm$^3$.

As a result, it has been found that, when a large number of images are outputted by using the toner, endurance stability of developability such as an image density, fogging, or gradation, and of transferability typified by image void may vary significantly depending on the kind of toner even if the toners have nearly the same wax concentration C[01] of an extract. It has also been found that the toners different from each other in endurance stability of developability and of transferability are clearly distinguished from each other by means of an indicator, that is, the extent to which the degree of agglomeration deteriorates, when they are left under a severe environment such as a high-temperature environment or a high-pressure environment.

The toner of the present invention has a ratio B/A between degrees of agglomeration of preferably 2.0 or less, more preferably 1.5 or less. Here, the degree of agglomeration of the toner when the toner is left under an environment of 23° C. and 50% RH for 24 hours is denoted by A (%), and the degree of agglomeration of the toner when the toner is left under an environment of 50° C. and 12% RH with a load of 1.56 kPa applied for 24 hours and then left under an environment of 23° C. and 50% RH for 24 hours without the load is denoted by B (%).

In addition, it is preferable that the degree of agglomeration A be in the range of 3 to 80% and the degree of agglomeration B be in the range of 3 to 99%, because the developability and the transferability become excellent with such degrees.

According to the studies of the inventors of the present invention, a toner having a ratio B/A between degrees of agglomeration of 2.0 or less allows a wax to be uniformly dispersed into the toner without liberation to the toner surface, even if, for example, the toner repeatedly receives a mechanical stress in a developing unit during long-term use, and hence the contamination of a member such as a developing sleeve is prevented. In addition, embedding of an external additive into toner surface is suppressed so that a reduction in flowability or charging performance of the toner hardly occurs and the developability and the transferability are stable for a long period of time.

In addition, a toner having a ratio B/A between degrees of agglomeration of 1.5 or less maintains endurance stability even under a severe environment such as a high-temperature and high-humidity environment. As a result, the fusion of the toner to a member such as a photosensitive drum hardly occurs and a stable image can be obtained.

The reason why the toner having a ratio B/A between degrees of agglomeration of 2.0 or less exerts various effects such as those described above is not clear. However, the reason is probably as follows.

The wax in the toner of the present invention is a mixture composed of multiple low-melting-point compounds so that the melting point of the wax ranges to a certain degree.

When a toner containing such a wax is exposed to an environment of 50° C. and 12% RH, a component having a lower melting point in the wax components is softened and tends to be in a "half-molten state". When the toner containing the wax component in the "half-molten state" is further applied with a load of 1.56 kPa, the wax component in the "half-molten state" softens the adjacent wax component in the toner. Therefore, the wax components dispersed into the toner agglomerate and coalesce repeatedly to form a coarse-particle-state wax. As a result, the wax is liberated to the toner surface. The toner in such a state has an increased degree of agglomeration because the adhesive property between toner particles increases.

A toner having a ratio B/A between degrees of agglomeration of more than 2.0 has a wax softer than a binder resin, the wax being liberated to the surface. Therefore, an external additive of the toner is easily embedded into the toner surface when the toner receives a mechanical stress in a developing unit. As a result, a reduction in flowability or charging performance of the toner easily occurs, leading to that the developability and the transferability easily deteriorate. In addition, being rubbed with members such as a photosensitive drum and a developing sleeve, the toner is easily fused to these members. As a result, an image to be formed may have an image defect.

A toner into which a wax is insufficiently dispersed (for example, a toner in which a large number of wax particles and wax domains are formed) particularly strongly exhibits this tendency. As the number of wax particles and wax domains in the toner increases, the wax is more easily liberated to the toner surface when the toner is applied with a load of 1.56 kPa under an environment of 50° C. and 12% RH. In this case, the degree of agglomeration tends to deteriorate so that the ratio B/A between degrees of agglomeration increases. In addition, various detrimental effects resulting from the embedding of an external additive into toner surface and the fusion of the toner to a member become easy to occur.

On the other hand, a toner in which at least part of wax is uniformly dispersed at a molecular level into a binder resin, with the small amount of wax particles or wax domains has nearly no adjacent wax particles each other. Thus, even if a low-melting-point component of the wax is softened, the state of dispersion of the wax tends to maintain an initial state. As a result, the ratio B/A between degrees of agglomeration has a low value, and the embedding of an external additive into the toner surface occurs at an extremely low frequency. Therefore, endurance stability of developability and of transferability is good.

The inventors have found that a toner of the present invention, in which wax concentrations (mg/cm$^3$) of extracts each of which is obtained by dispersing the toner into n-hexane or toluene at a concentration of 15 mg/cm$^3$ at 23° C. and by subjecting a wax to extraction treatment at 23° C. satisfy relationships shown in the following formulae (i) to (iii), is excellent in fixing performance such as low-temperature fixability or hot offset resistance and in endurance stability of developability and of transferability, has high coloring power, good color mixability, and good color reproducibility, and is also excellent in environmental stability.

$$C[01] \geqq D \times 0.2 \quad \text{(i)}$$

$$C[01] \geqq C[20] \times 0.6 \quad \text{(ii)}$$

$$C[20] \geqq C[90] \times 0.8 \quad \text{(iii)}$$

(In the formulae, D denotes a wax concentration when the wax is subjected to an extraction treatment with toluene for 12 hours, C[01] denotes a wax concentration when the wax is subjected to an extraction treatment with n-hexane for 1 minute, C[20] denotes a wax concentration when the wax is subjected to an extraction treatment with n-hexane for 20 minutes, and C[90] denotes a wax concentration when the wax is subjected to an extraction treatment with n-hexane for 90 minutes.)

It should be noted that the wax concentration D, which is a wax concentration when the wax is subjected to extraction with toluene for 12 hours at 23° C., corresponds to the wax concentration when nearly the total amount of wax in the toner is eluted, because toluene relatively quickly dissolves both the wax and the binder resin at room temperature.

The toner of the present invention, in which concentrations of a wax which is eluted from the toner into n-hexane or toluene are adjusted to fall within the ranges represented by the formulae (i) to (iii), and from which the rate of elution of the wax is controlled, is not only excellent in fixing performance such as low-temperature fixability or hot offset resistance and in endurance stability of developability and of transferability, having high coloring power, good color mixability, and good color reproducibility, but also excellent in environmental stability.

The reason why the toner of the present invention satisfying the formulae (i) to (iii) exerts such excellent effects is not clear. However, the reason is probably as follows.

The phrase "concentrations of a wax which is eluted from the toner into n-hexane or toluene satisfy the formulae (i) to (iii)" means that a considerable part of wax in the toner is completely uniformly dispersed at a molecular level into the binder resin. When the wax is completely uniformly dispersed into the binder resin to a level such that the formulae (i) to (iii) are satisfied, the wax is inevitably present near colorant particles in the toner and in some cases, the colorant particles are surrounded by the wax. In such a state, when the toner is fused through a fixation step in an image forming process, the colorant particles near the wax can be quickly spread over a transfer material together with the wax. Furthermore, the colorant particles can be mixed with the colorant particles in the toner of another color. As a result, extremely excellent color mixability and extremely excellent color reproducibility are expressed.

In addition, a conventional toner tends to pose problems of environmental variation of the toner resulting from a colorant (for example, a problem in that the colorant serves as a leak site under a high-temperature and high-humidity environment and hence the charge amount of the toner reduces to result in an increase in fogging, and a problem in that the colorant itself causes charge up under a low-temperature and low-humidity environment and hence the charge amount of the toner increases to result in a reduction in image density). On the other hand, in the toner of the present invention satisfying the formulae (i) to (iii), a finely dispersed wax is present near the colorant particles so that the colorant hardly serves as a leak site and the charge up of the colorant is also prevented. Thus, those problems resulting from a colorant are suppressed.

In addition, the toner of the present invention preferably has a specific storage elastic modulus G'.

The storage elastic modulus G' is an indicator of elasticity in a polymer, that is, reversibility with respect to a stress. In the case where a toner is being fixed to a transfer member, when the toner is deformed by a quantity of heat and a pressure applied thereto in passing through a fixing roller, G' serves as an indicator of a force necessary for returning the toner to its original shape. In other words, G' shows whether a molecule of a component constituting the toner (such as a binder resin) has spring-like property. In these days, various kinds of paper have been used as transfer members. Hence, a toner capable of conforming to transfer members made of various materials regardless of the structure of a fixing unit has been demanded. In particular, in a fixation method in which a film is used as a fixation member, variations in quantity of heat for fusing and fixing the toner to the film as the fixation member tend to occur, because the heat capacity of the film is small and the pressure that can be applied to the film is limited.

However, an image to thin paper as a transfer material with good fixability and good color mixability at elevated temperatures can be obtained by defining the elasticity at the temperature (80° C.) at which the toner enters a rubber region. Furthermore, a suppression effect on image unevenness at the time of fixation can be exerted and sufficient low-temperature fixability can be obtained even in an image to cardboard by defining the elasticity at the temperature (160° C.) at which the toner enters a flow region.

To be specific, a storage elastic modulus at a temperature of 80° C. (G'80) is preferably in the range of $1\times10^5$ to $1\times10^8$ (Pa), and more preferably in the range of $1\times10^5$ to $1\times10^7$ (Pa). In addition, a storage elastic modulus at a temperature of 160° C. (G'160) is preferably in the range of 10 to $1\times10^4$ (Pa), and more preferably in the range of $10\times10^2$ to $1\times10^4$ (Pa).

A (G'80) of less than $1\times10^5$ (Pa) tends to reduce hot offset resistance when thin paper is used as a transfer material, whereas a (G'80) in excess of $1\times10^8$ (Pa) tends to reduce color mixability.

In addition, a (G'160) of less than 10 (Pa) tends to cause fixation unevenness, whereas a (G'160) in excess of $1\times10^4$ (Pa) tends to reduce low-temperature fixability and color mixability when cardboard is used as a transfer material.

A loss elastic modulus G" is an indicator of viscosity in a polymer, that is, irreversibility with respect to a stress. In the case where a toner is being fixed to a transfer member, G" shows the ease with which the toner is deformed by a pressure being applied thereto when the toner passes through a fixing roller. Therefore, a ratio (G"/G'=tan δ) of the loss elastic modulus to the storage elastic modulus defined in the present invention serves as an indicator of balance between them. That is, the ratio serves as a measure as to whether the toner can absorb the pressure and heat energy that the toner receives through fixation.

When tan δ is in the range of 0.5 to 5.0 at any temperature between 120 and 150° C., the energy at the time of fixation is sufficiently transmitted to the toner layer. Therefore, a good fixed image can be formed. When the tan δ is less than 0.5 at an arbitrary temperature between 120 and 150° C., the toner hardly cause heat deformation so that OHT transparency and color mixability tend to reduce in a fixation method in which a film is used as a fixation member. In addition, when the tan δ at an arbitrary temperature between 120 and 150° C. exceeds 5.0, fixation unevenness tends to occur.

Furthermore, in terms of fixability, a toner in which a ratio (G"/G'=tan δ) of a loss elastic modulus (G") to a storage elastic modulus (G') is in the range of 1.0 to 4.0 at any temperature between 120 and 150° C. is more preferable.

The inventors of the present invention have made studies to find that more detailed definition of the viscoelasticity of a toner results in good electrophotographic property. That is, in order to facilitate heat deformation of a toner on transfer paper to ensure that fixation is performed when the toner passes through a fixing unit to receive heat fixation, a series of phase change in which the toner turns from a glass state to a glass transition state and then to a rubber-like state need to be controlled within a certain range with respect to temperature and viscoelasticity. Analyzing the temperature dependence of a storage elastic modulus in a specific temperature region allows one to know the series of phase change of the state of the toner.

(G'50/G'70) represents the temperature dependence of the storage elastic modulus of a toner in a glass state. In association with recent miniaturization of an image forming apparatus, the temperature inside the apparatus remarkably increases when the apparatus is used under a high-temperature and high-humidity environment. Therefore, the storage elastic modulus in a glass-state temperature region affects the developability. In view of the above, the developability and the low-temperature fixability are preferably made compatible by defining the storage elastic modulus ratio (G'50/G'70) in the temperature region.

A toner having a ratio (G'50/G'70) of a storage elastic modulus at a temperature of 50° C. (G'50) to a storage elastic modulus at a temperature of 70° C. (G'70) of less than 2.0 has reduced low-temperature fixability when thin paper is used as a transfer material. In addition, a toner having a ratio (G'50/G'70) in excess of 20.0 has reduced developability and storage stability.

(G'70/G'90) represents the temperature dependence of the storage elastic modulus of a toner in a glass transition state. In this temperature region, the main chain of a toner component (such as a binder resin) starts to vibrate, and a component in a glass state and a component in a rubber state are coexistent in the toner. Therefore, by defining the storage elastic modulus in this temperature region, the toner becomes less susceptible to variations in temperature occurring when a transfer material passes through a fixing unit. As a result, toner layers on the transfer material are favorably fixed and thus sufficient color mixture is performed. Therefore, an image with good color developability can be obtained.

A toner having a ratio (G'70/G'90) of the storage elastic modulus (G'70) to a storage elastic modulus at a temperature of 90° C. (G'90) of less than 60 has reduced color mixability, whereas a toner having a ratio (G'70/G'90) in excess of 250 tends to cause fixation unevenness.

(G'90/G'110) represents the temperature dependence of the storage elastic modulus of a toner in a rubber-like state. The rubber-like state refers to a state where the main chain of a toner component (such as a binder resin) is loosened. Through fixation, the loosened main chains of toner components are entangled with each other or the loosened main chain of toner components is entangled with a fiber of paper. Therefore, strong fixation can be achieved. Conventionally, fixation of a toner to paper is very susceptible to a subtle variation in temperature of a fixing unit or to a difference in rate of heat transfer due to a difference in kind of paper to be used. The toner of the present invention with its temperature dependence of the storage elastic modulus in a rubber-like state defined provides strong fixation of toner layers on paper to each other or strong fixation of a toner layer to paper to allow sufficient color mixture. Therefore, an image with good color developability can be obtained.

A toner having a ratio (G'90/G'110) of the storage elastic modulus (G'90) to a storage elastic modulus at a temperature of 110° C. (G'110) of less than 5 may have reduced color mixability. A toner having the ratio (G'90/G'110) in excess of 30 has reduced hot offset resistance when using a thin paper as a transfer material because the main chain of a toner component is excessively loosened owing to a temperature and the excessively loosened main chain of the toner component is broken when applied with a pressure.

It is more preferable that the ratio (G'50/G'70) be in the range of 2.0 to 18.0, the ratio (G'70/G'90) be in the range of 60 to 200, and the ratio (G'90/G'110) be in the range of 5 to 25.

Next, the composition of the toner of the present invention will be described.

As described above, the toner of the present invention contains at least a binder resin.

A general binder resin conventionally used for a toner can be used for the binder resin in the toner of the present invention without any particular limitation as long as the wax is highly dispersed into the toner. The binder resin is preferably a polyester-based resin chosen from: a hybrid resin having a polyester unit and a vinyl-based copolymer unit; and a mixture of a vinyl-based copolymer and a hybrid resin and/or a polyester resin. The binder resin is more preferably a hybrid resin.

The term "polyester-based resin" described above refers to a resin having a polyester unit, and comprehends a hybrid resin and a polyester resin. In the present invention, a binder resin having a polyester unit accounting for 50 mass % or more of the whole resin is preferable, and a binder resin having a polyester unit accounting for 70 mass % or more of the whole resin is more preferable. The use of a binder resin having a polyester unit accounting for 50 mass % or more of the whole resin can provide a toner which more remarkably exerts high coloring power, a vivid tint, good color mixability, and excellent transparency. Furthermore, the use of a hybrid resin having a polyester unit accounting for 50 mass % or more of the whole resin can provide a toner from which good pigment dispersibility, good wax dispersibility, good low-temperature fixability, and an improvement in hot offset resistance can be expected.

In the present invention, the term "polyester unit" refers to a portion derived from polyester whereas the term "vinyl-based copolymer unit" refers to a portion derived from a vinyl-based copolymer. Monomers for polyester for constituting a polyester unit are a polyvalent carboxylic acid component and a polyhydric alcohol component. A vinyl-based monomer for constituting a vinyl-based copolymer unit is a monomer component having a vinyl group.

In the present invention, the term "hybrid unit" refers to a resin obtained by chemically bonding a vinyl-based copolymer unit and a polyester unit. Specific examples of such a resin include a resin formed via an ester exchange reaction between a vinyl-based copolymer unit, which is obtained by polymerizing monomers each having a carboxylate group such as (meth)acrylate, and a polyester unit. More preferable examples thereof include a graft copolymer (or a block copolymer) using a vinyl-based copolymer unit as a backbone polymer and a polyester unit as a branch polymer.

In the case where a polyester resin or a hybrid resin having a polyester unit is used as the binder resin in the toner of the present invention, polyhydric alcohols and polyvalent carboxylic acids, polyvalent carboxylic anhydrides, or polyvalent carboxylates may be used as raw material monomers to form a polyester resin or a polyester unit of a hybrid resin.

Examples of a dihydric alcohol component include bisphenol A alkylene oxide adducts (such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene(2.0)-2,2-bis(4-hydroxyphenyl) propane, and polyoxypropylene(6)-2,2-bis(4-hydroxyphenyl)propane), ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a divalent carboxylic acid component include: aromatic dicarboxylic acids such as phthalic acid, isophthalic acid, and terephthalic acid, or anhydrides thereof; alkyldicarboxylic acids such as succinic acid, dodecenylsuccinic acid, adipic acid, sebacic acid, and azelaic acid, or anhydrides thereof; succinic acid substituted with an alkyl group having 6 to 12 carbon atoms, or anhydrides thereof; and unsaturated dicarboxylic acids such as fumaric acid, maleic acid, and citraconic acid, or anhydrides thereof.

Examples of a trivalent or higher carboxylic acid component include 1,2,4-benzenetricarboxylic acid (also called trimellitic acid), 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds thereof.

It is preferable that, of those, a bisphenol derivative represented in the following general formula (1) be used as a divalent alcohol component, and a divalent or higher carboxylic acid component (such as fumaric acid, maleic acid, maleic anhydride, phthalic acid, terephthalic acid, trimellitic acid, or pyrotrimellitic acid), or an anhydride, or a lower alkylester thereof be used as an acid component. The polyester resin or resin containing a polyester resin unit obtained when using those composition components has excellent charging property.

(1)

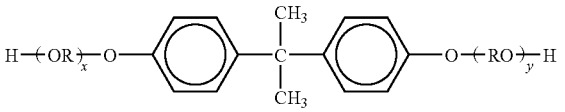

(wherein R represents an ethylene or propylene group, x and y each represent an integer of one or more, and x+y has an average value of 2 to 10.)

A vinyl-based monomer may be used to form a vinyl-based copolymer or a vinyl-based copolymer unit of a hybrid resin when a vinyl-based copolymer or a hybrid resin having a vinyl-based copolymer unit is used as the binder resin in the toner of the present invention. The vinyl-based monomer used in such a case includes the following.

Examples of the vinyl monomer include: styrene; styrenes such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylic acid or methacrylic acid derivatives such as acrylonitrile, methacrylonitrile, and acrylamide.

The examples further include monomers each having a carboxyl group such as: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydrides; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of the α,β-unsaturated acids with lower aliphatic acids; and alkenylmalonic acid, alkenylglutaric acid, alkenyladipic acid, acid anhydrides thereof, and monoesters thereof.

The examples still further include monomers each having a hydroxyl group such as: acrylates or methacrylates such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

When a vinyl-based copolymer or a hybrid resin having a vinyl-based copolymer unit is used as the binder resin in the toner of the present invention, the resins may be crosslinked with a crosslinking agent having two or more vinyl groups. The crosslinking agent used in such a case includes the following.

Examples thereof include: aromatic divinyl compounds such as divinylbenzene and divinylnaphthalene; diacrylate compounds linked with an alkyl chain such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and the above compounds whose acrylate moiety has been replaced with methacrylate; diacrylate compounds linked with an alkyl chain containing an ether linkage such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and the above compounds whose acrylate moiety has been replaced with methacrylate; diacrylate compounds linked with a chain containing an aromatic group and an ether linkage such as polyoxyethylene(2)-2,2-bis(4-hydroxyphenyl) propane diacrylate and polyoxyethylene(4)-2,2-bis(4-hydroxyphenyl)propane diacrylate, and the above compounds whose acrylate moiety has been replaced with methacrylate.

A polyfunctional crosslinking agent other than those described above can be used, and examples thereof include: pentaerythritol triacrylate, trimethylolethane triacrylate, trimethylolpropane triacrylate, tetramethylolmethane tetraacrylate, and oligoester acrylate, and the above compounds whose acrylate moiety has been replaced with methacrylate; triallylcyanurate; and triallyltrimellitate.

When incorporating a hybrid resin with a vinyl-based copolymer unit or a polyester unit into the toner, it is preferable that the vinyl copolymer unit or the polyester unit each contain a monomer unit capable of linking both units with each other.

Of the monomers units constituting the polyester unit, the monomer units capable of reacting with the vinyl-based copolymer unit can be formed from unsaturated dicarboxylic acids such as fumaric acid, maleic acid, citraconic acid, and itaconic acid, or anhydrides thereof. Of the vinyl-based monomer units constituting the vinyl-based polymer unit, monomer units capable of reacting with the polyester unit can be formed from vinyl-based monomers each having a carboxyl group or a hydroxyl group, and acrylates or methacrylates.

A preferable example of a method of obtaining a reaction product between the vinyl-based copolymer unit and the polyester unit involves subjecting a vinyl-based monomer and/or a monomer for polyester to a polymerization reaction in the presence of a polymer containing a monomer unit reactive with each of the vinyl-based copolymer unit and the polyester unit.

Examples of a radical polymerization initiator used when producing a vinyl-based copolymer or a hybrid resin having a vinyl-based copolymer unit include azo compounds (such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, and 2,2'-azobis(2-methyl-propane)), ketone peroxides (such as methyl ethyl ketone peroxide, acetylacetone peroxide, and cylcohexanone peroxide), 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl) peroxycarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate, and di-t-butyl peroxyazelate.

Examples of a method of producing the hybrid resin in the toner of the present invention include the production methods shown in the following (1) to (6).

(1) A method of producing a hybrid resin, including: separately producing a vinyl-based copolymer unit and a polyester unit; dissolving and swelling the vinyl-based copolymer unit and the polyester unit in a small amount of organic solvent; adding an esterification catalyst and alcohol to the solution; and heating the mixture to carry out an ester exchange reaction.

(2) A method of producing a hybrid resin, including: producing a vinyl-based copolymer unit; and subjecting a monomer for polyester (such as alcohol or a carboxylic acid) to a condensation polymerization reaction in the presence of the vinyl-based copolymer unit. That is, the hybrid resin is produced through a reaction between the vinyl-based copolymer unit (a vinyl-based monomer may be added as required) and the monomer for polyester (such as alcohol or a carboxylic acid) and/or polyester. An organic solvent may be appropriately used in this case as well.

(3) A method of producing a hybrid resin, including: producing a polyester unit; and subjecting a vinyl-based monomer to addition polymerization in the presence of the polyester unit. That is, the hybrid resin is produced through a reaction between the polyester unit (a monomer for polyester may be added as required) and the vinyl-based monomer and/or a vinyl-based copolymer unit.

(4) A method of producing a hybrid resin, including: producing a vinyl-based copolymer unit and a polyester unit; and adding a vinyl-based monomer and/or a monomer for polyester (such as alcohol or a carboxylic acid) in the presence of these polymer units to perform polymerization. An organic solvent may be appropriately used in this case as well.

(5) A method of producing a hybrid resin, including: producing a hybrid resin component; and subjecting a vinyl-based monomer and/or a monomer for polyester (such as alcohol or a carboxylic acid) to addition polymerization and/or a condensation polymerization reaction in the presence of the formed hybrid resin component to form a vinyl-based copolymer unit and a polyester unit. An organic solvent may be appropriately used.

The hybrid resin component may be produced with any one of the above methods (2) to (4) or may be produced with a conventionally known production method.

(6) A method of producing a hybrid resin, including: mixing a vinyl-based monomer and a monomer for polyester (such as alcohol or a carboxylic acid); and continuously subjecting the mixture to addition polymerization and a condensation polymerization reaction to produce a vinyl-based copolymer unit and a polyester unit. An organic solvent may be appropriately used.

In the above production methods (1) to (5), multiple polymer units different from each other in molecular weight or in degree of crosslinking can be used as the vinyl-based copolymer unit and/or the polyester unit.

Out of the above production methods (1) to (6), the production method (6) is particularly suitably employed for producing a hybrid resin in the toner of the present invention. In the hybrid resin obtained with the production method (6), the vinyl-based copolymer unit and the polyester unit tend to become extremely uniform.

In addition, in the method (6), the mixture the vinyl-based monomer and the monomer for polyester can be continuously subjected to addition polymerization and a condensation polymerization reaction while the mixture further includes a wax. The further including the wax results in a hybrid resin with improved wax dispersibility.

Furthermore, addition polymerization of vinyl-based monomers and graft polymerization of a vinyl-based monomer to a wax or to a resin can be intentionally performed simultaneously by appropriately selecting a polymerization reaction. For example, addition polymerization of the vinyl-based monomers is performed at a relatively high temperature by using a polymerization initiator having relatively high hydrogen abstraction ability. By doing so, miscibility of the wax in the toner with the vinyl-based copolymer and miscibility of the wax with the hybrid resin can be further improved. As a result, at least part of the wax in the toner can be uniformly dispersed at a molecular level into the binder resin.

The binder resin to be used in the present invention preferably has a peak molecular weight (Mp) of a component soluble in tetrahydrofuran (THF) in the range of 4,000 to 20,000 in a molecular weight distribution in gel permeation chromatography (GPC) measurement, and preferably has a ratio (Mw/Mn) of a weight average molecular weight (Mw) to a number average molecular weight (Mn) of 5 or more. When the Mp is less than 4,000, in some cases, the toner to be obtained poses a problem in terms of storage stability, the hot offset resistance is insufficient, and fusion to a photosensitive drum, filming, and the like easily occur. On the other hand, when the Mp exceeds 20,000, in some cases, the low-temperature fixability is insufficient, the gloss of an image becomes excessively low, and the color mixability is problematic.

The toner of the present invention preferably has an Mp of a binder resin component, which is soluble in THF, in the toner in the range of 4,000 to 20,000 in a molecular weight distribution in GPC measurement, and has a ratio (Mw/Mn) of Mw to Mn of preferably 50 or more, more preferably 100 or more. When the Mp of the resin component in the toner is less than 4,000, in some cases, the storage stability of the toner is problematic, the hot offset resistance is insufficient, and fusion to a photosensitive drum, filming, and the like easily occur. On the other hand, when the Mp exceeds 20,000, in some cases, the low-temperature fixability is insufficient, the gloss of an image becomes excessively low, and the color mixability is problematic. In addition, a ratio Mw/Mn of less than 50 may pose a problem in terms of hot offset resistance.

In order that the Mp of a binder resin component, which is soluble in THF, in the toner of the present invention may be in the range of 4,000 to 20,000, it is sufficient that a binder resin having an Mp of a component soluble in THF in the range of 4,000 to 20,000 be used as a raw material for the toner. In order that the ratio (Mw/Mn) may be 50 or more, a resin having a ratio (Mw/Mn) of 50 or more may be used as a binder resin. Alternatively, a binder resin having a ratio (Mw/Mn) of less than 50 may be subjected to metal crosslinking with an organometallic compound to be described later in a kneading step, which is a step of the toner production process, to achieve a ratio Mw/Mn of 50 or more. In addition, when the ratio Mw/Mn is adjusted by using the method according to metal crosslinking, the ratio Mw/Mn can be adjusted by the kind and addition amount of the organometallic compound, and the temperature at the kneading step.

A binder resin to be contained into the toner of the present invention preferably has a glass transition temperature of 40 to 80° C., and more preferably has a glass transition temperature of 50 to 70° C.

Acid value (AV) of a binder resin to be contained into the toner of the present invention can be in the range of 1 to 40 mg KOH/g. However, the range of acid value (AV) is not limited to the above.

The toner of the present invention contains a colorant for a cyan toner, a magenta toner, a yellow toner, or a black toner.

Colorants for a cyan toner include: C.I. Pigment Blue 2, 3, 15:1, 15:2, 15:3, 16, and 17; C.I. Acid Blue 6 and C.I. Acid Blue 45; and a copper phthalocyanine pigment whose phthalocyanine skeleton has been substituted with 1 to 5 phthalimide methyl groups.

Color pigments for a magenta toner include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35. The examples further include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Color pigments for a yellow toner include: C.I. Pigment Yellow 1, 2, 3, 4, 5, 6, 7, 10, 11, 12, 13, 14, 15, 16, 17, 23, 65, 73, 74, 83, 93, 97, 155, and 180; and C.I. Vat Yellow 1, 3, and 20.

Examples of a colorant for a black toner include carbon black, acetylene black, lamp black, graphite, iron black, aniline black, and cyanine black.

The amount of colorant used is 1 to 15 parts by mass, preferably 3 to 10 parts by mass with respect to 100 parts by mass of the binder resin in view of balance between reproducibility of an intermediate color and coloring power.

When the content of colorant exceeds 15 parts by mass, transparency easily reduces, and reproducibility of an intermediate color typified by a human skin color also easily reduces. Furthermore, charge stability of the toner reduces so that a needed charge amount is hardly obtained. When the content of colorant is less than 1 part by mass, needed coloring power is hardly obtained and a high-quality image with a high image density is hardly obtained.

As described above, the toner of the present invention contains a wax.

Examples of a wax that can be incorporated into the toner of the present invention include: aliphatic hydrocarbon-based waxes such as polyethylene wax, polypropylene wax, olefin copolymer wax, microcrystalline wax, Fischer-Tropsch wax, and paraffin wax; oxides of aliphatic hydrocarbon-based waxes such as oxidized polyethylene wax, and block copolymers of these; waxes mainly composed of aliphatic acid esters such as carnauba wax and montanic acid ester wax; ester waxes produced by synthetic reactions between higher aliphatic acids and higher alcohols such as behenyl behenate and behenyl stearate; and partially or wholly deacidified aliphatic acid esters such as deacidified carnauba wax.

The examples further include: saturated linear aliphatic acids such as palmitic acid, stearic acid, and montanic acid; unsaturated aliphatic acids such as brassidic acid, eleostearic acid, and valinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; aliphatic acid amides such as linoleic acid amide, oleic acid amide, and lauric acid amide; saturated aliphatic acid bisamides such as methylene-bisstearic acid amide, ethylene-biscapric acid amide, ethylene-bislauric acid amide, and hexamethylene-bisstearic acid amide; unsaturated aliphatic acid amides such as ethylene-bisoleic acid amide, hexamethylene-bisoleic acid amide, N,N'-dioleyladipic acid amide, and N,N-dioleylsebacic acid amide; aromatic bisamides such as m-xylene-bisstearic acid amide and N,N'-distearylisophthalic acid amide; aliphatic acid metal salts (generally called metallic soaps) such as calcium stearate, calcium laurate, zinc stearate, and magnesium stearate; waxes obtained by grafting vinyl-based monomers such as styrene and acrylic acid onto aliphatic hydrocarbon-based waxes; partially esterified products between aliphatic acids and polyhydric alcohols such as behenic acid monoglyceride; and methyl ester compounds having hydroxyl groups obtained by hydrogenating vegetable oil and fat.

Examples of a wax preferably used in the present invention include an aliphatic hydrocarbon-based wax. The wax to be used in the present invention is more preferably a polyethylene wax, a Fischer-Tropsch wax, or a paraffin wax, particularly preferably a paraffin wax. When an aliphatic hydrocarbon-based wax is used, the state of dispersion of the wax in the toner can be easily optimized and hence a toner having excellent low-temperature fixability can be obtained. In addition, a toner can be easily obtained, which is capable of expressing high coloring power, a vivid tint, and vivid color mixability, and which has excellent balance among various properties such as developability, transferability, and durability.

In addition, the wax in the toner of the present invention can impart to the toner excellent low-temperature fixability, high coloring power, a vivid tint, vivid color mixability, excellent environmental stability, and excellent durability. Therefore, the peak temperature of the highest endothermic peak in an endothermic curve in differential scanning calorimetry (DSC) measurement of the toner of the present invention is preferably in the range of 60 to 105° C., more preferably in the range of 70 to 90° C. The wax having the peak temperature of the highest endothermic peak of less than 60° C. may deteriorate the storage stability of the toner, for example. On the other hand, the wax having the peak temperature of the highest endothermic peak in excess of 105° C. may make it difficult to perform low-temperature fixation. The low-temperature fixation is desired from the viewpoint of energy savings.

The content of the wax in the toner of the present invention is preferably in the range of 1 to 15 parts by mass, more preferably in the range of 2 to 12 parts by mass with respect to 100 parts by mass of the binder resin. The content of less than 1 part by mass exhibits a small improving effect on low-temperature fixability, whereas the content in excess of 15 parts by mass may pose problems for the storage stability and developability of the toner.

The toner of the present invention preferably has one or two or more endothermic peaks in the temperature range of 30 to 200° C. in an endothermic curve in differential scanning calorimetry (DSC) measurement. In addition, the peak temperature of the highest endothermic peak out of the one or two or more endothermic peaks is preferably in the temperature range of 60 to 105° C., particularly preferably in the temperature range of 70 to 90° C. The toner having a peak temperature of the highest endothermic peak in this range has good balance between excellent low-temperature fixability and excellent developability. The toner having a peak temperature of the highest endothermic peak of less than 60° C. may have the poor storage stability. On the other hand, the toner having a peak temperature of the highest endothermic peak in excess of 105° C. may have deteriorating low-temperature fixability, which is not desirable from the viewpoint of energy savings. Incorporating a wax having a peak temperature of the highest endothermic peak in the range of 60 to 105° C. into a toner allow the toner to have a peak temperature of the highest endothermic peak in the range of 60 to 105° C.

In addition, the toner of the present invention may further contain an organometallic compound. The presence of an organometallic compound is preferable because, for example, a charge level of the toner can be optimized, charge rising can be improved, and hot melt property of the toner can be improved. The organometallic compound in the toner of the present invention is preferably a metal compound of an aromatic carboxylic acid selected from an aromatic oxycarboxylic acid and an aromatic alkoxycarboxylic acid, or a metal compound of a derivative of the aromatic carboxylic acid. The metal in the metal compound is preferably a metal having a valence of 2 or more. Preferable examples of the aromatic carboxylic acid include salicylic acid.

For example, a metal compound of an aromatic carboxylic acid can be synthesized by: dropping an aqueous solution of a metal ion having a valence of 2 or more into an aqueous solution of sodium hydroxide containing an aromatic carboxylic acid; heating and stirring the mixture; adjusting the pH of the aqueous solution; cooling the solution to room temperature; and subjecting the solution to filtration and washing with water. However, the synthesis method is not limited to the above method. Examples of a divalent metal include $Mg^{2+}$, $Ca^{2+}$, $Sr^{2+}$, $Pb^{2+}$, $Fe^{2+}$, $Co^{2+}$, $Ni^{2+}$, $Zn^{2+}$, and $Cu^{2+}$. Of those, $Zn^{2+}$, $Ca^{2+}$, $Mg^{2+}$, and $Sr^{2+}$ are preferable. Examples of a metal having a valence of 3 or more include $Al^{3+}$, $Cr^{3+}$, $Fe^{3+}$, $Ni^{3+}$, and $Zr^{4+}$. Of those metals each having a valence of 3 or more, $Al^{3+}$, $Cr^{3+}$, and $Zr^{4+}$ are preferable, and $Al^{3+}$ and $Zr^{4+}$ are particularly preferable.

The content of the organometallic compound in the toner of the present invention is preferably in the range of 0.1 to 5 parts by mass with respect to 100 parts by mass of the binder resin. The content in this range enables the charge level of the toner to be appropriately adjusted, whereby an absolute charge amount necessary for development can be easily obtained. In addition, as described above, the ratio Mw/Mn can be adjusted via metal crosslinking at the kneading step. Therefore, the hot melt property of the toner can also be improved.

The toner of the present invention is preferably a toner containing a flowability improver added from an outside (hereinafter, referred to as "externally added") to toner host particles. The flowability improver has a function of increasing flowability when externally added to the toner host particles. The flowability improver is added from the viewpoint of improvement in image quality.

Examples of a flowability improver that can be used include: fluorine-based resin powders such as a vinylidene fluoride fine powder and a polytetrafluoroethylene fine powder; silica fine powders such as a silica fine powder obtained through a wet process and a silica fine powder obtained through a dry process; treated silica fine powders obtained by subjecting the silica fine powders to surface treatments with treating agents such as a silane compound, a titanium coupling agent, and silicone oil; titanium oxide fine powders; alumina fine powders; treated titanium oxide fine powders; and treated alumina oxide fine powders. Such a flowability improver has a specific surface area according to nitrogen adsorption measured by means of a BET method of 30 $m^2/g$ or more, preferably 50 $m^2/g$ or more.

The content of the flowability improver in the toner of the present invention is preferably in the range of 0.01 to 10 parts by mass, more preferably in the range of 0.05 to 5 parts by mass with respect to 100 parts by mass of the toner particles.

The toner of the present invention is composed of: toner particles each containing at least a binder resin, a colorant, and a wax; and an external additive such as a flowability improver externally added to the toner particles as required. The toner particles in the present invention can be obtained according to the method described below. That is, toner raw materials are sufficiently mixed in a mixer such as a Henschell mixer or a ball mill, the mixture is melted, kneaded, and milled by using a heat kneader such as a kneader or an extruder, the melt kneaded product is cooled and solidified, the solidified product is pulverized, and the pulverized product is classified, whereby toner particles having a predetermined average particle size can be obtained.

The toner of the present invention preferably has a weight average particle diameter (D4) in the range of 4 to 9 μm. Reducing the weight average particle diameter of the toner provides good reproducibility of an outline portion of a developed image, especially a letter image or a line pattern image.

A weight average particle diameter of less than 4 μm increases, for example, the adhesive force of the toner to the surface of a photosensitive drum. This tends to be responsible for image unevenness based on insufficient transfer. In addition, the charge amount per unit mass of the toner increases so that the image density may reduce for example under a low-temperature and low-humidity environment. Furthermore, for example, in the case where the toner is used in the form of a two-component developer, frictional charging with a carrier is hardly smoothly performed owing to a reduction in flowability and an increase in adhesive property to the surface of a member such as the photosensitive drum. In this case, the amount of toner that cannot be sufficiently charged increases so that fogging in a non-image portion in a developed image becomes remarkable.

A weight average particle diameter in excess of 9 μm advantageously provides excellent flowability of the toner. However, the number of fine particles capable of contributing to an increase in image quality is reduced so that the toner hardly faithfully adheres to a fine electrostatic charge image on a photosensitive drum. As a result, reproducibility of a highlight portion reduces and gradation may reduce. Furthermore, fusion of the toner to the surface of a member such as the photosensitive drum easily occurs.

In addition, it is particularly preferable that a ratio of toner particles each having a particle diameter of 4 μm or less be in the range of 3 to 40 number % and a content of toner particles each having a particle diameter of 10 μm or more be 10 vol % or less. This is because a toner having good balance between developability and transferability can be easily obtained with this condition.

An average circularity of particles each having a circle-equivalent diameter of 3 μm or more in the toner of the present invention is preferably in the range of 0.925 to 0.965, more preferably in the range of 0.930 to 0.965. Setting the average circularity to fall within the range provides the toner with good flowability, good transferability, and good chargeability.

An average circularity of less than 0.925 may result in poor transferability, especially poor transfer efficiency. On the other hand, an average circularity in excess of 0.965 results in an excessively spherical shape so that an image defect due to insufficient cleaning may occur. For example, transfer residual toner passes through a cleaning blade at the time of cleaning of a photosensitive drum.

The toner of the present invention containing a wax may have insufficient performance properties such as transferability and chargeability only by controlling the particle size and circularity of the toner. The inventors of the present invention have found that in order that the toner containing a wax may express excellent performance properties, it is important to control a wax amount on the toner surface.

Then, it has been found that the transmissivity with a toner in a 45-vol % aqueous solution of methanol (described in detail hereinafter) is a simple and highly accurate indicator for grasping the wax amount near the toner surface. Furthermore, it has been found that a toner having a specific transmissivity value expresses excellent performance properties even if the toner contains a wax.

The transmissivity with a toner in a 45-vol % aqueous solution of methanol means the transmissivity of light at a wavelength of 600 nm transmitted through a dispersion liquid prepared by dispersing the toner into a 45-vol % aqueous solution of methanol at a concentration of 2 mg/cm$^2$. The transmissivity with a toner in a 45-vol % aqueous solution of methanol can be measured by using a dispersion liquid obtained by forcedly dispersing the toner into a mixed solvent of water and methanol and by leaving the resultant dispersion for a predetermined period of time. The transmissivity with the toner of the present invention in a 45-vol % aqueous solution of methanol is preferably in the range of 5 to 70%, more preferably in the range of 10 to 50%.

The transmissivity with a toner in a 45-vol % aqueous solution of methanol allows one to accurately grasp the presence amount of wax near the toner surface with good reproducibility.

When a large amount of hydrophobic wax is present on the toner surface, the toner is hardly dispersed into the solvent and agglomerates so that the transmissivity with the toner has a high value (for example, more than 70%). When a small amount of wax is present on the toner surface, a large amount of polyester unit of a hydrophilic binder resin is present on the toner surface. As a result, the toner is uniformly dispersed into a mixed solvent and the transmissivity with the toner has a low value (for example, less than 5%).

When the transmissivity with the toner exceeds 70%, the wax amount on the toner surface is excessively large so that, for example, the wax may be fused to the surface of a developing sleeve to increase the resistance of the developing sleeve. As a result, the effectiveness of an actual developing bias necessary for development reduces and the image density can reduce.

When the transmissivity with the toner is less than 5%, the amount of wax exposed to the toner surface is excessively small so that the effect of the wax is hardly exerted through a image fixation step. As a result, it may be difficult to perform low-temperature image fixation. This is not preferable from the viewpoint of energy savings.

As described above, the transmissivity with the toner of the present invention in a 45-vol % aqueous solution of methanol is preferably in the range of 5 to 70%. Setting the transmissivity with the toner to fall within this range provides a toner having good balance among various properties such as fixability, developability, and transferability, and capable of keeping stable performance for a long period of time.

The toner of the present invention shows a sharper charge distribution when the particle size distribution, the average circularity, and the transmissivity of/with the toner are adjusted as described above. In this case, development efficiency increases and fogging significantly reduces. Furthermore, it becomes possible to faithfully develop a latent image formed on a photosensitive drum. Therefore, the toner of the present invention with the particle size distribution, the average circularity, and the transmissivity adjusted as described above can provide a toner image excellent in gradation and resolution particularly at a highlight portion because the toner is excellent in developability of a fine dot latent image such as a halftone dot or a digital dot. Furthermore, the use of the toner enables the quality of image outputted to be maintained high even in continuous image output, enables a high-density image to be favorably developed with small toner consumption, and enables a full-color image capable of keeping a vivid tint and good color reproducibility for a long period of time to be obtained.

The toner of the present invention can also be applied to an image forming apparatus having an intermediate transfer unit. Image forming apparatuses having intermediate transfer units have rapidly become prevalent in recent years because they can adjust to various transfer materials. An image forming process by using an image forming apparatus having an intermediate transfer unit substantially has two transfer steps. As a result, a reduction in transfer efficiency easily leads to a reduction in toner usability. However, the toner of the present invention with the particle size distribution, the average circularity, and the transmissivity adjusted as described above can be applied to an image forming apparatus having an intermediate transfer unit because the toner has achieved high transferability. The use of the toner of the present invention having high transferability can suppress insufficient transfer such as transfer void which easily occurs in a system using an intermediate transfer unit. Therefore, the reproducibility and tint of a secondary color become extremely good and a beautiful full-color image can be obtained even when arbitrary transfer material is used.

A method of adjusting the average circularity of the toner of the present invention is not particularly limited. For example, a method involving spheroidizing pulverized toner particles by employing a mechanical impact means, a method involving atomizing a melt mixture into the air by using a disk or a multi-fluid nozzle to obtain spherical toner particles, and the like can be employed.

Of the above methods, a method involving spheroidizing pulverized toner particles by employing a mechanical impact means is more preferable, because the use of the method can enable the wax amount on the toner particle surface to be easily optimized. The adjustment of the wax amount on the toner particle surface (that is, the adjustment of the transmissivity with the toner in a 45-vol % aqueous solution of methanol) can be performed by controlling the physical properties of raw materials (in particular, the viscoelasticity of a binder resin) or by controlling the production conditions, especially a melt kneading condition and a polymerization condition. However, how the adjustment is performed is not particularly limited as long as desired physical properties are obtained.

However, there are difficulties in producing a toner simultaneously satisfying those physical even if the many conventional means for producing a toner are used. For example, a toner produced by using air jet-type means has the desired transmissivity with a toner in a 45-vol % aqueous solution of methanol (that is, the transmissivity is in the range of 5 to 70%), but does not have the desired average circularity (that is, the average circularity tends to be less than 0.925).

For example, a hybridizer manufactured by Nara Machinery Co. can have been used as means of spheroidizing toner particle. However, the means applies excessive thermal hysteresis to the toner particles so that the wax in the toner particle is liberated to the toner particle surface. Therefore, the transmissivity with the toner tends to exceed 70%.

In addition, a Kryptron system manufactured by Kawasaki Heavy Industries Co. and a Super Rotor manufactured by Nisshin Engineering Co. can have been used as means of simultaneously performing pulverization and spheroidization of toner particles. However, those means also apply excessive thermal hysteresis to the toner particles. Therefore, the transmissivity with the toner produced by the means tends to exceed 70%.

As described above, a toner having the average circularity of less than 0.925 and the transmissivity in the range of 5 to 70% has been conventionally present. However, the toner has a low circularity and provides insufficient transferability or the like. When the toner is subjected to a spheroidization treatment to allow the toner to have an average circularity in the range of 0.925 to 0.965, a wax in the toner is easily liberated to the toner surface and the transmissivity with the toner exceeds 70%. Therefore, a toner having the desired property such as developability has not been proposed.

Figure 2:
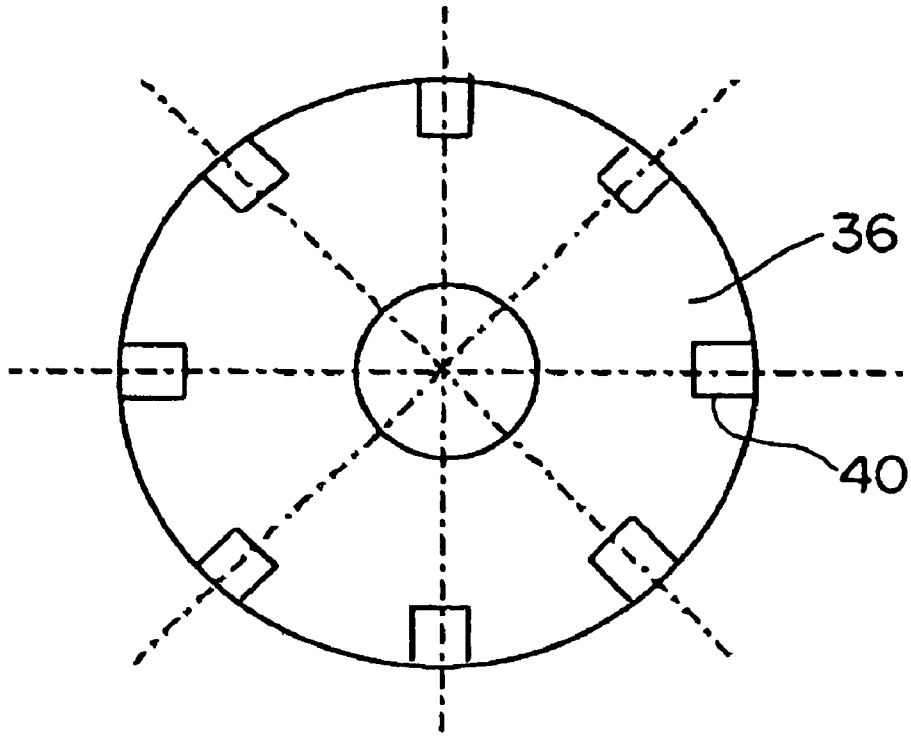
FIG. 2 is a schematic drawing showing an example of a top view of a dispersion rotor in the surface modification apparatus shown in FIG. 1.

In view of the above, an apparatus shown in FIGS. 1 and 2 is preferably exemplified as effective means for allowing the toner of the present invention to have an average circularity in the range of 0.925 to 0.965. By employing the apparatus, the toner simultaneously having the average circularity in the range of 0.925 to 0.965 and the transmissivity in the range of 5 to 70% is obtained.

FIG. 1 is a schematic sectional drawing showing an example of the structure of a surface modification apparatus preferably used for producing the toner of the present invention. FIG. 2 is a schematic plan view showing the structure of a dispersion rotor in the surface modification apparatus shown in FIG. 1.

The surface modification apparatus provides a desired shape and desired performance to a toner by applying a mechanical impact force to the toner while discharging generated fine powders to the outside of the system. In general, when a toner is subjected to a spheroidization treatment in a mechanical manner, extremely small fine powders generated through pulverization treatment reagglomerate to make the shape of the toner particle irregular. Therefore, the spheroidization treatment needs to be performed while the generated extremely small fine powders are discharged to the outside of the system so that a more mechanical impact force than necessary for obtaining a desired the degree of sphericity is required. As a result, a redundant quantity of heat is applied to the toner to thereby increase the wax amount on the toner surface. In addition, extremely small fine powders play a major role in acceleration of spending a carrier.

In contrast, the surface modification apparatus shown in FIGS. 1 and 2, in which a process from the application of a mechanical impact force to the classification is performed without stopping an air flow, can efficiently produce desired particles, because reagglomeration of the extremely small fine powders hardly occurs. A surface modification apparatus 30 shown in FIG. 1 includes: [1] a casing;

[2] a jacket through which cooling water or antifreeze can pass (not shown);

[3] a dispersion rotor 36 serving as means of surface modification, which is disk-like body of rotation rotating at high speed, attached to a central rotation axis in the casing, having multiple square disks or cylindrical pins 40 on its top face;

[4] a liner 34 arranged on the periphery of the dispersion rotor 36 in every predetermined interval, provided with a large number of grooves on its surface (the liner 34 may have no grooves on its surface);

[5] a classification rotor 31 serving as means for classifying surface-modified raw materials into predetermined particle sizes;

[6] a cold air introduction port 35 for introducing cold air;

[7] a raw material supply port 33 for introducing a raw material to be treated;

[8] a discharge valve 38 set so as to be openable/closable so that a surface modification time can be appropriately adjusted;

[9] a powder discharge port 37 for discharging treated powders; and

[10] a cylindrical guide ring 39 serving as guide means for dividing a space surrounded by the classification rotor 31, the dispersion rotor 36 and liner 34 into a first space 41 and a second space 42. Particles pass through the first space 41 before being introduced into the classification rotor 31. And particles from which fine powders are removed with the classification rotor 31 are introduced into the surface treatment means through the second space 42.

A gap portion between the dispersion rotor 36 and the liner 34 is a surface modification zone, whereas the classification rotor 31 and a peripheral portion of the classification rotor 31 constitute a classification zone.

When a finely pulverized product is loaded into the surface modification apparatus through the raw material supply port 33 with the discharge valve 38 closed, the loaded finely pulverized product is first sucked with a blower (not shown) and classified by the classification rotor 31. The classified fine powders each having a predetermined particle size or smaller are continuously discharged to the outside of the apparatus through a fine powder discharge port 32. The coarse powders each having a predetermined particle size or larger ride on a circulation flow generated by the dispersion rotor 36, and are then introduced into the surface modification zone along the inner periphery of the guide ring 39 (the second space 42) by virtue of a centrifugal force.

The raw materials introduced into the surface modification zone receive a mechanical impact force between the dispersion rotor 36 and the liner 34 to be subjected to a surface modification treatment. The surface-modified particles ride on cold air passing through the inside of the apparatus, to thereby be introduced into the classification zone along the outer periphery of the guide ring 39 (the first space 41). The fine powders generated by the surface modification treatment are classified by the classification rotor 31 and discharged to the outside of the apparatus through the fine powder discharge port 32. The coarse powders ride on the circulation flow to return to the surface modification zone, and then are repeatedly subjected to a surface modification treatment. After passing of a predetermined period of time, the discharge valve 38 is opened and the surface-modified particles are recovered through the discharge port 37.

The inventors of the present invention have made studies to find the following. That is, in the surface modification treatment process using the above surface modification apparatus, the time period from the loading of the finely pulverized product through the raw material supply port 33 to the opening of the discharge valve (cycle time), and the number of revolutions of the dispersion rotor (the rotation rate of the dispersion rotor) are important for controlling the average circularity of the toner and the transmissivity with the toner (that is, the wax amount on the toner particle surface). A prolonged the cycle time or an increased the rotation rate of the dispersion rotor is effective in increasing the average circularity. On the other hand, a shortened the cycle time or a reduced the rotation rate is effective in limiting the transmissivity with the toner to a low level.

In particular, when the rotation rate of the dispersion rotor is less than a predetermined rate, the toner cannot be efficiently spheroidized. Therefore, the cycle time need to be prolonged. As a result, the transmissivity with the toner may be increased to excessive. It has been found that setting the rotation rate of the dispersion rotor at $1.2\times10^5$ mm/s or more and the cycle time at 5 to 60 seconds is effective in increasing the circularity of the toner while limiting the transmissivity to a predetermined value or less. Therefore, the toner having the average circularity and the transmissivity in the desired range is obtained.

The toner of the present invention can be used for a one-component developer or for a two-component developer. The use of the toner of the present invention for a two-component developer can provide a more vivid full-color image for a longer period of time.

When the toner of the present invention is used for a two-component developer, the toner of the present invention and a magnetic carrier may be mixed to prepare a two-component developer. Examples of an available magnetic carrier include: surface-oxidized iron or unoxidized iron; and metals such as nickel, copper, zinc, cobalt, manganese, chromium, calcium, magnesium, and rare earth elements, and alloys and oxides thereof; and magnetic ferrites.

In addition, a resin-coated carrier obtained by coating the surface of any one of the above magnetic carriers with a resin or the like is suitably used. A conventionally known method can be adopted as a method of producing a resin-coated carrier without particular limitation. Examples of such a method include: a method in which a resin solution is sprayed onto a magnetic carrier floating and fluidizing, to thereby form a coat film on the carrier surface; a spray dry method; a method in which a coating material such as a resin is dissolved or suspended into a solvent and mixed with a magnetic carrier, and then the solution is gradually evaporated while a shearing stress is applied; and a method in which a powder and a magnetic carrier are merely mixed.

Examples of a coating material for a magnetic carrier include a resin (for example, a silicone resin or a fluorine resin) having a small surface energy expected to be useful in preventing the magnetic carrier from spending by toner fusion. The examples further include a polyester resin, a styrene-based resin, an acryl-based resin, polyamide resin, polyvinyl butyral resin, and an amino acrylate resin. Each of those resins is used singly or is used in combination with another resin.

In addition, the coating material for a magnetic carrier is preferably combined with various additives in order to enhance adhesiveness to the magnetic carrier. Therefore, toughness of a coating is increased. In particular, a solution of silicone resin to which water is added can be used for producing a carrier coated with a silicone resin, whereby the carrier having further improved durability and charging property can be obtained. This is because hydrolysis of a crosslinking point of the silicone resin is promoted to further advance a curing reaction, and because the silicone resin temporarily has an increased surface energy to increase adherence to the magnetic carrier.

The amount of resin solid to be applied to a magnetic carrier is preferably in the range of 0.05 to 10 parts by mass, more preferably 0.1 to 5 parts by mass with respect to 100 parts by mass of the magnetic carrier.

In addition, the weight average particle diameter (D4) of the magnetic carrier is preferably in the range of 25 to 80 μm, more preferably in the range of 30 to 65 μm. The particle size can be measured with a Microtrack particle size analyzer SRA type (manufactured by Nikkiso Co.) at a range setting of 0.7 to 125 μm. A magnetic carrier having a weight average particle diameter of less than 25 μm is hardly mixed with the toner. A magnetic carrier having a weight average particle diameter in excess of 80 μm has a small specific surface so that a charging ability at the time of toner replenishment deteriorates. The deterioration may be responsible for fogging or toner scattering. As described above, a two-component developer can be prepared by mixing the toner of the present invention and the magnetic carrier. The toner concentration in the two-component developer is in the range of 2 to 15 mass %, preferably in the range of 4 to 13 mass %. The developer having a toner concentration of less than 2 mass % tends to reduce an image density. On the other hand, the developer having a toner concentration in excess of 15 mass % easily causes fogging and scattering in a image forming apparatus, and may have a short useful life.

Next, an example of an image forming method to which the toner of the present invention is applied will be described below with reference to drawings showing an image forming apparatus to which the image forming method is applied.

Figure 3:
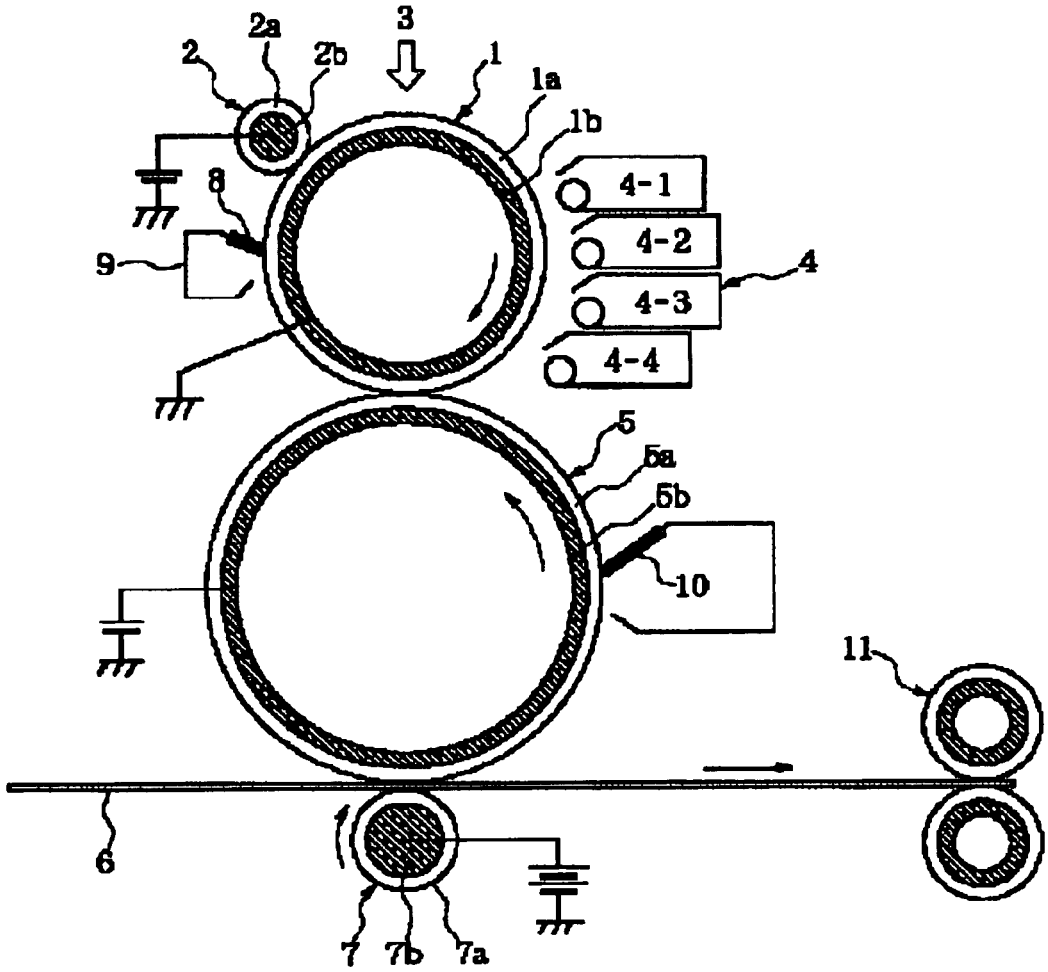
FIG. 3 is a schematic explanatory drawing of an image forming apparatus for a two-component developer used in examples of the present invention.

The toner of the present invention can be used for a two-component developer when mixed with a magnetic carrier. FIG. 3 shows an image forming apparatus using a two-component developer. Developing units 4-1, 4-2, 4-3, and 4-4 contain a developer having a cyan toner, a developer having a magenta toner, a developer having a yellow toner, and a developer having a black toner, respectively. The developing units are configured to develop an electrostatic charge image formed on a photosensitive drum 1 serving as a photosensitive member according to a magnetic brush development method, and then to form the respective toner images on the photosensitive drum 1.

Figure 4:
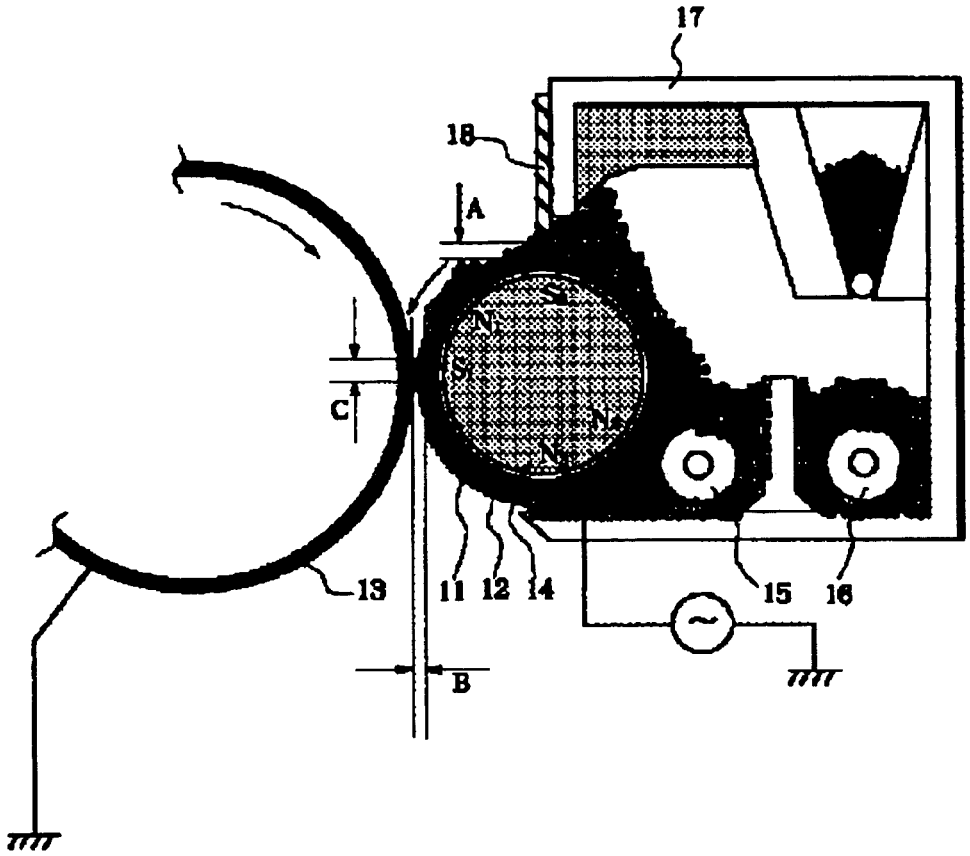
FIG. 4 is an enlarged cross-sectional drawing of a main portion of a developing device for a two-component developer used in examples of the present invention.

FIG. 4 specifically shows a developing unit used in the image forming apparatus shown in FIG. 3 (FIG. 4, which shows only one developing unit for the photosensitive drum, specifically shows one of the developing units in FIG. 3.). To be specific, development is preferably performed in a state where a magnetic brush 12 contacts a photosensitive drum 13 while an alternating electric field is applied. A distance B between a developing sleeve 11 serving as a developer carrier and the photosensitive drum 13 is preferably in the range of 100 to 1,000 μm. In FIG. 4, reference numeral 14 denotes a magnet roller; 15 and 16, screws for stirring and feeding a developer; and 18, a regulating member for regulating thickness of the developer layer on the developing sleeve to a thickness A.

The alternating electric field preferably has a voltage between peaks (Vpp) in the range of 500 to 5,000 V and a frequency (f) in the range of 500 to 10,000 Hz. The waveform of the alternating electric field to be used can be selected from various waveforms such as a triangular waveform, a rectangular waveform, a sinusoidal waveform, and a waveform adjusted its duty ratio. A contrast potential is preferably in the range of 200 to 500 V so that a sufficient image density is obtained.

In order to obtain a sufficient image density and to perform development excellent in dot reproducibility and causing no adhesion of a magnetic carrier to a photosensitive drum, a contact width (development nip C) between the magnetic brush 12 on the developing sleeve 11 and the photosensitive drum 13 is preferably set at 3 to 8 mm.

Figure 5:
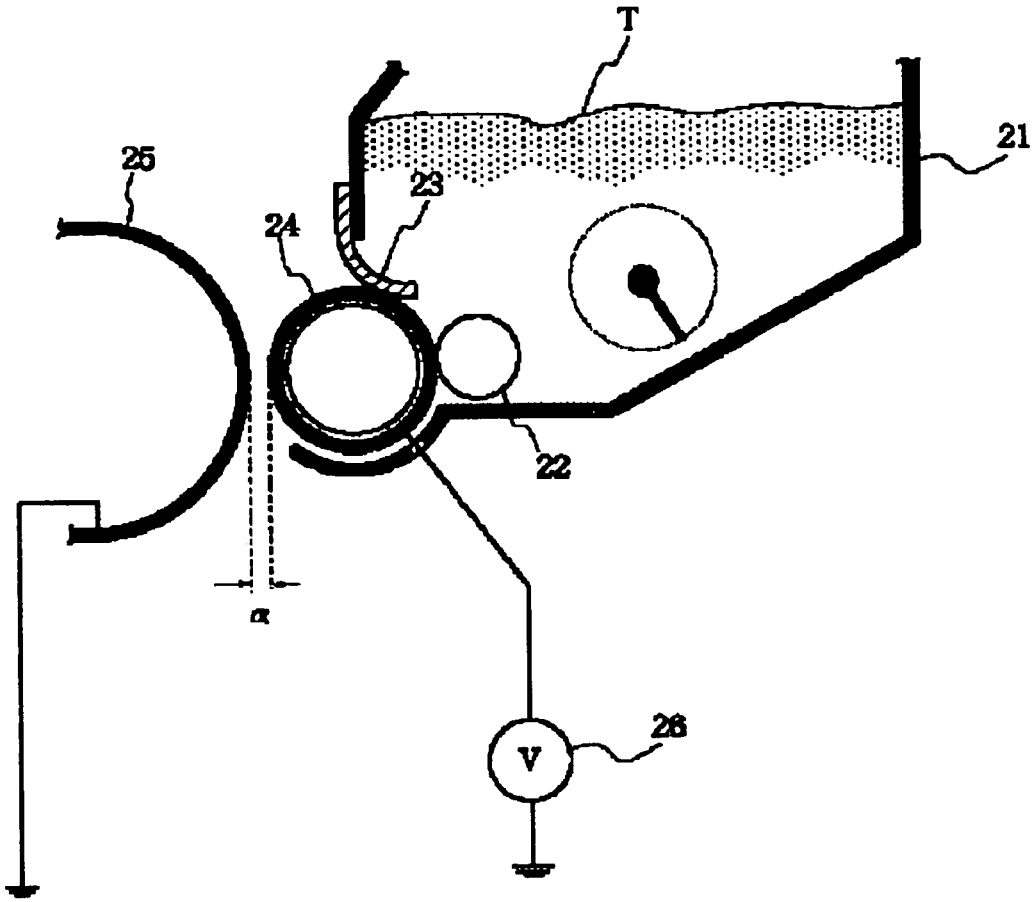
FIG. 5 is a schematic explanatory drawing of an image forming apparatus for a nonmagnetic one-component developer to which the toner of the present invention can be applied.

The toner of the present invention can be used for a nonmagnetic one-component developer without being mixed with a magnetic carrier. The nonmagnetic one-component developer can be applied to developing means shown in FIG. 5. FIG. 5 is a schematic drawing of an image forming apparatus using nonmagnetic one-component development. In FIG. 5, reference numeral 25 denotes a photosensitive drum. A latent image is formed by electrophotographic process means. A bias is applied by a bias power source 26 between a developing sleeve 24 serving as a toner carrier and the photosensitive drum. The developing sleeve 24 is preferably a cylinder composed of stainless steel, aluminum, or the like. As required, the surface of the developing sleeve 24 may be coated with a resin into which fine particles of a metal, carbon black, a charge control agent, or the like are dispersed. A gap a between the photosensitive drum and the developing sleeve 24 can be set at 50 to 500 μm in the case of jumping development. In the case of contact development, the photosensitive drum and the developing sleeve are brought into contact with each other (that is, $\alpha=0$) or are made opposite to each other with a gap between them narrower than the toner layer to be formed on the developing sleeve. The development nip width is preferably set at 0.2 to 8.0 mm. In addition, in the case of contact development, a developing sleeve to be preferably used is one having an elastic layer on its surface, that is, a so-called elastic roller. The hardness of a material for an elastic layer to be used is preferably in the range of 30 to 60 degrees (asker-C/load of 1 kg).

A substantially right-half spherical surface of the developing sleeve 24 is always in contact with a toner reservoir in a toner container 21. The toner near the right-half spherical surface of the developing sleeve 24 adheres to and is held on the surface of developing sleeve 24 by virtue of an electrostatic force.

Setting the surface roughness Ra (μm) of the developing sleeve at 1.5 or less can allow the toner layer on the developing sleeve to be thin. The traveling speed of the surface of the developing sleeve is preferably set to be 1.05 to 3.0 times as high as the traveling speed of the surface of the photosensitive drum.

A toner T is stored in the toner container 21 and is supplied onto the developing sleeve by a supply member 22. A supply member to be preferably used is a supply roller composed of a porous elastic body, for example, a foamed material such as a soft polyurethane foam. The supply member 22 is allowed to rotate at a relative speed in the forward or backward direction with respect to the developing sleeve. The supply member 22 supplies the toner onto the developing sleeve from toner container and strips a toner on the developing sleeve after development (that is, transfer residual toner).

The toner supplied onto the developing sleeve is uniformly applied by a regulating member 23 to form a thin layer. A regulating member for thinning a toner layer is a doctor blade (such as a metal blade or a magnetic blade). The regulating member 23 can be placed at a predetermined distance from the developing sleeve. An elastic body such as an elastic blade or elastic roller, which can apply a toner under pressure to the developing sleeve, may also be used as a regulating member for thinning a toner layer.

For example, in FIG. 5, a substrate at an upper portion of the elastic blade serving as the regulating member 23 is fixed to and held on the side of the toner container 21. A lower portion of the inner face side of the elastic blade, which is bent against the elasticity of the blade, is brought into contact with the surface of the developing sleeve 24 under an appropriate pressure in the forward or backward direction of the developing sleeve 24. With such a composition, an exact toner layer stable toward environmental variations can be formed. A material for the elastic blade is preferably selected from frictional charging-type materials suitable for charging a toner to desired polarity. Examples of an available material include: rubber elastic material such as a silicone rubber, a urethane rubber, and an NBR; synthetic resin elastic material such as polyethylene terephthalate; metal elastic material such as stainless steel, steel, and phosphor bronze; and composites thereof. In addition, when durability is demanded for the regulating member and the developing sleeve, a resin or rubber is preferably affixed to or coat-applied to a sleeve contacting portion of a metal elastic member.

A contact pressure between the elastic member and the developing sleeve is preferably in the range of 0.1 to 30 kPa. In addition, a gap between the elastic blade and the developing sleeve is preferably set in the range of 50 to 400 μm.

Hereinafter, methods of measuring various physical properties employed in the present invention will be described.

<Quantification of Wax Concentration of Toner Extract>

(1) Preparation of Sample

The following operations are performed in a room with its temperature controlled at 23° C.

300 mg of toner are precisely weighed and charged into a 30-$cm^3$ sample bottle (for example, trade name "SV-30" manufactured by Nichiden-Rika Glass Co.), and a 2 cm-long stirring bar for a magnetic stirrer is placed into the bottle. Next, 20 $cm^3$ of solvent (n-hexane or toluene) the temperature of which is adjusted at 23° C. are quickly charged into the bottle while the stirring bar is allowed to rotate by using a magnetic stirrer, and then the bottle is sealed. The number of revolutions of the stirring bar is adjusted in such a manner that the toner is sufficiently dispersed into the solvent, and then an extraction time is measured. Immediately after a predetermined period of time has passed, an extract is sucked into a syringe and filtered through a solvent-resistant membrane filter having a pore diameter of 0.45 μm (for example, trade name "Maeshori Disk" manufactured by Tosoh Co.) to prepare a sample solution as a toner extract.

(2) Gas Chromatograph Measuring Device and Measurement Conditions

The resultant sample solution is subjected to gas chromatograph analysis under the following conditions. The wax concentration in the extracted sample solution is calculated as follows. Several samples completely dissolving a wax into n-hexane or toluene are prepared in advance. Then, the samples are subjected to gas chromatograph analysis to create a calibration curve from a wax concentration and an area value of a wax peak on a gas chromatograph chart. Finally, the wax concentration in the extracted sample solution is calculated on the basis of the calibration curve.

Measurement Conditions:

Gas chromatograph: HEWLETT PACKARD 6890GC

Detector: flame ionization detector (FID)

Column: DB-1ht (manufactured by J & W, having a length of 30 m, an inner diameter of 0.25 mm, and a wall thickness of 0.10 μm)

Injection port temperature: 400° C.

Detector temperature: 430° C.

Carrier gas: He

Oven temperature: started from 150° C., increased up to 400° C. at 10° C./min, held for 15 minutes Injection amount: $5.0\times10^{-3}$ $cm^3$ Splitless, constant flow 1.0 $cm^3$/min <Measurement of Degree of Agglomeration A and Degree of Agglomeration B>

(1) Preparation of Sample (i) Preparation of Sample for Measurement of Degree of Agglomeration A 20 g of toner are weighed and placed into a cylindrical container having a diameter of 4 cm. Then, the upper surface of the toner sample placed into the container is leveled and the toner is left for 30 minutes. After that, tapping is performed 50 times and then the toner is left for an additional 1 hour. Subsequently, the container is left under an environment of 23° C. and 50% RH for 24 hours. After that, the total amount of toner is transferred to a sample bottle made of polyethylene, and is sufficiently mixed.

(ii) Preparation of Sample for Measurement of Degree of Agglomeration B 20 g of toner are weighed and placed into a cylindrical container having a diameter of 4 cm. Then, the upper surface of the toner sample placed into the container is leveled and the toner is left for 30 minutes. After that, tapping is performed 50 times and then the toner is left for an additional 1 hour. Next, a load of 1.56 kPa is uniformly applied to the sample surface, and the sample is left in a drier of 50° C. and 12% RH for 24 hours. Subsequently, the load is released and the sample is left under an environment of 23° C. and 50% RH for 24 hours. After that, the total amount of toner is transferred to a sample bottle made of polyethylene and sufficiently mixed.

(2) Measurement

Measurement of degree of agglomeration is performed by using a Powder Tester PT-R manufactured by Hosokawa Micron Corporation and three kinds of sieves each having an aperture of 150 μm (upper sieve), 75 μm (middle sieve), or 38 μm (lower sieve). 5.0 g of the above sufficiently mixed toner are weighed and placed on the uppermost sieve. And the sieves are vibrated at a vibration width of 0.50 mm for 10 seconds. Then, the degree of agglomeration is calculated from the following expression by using the amounts of toner remaining on the respective sieves.

$$\text{Degree of agglomeration (\%)}=\{(1.0\times a+0.6\times b+0.2\times c)/5.0\}\times 100$$

(In the expression, a denotes the mass of toner remaining on the upper sieve having an aperture of 150 μm, b denotes the mass of toner remaining on the middle sieve having an aperture of 75 μm, and c denotes the mass of toner remaining on the lower sieve having an aperture of 38 μm.)

<Measurement of Transmissivity with Toner in 45-Vol % Aqueous Solution of Methanol>

(1) Preparation of Toner Dispersion

An aqueous solution with a methanol-to-water volume mixing ratio of 45:55 is prepared. 10 $cm^3$ of the aqueous solution are charged into a 30-$cm^3$ sample bottle (for example, trade name "SV-30" manufactured by Nichiden-Rika Glass Co.), and 20 mg of the toner is dipped in the solution, followed by capping the bottle. After that, the bottle including the sample solution is shaken with a Yayoi shaker (model: YS-LD, manufactured by Yayoi Corporation) for 5 seconds at 2.5 $s^{-1}$. At this time, the angle at which the bottle is shaken is set as follows. A direction right above the shaker (vertical direction) is set at 0°, and a shaking support moves forward by 15° and backward by 20°. The sample bottle is fixed to a fixing holder (prepared by fixing the cap of the sample bottle onto an extension line of the center of the support) attached to the tip of the support. A solution 30 seconds after completion of the shaking the bottle including the sample solution is provided as a dispersion for measurement of transmissivity.

(2) Measurement of Transmissivity

The dispersion prepared in (1) is charged into a 1 cm square quartz cell. The transmissivity (%) of light at a wavelength of 600 nm transmitted through the dispersion charged into the cell is measured by using a spectrophotometer MPS 2000 (manufactured by Shimadzu Corporation) 10 minutes after the cell including the dispersion has been loaded into the spectrophotometer.

$$\text{Transmissivity (\%)}=I/I_0\times 100$$

(In the expression, $I_0$ denotes incident luminous flux, and I denotes transmitted luminous flux.)

<Measurement of Weight Average Particle Diameter (D4) and Particle Size Distribution of Toner>

The weight average particle diameter (D4) and particle size distribution of a toner can be measured with various means such as a Coulter Counter TA-II or Coulter Multisizer (manufactured by Beckman Coulter, Inc). In the present invention, the Coulter Multisizer is preferably used, and an interface (manufactured by Nikkaki Bios Co.) and a personal computer for outputting a number distribution and a volume distribution are connected to it. A 1% aqueous solution of NaCl prepared by using extra-pure sodium chloride is employed as an electrolyte. For example, an ISOTON R-II (manufactured by Coulter Scientific Japan, Co.) can be employed as an electrolyte.

A measurement method is as follows. To 100 to 150 $cm^3$ of the electrolyte, 0.1 to 0.3 $cm^3$ of surfactant (preferably alkylbenzene sulfonate) as a dispersant, and then 2 to 20 mg of measurement sample are added. The electrolyte in which the sample is suspended is subjected to a dispersion treatment by an ultrasonic disperser for about 1 to 3 minutes. After that, by using the Coulter Multisizer with a 100-μm aperture, the volume and number of toner particles each having a particle diameter of 2 μm or more are measured to calculate a volume distribution and a number distribution.

The weight average particle diameter (D4: the central value of each channel is defined as a representative value) can be determined from the calculated results.

<Measurement of Weight Average Particle Diameter (D4) of Magnetic Carrier>

The weight average particle diameter (D4) can be measured with a Microtrack particle size analyzer SRA type (manufactured by Nikkiso Co.) at a range setting of 0.7 to 125 μm.

<Measurement of Average Circularity of Toner>

The average circularity of the toner is calculated according to the following expressions by using a measurement result with a flow-type particle image measuring device "FPIA-2100" (manufactured by Sysmex Corporation).

$$\text{Circularity}=(\text{Circumferential length of a circle having the same area as the particle projected area})/(\text{Circumferential length of a particle projected image})$$

The term "particle projected area" is defined as an area of a binarized toner particle image, whereas the term "circumferential length of a particle projected image" is defined as the length of a borderline obtained by connecting the edge points of the toner particle image. The measurement of them is performed by using a toner particle image that has been subjected to image processing at an image resolution of 512×512 (a pixel measuring 0.3 μm×0.3 μm).

The circularity is an indicator of the degree of irregularities on a toner particle. The circularity is 1.00 when the toner particle has a completely spherical shape. The more complicated the surface shape, the lower the circularity.

In addition, the average circularity C means the average value of a frequency distribution of circularity.

In the above measurement, particles each having a circle-equivalent diameter of 3 μm or more are objects of the measurement. The circle-equivalent diameter can be determined from the following expression.

$$\text{Circle-equivalent diameter}=(\text{Particle projected area}/\pi)^{1/2}\times 2$$

The measuring device "FPIA-2100", which is used in the present invention, calculates the average circularity according to the following procedure. First, the circularities of the respective particles are calculated. Then, the particles are classified into classes, which are obtained by equally dividing the circularity range of 0.4 to 1.0 at an interval of 0.01, depending on the resultant circularities. After that, the average circularity is calculated from the central value of each class and the number of particles classified into the each class.

The average circularity C is calculated from the following expression when a central value of a class into which a particle i is classified is denoted by $c_i$ and the number of measured particles is denoted by m.

$$\text{Average circularity } C = \sum_{i=1}^{m} (c_i/m)$$

A specific measurement method is as follows. 10 ml of ion-exchanged water from which an impurity solid and the like have been removed in advance are prepared in a vessel. To the ion-exchanged water, a surfactant (preferably alkylbenzene sulfonate) as a dispersant, and then 0.02 g of measurement sample are added. As a result, the sample is uniformly dispersed into the mixture. The resultant mixture is subjected to a dispersion treatment for 2 minutes by an ultrasonic disperser "Tetora 150" (manufactured by Nikkaki-Bios Co.) as dispersion means to prepare a dispersion for measurement. At that time, the dispersion is appropriately cooled in order that the temperature of the dispersion may not be 40° C. or higher. The flow-type particle image measuring device FPIA-2100 is placed in environment of controlled temperature at 23° C.±0.5° C., thereby a temperature inside the device is in the range of 26 to 27° C. As a result, a variation in circularity is suppressed. Automatic focusing is performed by employing a 2-μm latex particle at a predetermined time interval, preferably at an interval of 2 hours.

The flow-type particle image measuring device is used for the measurement of the circularity of a toner particle. The concentration of toner particles in the dispersion is adjusted again in such a manner that the concentration at the time of measurement is in the range of 3,000 to 10,000 particles/μl, and 1,000 or more particles are measured. The average circularity of the particles is determined on the basis of a data which is obtained by removing the measurement results from particles each having a circle-equivalent diameter of less than 3 μm from the measurement results from all measured particles (1,000 or more particles).

The measuring device "FPIA-2100", which is used in the present invention, has increased the magnification of a processed particle image and increased the processing resolution of a captured image (256×256 to 512×512) as compared to a measuring device "FPIA-1000", which has been used to analyze the shape of toner. Whereby, FPIA-2100 has increased the accuracy of toner shape measurement. As a result, the measuring device "FPIA-2100" has achieved more accurate capture of a fine particle. Therefore, the FPIA-2100 is more suitable than the FPIA-1000 in the case where a shape of a toner particle must be measured more accurately as in the present invention.

<Measurement of the Highest Endothermic Peak Temperature of Wax and Toner>

Measurement of the highest endothermic peak temperature of wax or toner is performed by using a differential scanning calorimeter (DSC measuring device) such as a DSC-7 (manufactured by Perkin Elmer Co.) or a DSC2920 (manufactured by TA Instruments Japan Co.) in conformance with ASTM D3418-82. 2 to 10 mg, preferably 5 mg, of measurement sample is precisely weighed. The weighed sample is charged into an aluminum pan, and measurement is performed at the measurement temperature range of 30 to 200° C. and at a heating rate of 10° C./min. An empty aluminum pan is used as a reference. In the measurement, the temperature is once increased and then decreased, and increased again. The highest endothermic peak in the DSC curve in the temperature range of 30 to 200° C. in the heating process is defined as the highest endothermic peak of the endothermic curve in the DSC measurement of the toner of the present invention.

<Measurement of Molecular Weight Distribution of Binder Resin and Binder Resin Component Incorporated into Toner>

Measurement of the molecular weight distribution of a resin component soluble in tetrahydrofuran (THF) by means of gel permeation chromatography (GPC) is performed as follows.

A binder resin or a toner is left in THF at room temperature for 24 hours to be dissolved into THF. The resultant solution is filtered through a solvent-resistant membrane filter having a pore diameter of 0.45 μm (for example, trade name "Myshori Disk" manufactured by Tosoh Corporation) to prepare a sample solution. The amount of the binder resin or toner to be used is adjusted in such a manner that the concentration of resin component soluble in THF in the sample solution is in the range of 0.4 to 0.6 mass %. The sample solution is subjected to measurement under the following conditions.

[Measurement Conditions]

Device: High-performance GPC HLC8120 GPC (manufactured by Tosoh Corporation)

Column: a seven series of Shodex KF-801, 802, 803, 804, 805, 806, and 807 (manufactured by Showa Denko K. K.)

Eluent: tetrahydrofuran

Flow rate: 1.0 $cm^3$/min

Oven temperature: 40.0° C.

Sample injection amount: 0.10 $cm^3$

In addition, a molecular weight calibration curve prepared with standard polystyrene resins (TSK Standard Polystyrene F-850, F-450, F-288, F-128, F-80, F-40, F-20, F-10, F-4, F-2, F-1, A-5000, A-5.000, A-1000, and A-500 manufactured by Tosoh Corporation) is employed for calculating the molecular weight of a sample.

<Measurement of Molecular Weight Distribution of Wax>

Measurement of molecular weight distribution of wax is performed by means of gel permeation chromatography (GPC) under the following condition.

[Measurement Conditions]

Device: GPC-150C (manufactured by Waters Corporation)

Column: Shodex KF-80M (manufactured by Showa Denko K. K.)

Oven temperature: 135° C.

Eluent: o-dichlorobenzene (containing the additive of 0.1% methanol)

Flow rate: 1.0 $cm^3$/min

Sample injection amount: 0.40 $cm^3$ of a sample solution (0.15%)

In addition, a molecular weight calibration curve prepared with monodisperse polystyrene standard sample is employed for calculating the molecular weight of a sample.

A sample is prepared as follows.

A wax sample to be measured is added to o-dichlorobenzene contained in a sample bottle. The sample bottle including the wax sample is heated on a hot plate set at 150° C. so that the wax sample is dissolved in o-dichlorobenzene. The resultant wax solution is set up in the filter unit of the measuring device GPC-150C. A GPC sample solution is obtained from passing the wax solution through the filter unit. A concentration of wax in the GPC sample solution is adjusted at 0.15 mass %.

<Measurement of Viscoelasticity of Color Toner>

The storage elastic modulus G' and loss elastic modulus G" of a toner are measured by means of the following means and under the following conditions.

The viscoelasticity measurement apparatus ("Rheometer ARES", manufactured by TA INSTRUMENT corporation) is used as measuring device. A toner is press-molded with a tableting machine into disk-like sample having a diameter of 7.9 mm and a thickness of 2.0±0.3 mm.

The disk-like sample is set on a parallel plate, and heated from room temperature to 120° C. over 15 minute so that a shape of the disk-like sample is arranged. After that, the tablet sample is cooled to the initial starting temperature, and then is subjected to measurement of viscoelasticity of the sample. A setting the tablet sample in such a manner that the initial normal force is adjusted to zero is important.

Measurement of viscoelasticity is performed under the following condition.

[Measurement Conditions]

1. Parallel plate of 8 mm in diameter is used.
2. Measurement frequency is set at 6.28 rad/sec.
3. Initial value of applied strain is set at 0.1%.
4. Measurement temperature is increased at a rate of 2.0/min from 30° C. to 200° C.

Measurement of viscoelasticity is under the following set-ups of automatic adjustment mode.

Automatic strain adjustment mode (Auto Strain) is employed in the measurement.

5. "Max Applied Strain" is set at 20.0%.
6. "Max Applied Torque" and "Min Allowed Torque" are set at 200.0 g·cm and 0.2 g·cm, respectively.
7. "Strain Adjustment" is set at 20.0% of "Current Strain."

Automatic tension adjustment mode (Auto Tension) is employed in the measurement.

8. Automatic direction of the tension ("Auto Tension") is set to "Compression."
9. "Initial Static Force" is set at 10.0 g, "Auto Tension Sensitibity" set at 40.0 g.
10. Operation condition of "Auto Tension" is set at $1.0\times10^3$ of "Sample Modulus." <Measurement of glass transition temperature of binder resin>

Measurement of acid value of binder resin is performed in conformance with ASTM D3418-82 by using a differential scanning calorimeter (DSC measuring device).

5 to 20 mg, or preferably to 10 mg of the measurement sample is exactly weighed. The weighed sample is placed on an aluminum pan. As a reference, an empty aluminum pan is also used to carry out the measurement at ascending temperature rate of 10° C./minute, and in a measurement temperature range of 30° C. to 200° C.

In this ascending temperature process, a change in specific heat is observed within the temperature range of 40° C. to 100° C. At this time, there is an intersection point of a middle line and a differential thermal curve, the middle line is between base lines before and after the specific heat change. This intersection point is defined as the glass transition temperature of the binder resin of the present invention.

<Measurement of Acid Value of Binder Resin>

Measurement of acid value (AV) of binder resin is performed in conformance with ASTM D3418-82 as follows.

2 to 10 g of a binder resin is weighted in a 200 to 300 ml triangular flask. Then, about 50 ml of a methanol-toluene solvent mixture with a methanol-to-toluene mixing ratio of 30:70 is added into the triangular flask to dissolve the resin. A small amount of acetone may be further added if the solubility of the binder resin is poor. The resultant solution is titrated with a previously standardized N/10 potassium hydroxide-alcohol solution by using a 0.1% mixed indicator of bromothymol blue and phenol red. Then, the acid value is determined from the consumption of the potassium hydroxide-alcohol solution by using the following equation.

$$\text{Acid Value}=\text{KOH (ml)}\times f\times 56.1/\text{Sample Mass (g)}$$

(where f denotes a factor of N/10 KOH.)

EXAMPLES

Hereinafter, specific examples of the present invention will be described. However, the scope of the present invention is not limited to these examples. The term "part" in a loading means "part by mass".

<Production of Binder Resin>

Production Example of Hybrid Resin A

Placed into an autoclave equipped with a thermometer, a stirrer, a condenser, and a nitrogen gas-introducing pipe were 100.00 parts of toluene, 100.00 parts of octane, 36.26 parts (35.0 mol %) of polyoxypropylene(2.2)-2,2-bis(4-hydroxyphenyl)propane, 14.48 parts (15.0 mol %) of polyoxyethylene(2.2)-2,2-bis(4-hydroxyphenyl)propane, 15.38 parts (31.3 mol %) of terephthalic acid, 7.09 parts (12.4 mol %) of trimellitic anhydride, 2.19 parts (6.3 mol %) of fumaric acid, 4.00 parts of purified normal paraffin wax having a peak temperature of the highest endothermic peak in DSC of 75° C., and 0.30 part of dibutyltin oxide. After the air in the autoclave had been substituted by nitrogen gas, the autoclave was sealed. Then, the temperature in the autoclave was gradually increased while the mixture was stirred, and the temperature was held at 180° C.

In the meantime, 17.80 parts of styrene, 4.80 parts of 2-ethylhexyl acrylate, 2.00 parts of fumaric acid, and 0.50 part of di-t-butylperoxide were sufficiently mixed at room temperature. The mixture was poured into the autoclave over 3 hours to perform radical polymerization of a vinyl-based monomer, thereby resulting in a vinyl-based copolymer. At the same time, part of the paraffin wax was subjected to a grafting reaction with the vinyl-based monomer. After that, the temperature of the reaction solution was increased up to 200° C. and held at the temperature for 3 hours. Then, the temperature of the reaction solution was cooled to 100° C. and held at the temperature. The produced condensed water and large parts of toluene and octane were distilled off from the reaction mixture under reduced pressure. After that, the temperature of the reaction solution was increased up to 200° C. and held at the temperature for 3 hours to complete the condensation reaction. At the same time, dehydration and solvent removal were performed to obtain a hybrid resin A. Hybrid resin A has glass transition temperature (Tg) of 62° C. and acid value (AV) of 28. Table 1 shows the molecular weight measurements by means of GPC.

Production Example of Hybrid Resin B

Placed into a reaction vessel equipped with a thermometer, a stirrer, a condenser, and a nitrogen gas-introducing pipe were 36.26 parts (35.0 mol %) of polyoxypropylene(2,2)-2,2-bis(4-hydroxyphenyl)propane, 14.48 parts (15.0 mol %) of polyoxyethylene(2,2)-2,2-bis(4-hydroxyphenyl)propane, 15.38 parts (31.3 mol %) of terephthalic acid, 7.09 parts (12.4 mol %) of trimellitic anhydride, 2.19 parts (6.3 mol %) of fumaric acid, and 0.30 part of dibutyltin oxide. After the air in the reaction vessel had been substituted by nitrogen gas, the temperature in the reaction vessel was gradually increased while the mixture was stirred. Finally, the stirring was performed at a temperature of 130° C.

In the meantime, 17.80 parts of styrene, 4.80 parts of 2-ethylhexyl acrylate, 2.00 part of fumaric acid, 0.68 part of dimer of α-methylstyrene, and 1.13 part of dicumyl peroxide were sufficiently mixed at room temperature. The mixture was dropped into the reaction vessel over 5 hours. After that, the temperature of the reaction solution was increased up to 200° C. and the reaction solution was subjected to a reaction for 6 hours to obtain a hybrid resin B. A Hybrid resin B has glass transition temperature (Tg) of 61° C. and acid value (AV) of 30. Table 1 shows the molecular weight measurements by means of GPC.

Production Example of Polyester Resin C

Placed into a reaction vessel equipped with a thermometer, a stirrer, a condenser, and a nitrogen gas-introducing pipe were 48.10 parts (35.0 mol %) of polyoxypropylene(2,2)-2,2-bis(4-hydroxyphenyl)propane, 19.20 parts (15.0 mol %) of polyoxyethylene(2,2)-2,2-bis(4-hydroxyphenyl)propane, 20.40 parts (31.3 mol %) of terephthalic acid, 9.40 parts (12.4 mol %) of trimellitic anhydride, 2.90 parts (6.3 mol %) of fumaric acid, and 0.30 part of dibutyltin oxide. After the air in the reaction vessel had been substituted by nitrogen gas, the temperature in the reaction vessel was gradually increased while the mixture was stirred. The mixture was subjected to a condensation reaction at 215° C. for 4 hours to obtain a polyester resin C. A polyester resin C has glass transition temperature (Tg) of 60° C. and acid value (AV) of 28. Table 1 shows the molecular weight measurements by means of GPC.

Production Example of Vinyl-based Copolymer D 200.0 parts of xylene were loaded into a reaction vessel equipped with a thermometer, a stirrer, a condenser, and a nitrogen gas-introducing pipe. The air in the reaction vessel was sufficiently substituted by nitrogen gas while the mixture was stirred, and the temperature in the reaction vessel was increased up to 120° C. The following components were sufficiently mixed at room temperature, and the resultant mixture was dropped into the reaction vessel over 5 hours to perform radical polymerization. The temperature in the reaction vessel was additionally increased and the radical polymerization was completed under xylene reflux. The solvent was distilled off under reduced pressure to obtain a vinyl-based copolymer D. A vinyl-based copolymer D has glass transition temperature (Tg) of 60° C. and acid value (AV) of 18. Table 1 shows the molecular weight measurements by means of GPC.

| | |
|---|---|
| Styrene | 77.00 parts |
| 2-ethylhexyl acrylate | 18.00 parts |
| Monobutyl maleate | 5.00 parts |
| Di-t-butylperoxide | 1.00 part |

TABLE 1

| | Weight average molecular weight (Mw) | Number average molecular weight (Mn) | Main peak molecular weight (Mp) | Mw/Mn |
|---|---|---|---|---|
| Hybrid resin A | 124000 | 2900 | 8000 | 43 |
| Hybrid resin B | 103000 | 3500 | 8000 | 29 |
| Polyester resin C | 27000 | 2300 | 8000 | 12 |
| Vinyl-based copolymer D | 68000 | 6700 | 9000 | 10 |

Table 2 shows the physical properties of waxes A to D in the hybrid resin A or in the toners to be described later.

TABLE 2

| | Kind | Highest endothermic peak(° C.) | Mn | Mw |
|---|---|---|---|---|
| Wax A | Purified normal paraffin | 75 | 375 | 488 |
| Wax B | Ester wax mainly composed of stearyl stearate (92 mass % purity) | 68 | 885 | 894 |
| Wax C | Polyethylene | 120 | 1013 | 8882 |
| Wax D | Ester wax mainly composed of behenyl behenate (95 mass % purity) | 78 | 1071 | 1082 |

<Toner Production>

Toner Production Example 1

| | |
|---|---|
| Hybrid resin A | 104.00 parts |
| C.I. Pigment Blue 15:3 | 4.00 parts |
| Aluminum 3,5-di-t-butylsalicylate compound | 2.00 parts |

The above materials were sufficiently premixed by using a Henschell mixer. After that, the mixture was melt and kneaded in a biaxial extruder. The kneaded product was cooled, and then coarsely pulverized into pieces each having a size of about 1 to 2 mm with a hammer mill. Next, the coarsely pulverized pieces were finely pulverized into pieces each having a particle size of 20 μm or less by using a pulverizer according to an air jet method.

After that, the finely pulverized pieces were treated in an apparatus (shown in FIGS. 1 and 2) for simultaneously performing a surface modification treatment (spheroidization treatment) and classification using a mechanical impact force, thereby resulting in toner base particles 1. The average circularity of the toner base particles 1 measured with the FPIA-2100 described above was 0.930.

Furthermore, 100.00 parts of the toner base particles 1 and 1.50 parts of hydrophobic titanium oxide fine powder (having a specific surface area measured according to a BET method of 150 $m^2/g$), which is obtained by treating 100.00 parts of titanium oxide host particles with 30.00 parts of $i\text{-}C_4H_9Si(OCH_3)_3$, were mixed by using a Henschell mixer to obtain a cyan toner 1. The average circularity of the cyan toner 1 measured was 0.930.

Table 3 shows the internal addition prescription of the cyan toner 1 whereas Table 4 shows the physical properties of the cyan toner 1.

Toner Production Example 2

A cyan toner 2 having an average circularity of 0.945 was obtained in the same manner as in Toner Production Example 1 except that the operating conditions of the apparatus for simultaneously performing a surface modification treatment and classification were altered. Table 3 shows the internal addition prescription of the toner 2 whereas Table 4 shows the physical properties of the toner 2.

Toner Production Example 3

A cyan toner 3 having an average circularity of 0.958 was obtained in the same manner as in Toner Production Example 1 except that the operating conditions of the apparatus for simultaneously performing a surface modification treatment and classification were altered. Table 3 shows the internal addition prescription of the toner 3 whereas Table 4 shows the physical properties of the toner 3.

Toner Production Example 4

The finely pulverized pieces were not treated in the apparatus for simultaneously performing a surface modification treatment and classification in Toner Production Example 1 but were subjected to classification by means of an air classifier (elbow jet classifier), thereby resulting in toner base particles 4. The subsequent procedure was the same as that in Toner Production Example 1, with the result that a cyan toner 4 having an average circularity of 0.915 was obtained. Table 3 shows the internal addition prescription of the toner 4 whereas Table 4 shows the physical properties of the toner 4.

Toner Production Example 5

A cyan toner 5 was obtained in the same manner as in Toner Production Example 1 except that the aluminum 3,5-di-t-butylsalicylate compound was changed to a zirconium 3,5-di-t-butylsalicylate compound (trade name TN-105, available from Hodogaya Chemical Co.). Table 3 shows the internal addition prescription of the toner 5 whereas Table 4 shows the physical properties of the toner 5.

Toner Production Example 6

A cyan toner 6 was obtained in the same manner as in Toner Production Example 1 except that 104.00 parts of the hybrid resin A were changed to 78.00 parts of the hybrid resin A and 25.00 parts of the hybrid resin B, and 1.00 part of the wax A was further added. Table 3 shows the internal addition prescription of the toner 6 whereas Table 4 shows the physical properties of the toner 6.

Toner Production Example 7

A cyan toner 7 was obtained in the same manner as in Toner Production Example 1 except that 104.00 parts of the hybrid resin A were changed to 78.00 parts of the hybrid resin A and 25.00 parts of the polyester resin C, and 1.00 part of the wax A was further added. Table 3 shows the internal addition prescription of the toner 7 whereas Table 4 shows the physical properties of the toner 7.

Toner Production Example 8

A cyan toner 8 was obtained in the same manner as in Toner Production Example 1 except that 104.00 parts of the hybrid resin A were changed to 78.00 parts of the hybrid resin A and 25.00 parts of the vinyl-based copolymer D, and 1.00 part of the wax A was further added. Table 3 shows the internal addition prescription of the toner 8 whereas Table 4 shows the physical properties of the toner 8.

Toner Production Example 9

A cyan toner 9 was obtained in the same manner as in Toner Production Example 1 except that 104.00 parts of the hybrid resin A were changed to 52.00 parts of the hybrid resin A and 50.00 parts of the hybrid resin B, and 2.00 parts of the wax A was further added. Table 3 shows the internal addition prescription of the toner 9 whereas Table 4 shows the physical properties of the toner 9.

Toner Production Example 10

The finely pulverized pieces were not treated in the apparatus for simultaneously performing a surface modification treatment and classification in Toner Production Example 9 but were subjected to classification by means of an air classifier (elbow jet classifier), thereby resulting in toner base particles 10. The subsequent procedure was the same as that in Toner Production Example 1, with the result that a cyan toner 10 having an average circularity of 0.916 was obtained. Table 3 shows the internal addition prescription of the toner 10 whereas Table 4 shows the physical properties of the toner 4.

Toner Production Example 11

A cyan toner 11 was obtained in the same manner as in Toner Production Example 1 except that 104.00 parts of the hybrid resin A were changed to 52.00 parts of the hybrid resin A and 50.00 parts of the polyester resin C, and 2.00 parts of the wax A were further added. Table 3 shows the internal addition prescription of the toner 11 whereas Table 4 shows the physical properties of the toner 11.

Toner Production Example 12

A cyan toner 12 was obtained in the same manner as in Toner Production Example 1 except that 104.00 parts of the hybrid resin A were changed to 52.00 parts of the hybrid resin A and 50.00 parts of the vinyl-based copolymer D, and 2.00 parts of the wax A were further added. Table 3 shows the internal addition prescription of the toner 12 whereas Table 4 shows the physical properties of the toner 12.

Toner Production Example 13

A cyan toner 13 was obtained in the same manner as in Toner Production Example 1 except that 104.00 parts of the hybrid resin A were changed to 52.00 parts of the hybrid resin A and 50.00 parts of the hybrid resin B, and 4.00 parts of the wax B were further added. Table 3 shows the internal addition prescription of the toner 13 whereas Table 4 shows the physical properties of the toner 13.

Toner Production Example 14

A cyan toner 14 of the present invention having a ratio of toner particles each having a particle diameter of 10 μm or more of 15 vol % and a weight average particle diameter of 9.6 μm was obtained in the same manner as in Toner Production Example 9 except that the operating conditions of the pulverizer were altered. Table 3 shows the internal addition prescription of the toner 14 whereas Table 4 shows the physical properties of the toner 14.

Toner Production Example 15

A cyan toner 15 of the present invention having a ratio of toner particles each having a particle diameter of 4 μm or less of 58 number % and a weight average particle diameter of 3.9 μm was obtained in the same manner as in Toner Production Example 9 except that the operating conditions of the pulverizer were altered. Table 3 shows the internal addition prescription of the toner 15 whereas Table 4 shows the physical properties of the toner 15.

Toner Production Example 16

A cyan toner 16 was obtained in the same manner as in Toner Production Example 1 except that 8.00 parts of the wax A were further added. Table 3 shows the internal addition prescription of the toner 16 whereas Table 4 shows the physical properties of the toner 16.

Toner Production Example 17

A cyan toner 17 was obtained in the same manner as in Toner Production Example 1 except that 104.00 parts of the hybrid resin A were changed to 52.00 parts of the hybrid resin A and 50.00 parts of the hybrid resin B. Table 3 shows the internal addition prescription of the toner 17 whereas Table 4 shows the physical properties of the toner 17.

Toner Production Example 18

A cyan toner 18 was obtained in the same manner as in Toner Production Example 9 except that the aluminum 3,5-di-t-butylsalicylate compound was not used. Table 3 shows the internal addition prescription of the toner 18 whereas Table 4 shows the physical properties of the toner 18.

Toner Production Example 19

A cyan toner 19 was obtained in the same manner as in Toner Production Example 4 except that 104.00 parts of the hybrid resin A were changed to 52.00 parts of the hybrid resin A and 50.00 parts of the hybrid resin B, and 4.00 parts of the wax C were further added. Table 3 shows the internal addition prescription of the toner 19 whereas Table 4 shows the physical properties of the toner 19.

Toner Production Example 20

The toner base particles 10 produced in Toner Production Example 10 were subjected to a spheroidization treatment by a Hybridizer (manufactured by Nara Machinery Co.) to obtain toner base particles 20. The subsequent procedure was the same as that in Toner Production Example 1, with the result that a cyan toner 20 having an average circularity of 0.964 was obtained. Table 3 shows the internal addition prescription of the toner 20 whereas Table 4 shows the physical properties of the toner 20.

Toner Production Example 21

A magenta toner 21 was obtained in the same manner as in Toner Production Example 1 except that 6.00 parts of C.I. Solvent Red 1 were used instead of 4.00 parts of C.I. Pigment Blue 15:3. Table 3 shows the internal addition prescription of the toner 21 whereas Table 4 shows the physical properties of the toner 21.

Toner Production Example 22

A yellow toner 22 was obtained in the same manner as in Toner Production Example 1 except that 6.00 parts of C.I. Pigment Yellow 17 were used instead of 4.00 parts of C.I. Pigment Blue 15:3. Table 3 shows the internal addition prescription of the toner 22 whereas Table 4 shows the physical properties of the toner 22.

Toner Production Example 23

A cyan toner 23 was obtained in the same manner as in Toner Production Example 1 except that 100.00 parts of the polyester resin C and 4.00 parts of the wax A were used instead of 104.00 parts of the hybrid resin A. Table 3 shows the internal addition prescription of the toner 23 whereas Table 4 shows the physical properties of the toner 23.

Toner Production Example 24

| | |
|---|---|
| Hybrid resin B | 100.00 parts |
| Wax A | 4.00 parts |
| C.I. Pigment Blue 15:3 | 4.00 parts |
| Aluminum 3,5-di-t-butylsalicylate compound | 2.00 parts |

The mixture of above materials was sufficiently premixed by using a Henschell mixer. After that, the mixture was melt and kneaded in a biaxial extruder. The kneaded product was cooled and then coarsely pulverized into pieces each having a size of about 1 to 2 mm with a hammer mill. Next, the coarsely pulverized pieces were finely pulverized into pieces each having a particle size of 20 μm or less by using a pulverizer according to an air jet method. After that, the finely pulverized pieces were subjected to classification by means of an air classifier (elbow jet classifier), thereby resulting in toner base particles 24.

Furthermore, 100.00 parts of the toner base particles 24 and 1.50 parts of hydrophobic titanium oxide fine powder (having a specific surface area according to a BET method of 150 $m^2/g$), which is obtained by treating 100.00 parts of titanium oxide host particles with 30.00 parts of i-$C_4H_9Si(OCH_3)_3$ were mixed by using a Henschell mixer to obtain a cyan toner 24. Table 3 shows the internal addition prescription of the cyan toner 24 whereas Table 4 shows the physical properties of the cyan toner 24.

Toner Production Example 25

A cyan toner 25 was obtained in the same manner as in Toner Production Example 24 except that 70.00 parts of the polyester resin C and 30.00 parts of the vinyl-based copolymer D were used instead of 100.00 parts of the hybrid resin B. Table 3 shows the internal addition prescription of the toner 25 whereas Table 4 shows the physical properties of the toner 25.

Toner Production Example 26

A cyan toner 26 was obtained in the same manner as in Toner Production Example 24 except that 100.00 parts of the polyester resin C was used instead of 100.00 parts of the hybrid resin B. Table 3 shows the internal addition prescription of the toner 26 whereas Table 4 shows the physical properties of the toner 26.

Toner Production Example 27

A cyan toner 27 was obtained in the same manner as in Toner Production Example 24 except that 100.00 parts of the vinyl-based copolymer D was used instead of 100.00 parts of the hybrid resin B. Table 3 shows the internal addition prescription of the toner 27 whereas Table 4 shows the physical properties of the toner 27.

Toner Production Example 28

A cyan toner 28 was obtained in the same manner as in Toner Production Example 4 except that 15.00 parts of the wax A used in Production Example of Hybrid Resin A were further added. Table 3 shows the internal addition prescription of the toner 28 whereas Table 4 shows the physical properties of the toner 28.

Toner Production Example 29

700.00 parts of ion-exchanged water and 800.00 parts of 0.1-kmol/$m^3$ aqueous solution of $Na_3PO_4$ were charged into a four-necked flask, and the temperature of the mixture was heated to 60° C. The mixture was added with 70.00 parts of 1.01-kmol/$m^3$ aqueous solution of $CaCl_2$ while being stirred with a TK Homomixer (manufactured by Tokushu Kika Kogyo Co.) at 170 $s^{-1}$. As a result, an aqueous dispersion medium containing a fine and hardly water-soluble dispersant $Ca_3(PO_4)_2$ was prepared.

In the meantime, the mixture composed of the following components was subjected to dispersion treatment by using an Atliter (manufactured by Mitsui Mining and Smelting Co.) at room temperature for 4 hours, to thereby prepare a uniform polymerizable monomer composition.

| | |
|---|---|
| Styrene | 78.00 parts |
| n-butyl acrylate | 22.00 parts |
| Divinylbenzene | 0.20 part |
| C.I. Pigment Blue 15:3 | 4.00 parts |
| Wax D | 10.00 parts |
| Aluminum 3,5-di-t-butylsalicylate compound | 2.00 parts |
| 2,2-azobis(2,4-dimethylvaleronitrile) | 3.00 parts |

Next, the polymerizable monomer composition was placed into the aqueous dispersion medium, and the mixture was stirred with a Homomixer in a nitrogen atmosphere at an internal temperature of 60° C. for 10 minutes, followed by granulation. After that, the stirring device was changed to a paddle stirring blade, and the mixture was stirred at 3.3 $s^{-1}$ for 5 hours at 60° C. Furthermore, the temperature of the mixture was increased up to 80° C. and held for 5 hours, thereby resulting in a suspension of toner base particles.

After that, the suspension was cooled and added with dilute hydrochloric acid, and the whole was stirred for 2 hours to dissolve the dispersant $Ca_3(PO_4)_2$. Furthermore, the suspension was filtered to obtain toner base particles, and the toner base particles were repeatedly washed with water. Then, the resultant water-containing toner base particles were dried with hot air at 40° C. for 3 days to obtain toner base particles 29.

Furthermore, 100.00 parts of the toner base particles 29 and 1.50 parts of hydrophobic titanium oxide fine powder (having a specific surface area according to a BET method of 150 $m^2$/g), which is obtained by treating 100.00 parts of titanium oxide host particles with 30.00 parts of i-$C_4H_9Si(OCH_3)_3$, were mixed by using a Henschell mixer to obtain a cyan toner 29. Table 3 shows the internal addition prescription of the toner 29 whereas Table 4 shows the physical properties of the toner 29.

Toner Production Example 30

3.00 parts of the polyester resin C and 5.00 parts of C.I. Pigment Blue 15:3 were dispersed into 97.00 parts of ethyl acetate by using an Atliter to prepare a pigment dispersion.

Subsequently, 15.00 parts of the wax A and 85.00 parts of toluene were loaded into a disperser, and the mixture was heated to 100° C. and stirred for 3 hours. Then, the mixture was cooled to room temperature at a rate of about 2° C./min while being stirred to precipitate a fine-particle-state wax.

The wax dispersion liquid was dispersed again under a pressure of 49 MPa by using a high-pressure emulsifier GAULIN 15MR type (APV Co.). The prepared dispersion of the fine-particle-state wax was diluted with ethyl acetate in such a manner that the wax concentration would be 15 mass %.

98.00 parts of the polyester resin C, 80.00 parts of the pigment dispersion, 26.00 parts of the dispersion of the fine-particle-state wax (having a wax concentration of 15 mass %), and 32.00 parts of ethyl acetate were mixed and sufficiently dissolved the polyester resin C into the ethyl acetate. Then, the solution was stirred with a TK Homomixer at a number of revolutions of 170 $s^{-1}$ for 10 minutes to prepare a uniform oil phase.

In the meantime, 60.00 parts of calcium carbonate and 40.00 parts of water were stirred by using a ball mill for 4 days to prepare an aqueous solution of calcium carbonate. 2.00 parts of carboxymethylcellulose were added to 98.00 parts of water to prepare an aqueous solution of carboxymethylcellulose.

The mixture of 60.00 parts of the oil phase, 10.00 parts of the aqueous solution of calcium carbonate, and 30.00 parts of the aqueous solution of carboxymethylcellulose was subjected to emulsification using a colloid mill (manufactured by Nippon Seiki Co.) at a interval of 1.5 mm and a number of revolutions of 133 $s^{-1}$ for 20 minutes. Then, the solvent was removed from the emulsified product under reduced pressure (15 kPa) at a room temperature for 3 hours using a rotary evaporator. After that, 12-mol/l hydrochloric acid was added to the resultant product until the pH became 2, therefore calcium carbonate was removed from the toner particle surface. After that, aqueous solution of NaOH (10-mol/l) was added to the resultant until the pH became 10. Furthermore, the resultant mixture was stirred with a stirring device for 1 hour while being subjected to ultrasonic treatment with an ultrasonic washing tank. Then, centrifugal sedimentation of toner particles was performed. The supernatant was exchanged 3 times whereby the toner particles are washed. The washed toner particles are dried to obtain toner base particles 30.

After that, 100.00 parts of the toner base particles 30 and 1.50 parts of hydrophobic titanium oxide fine powder (having a specific surface area according to a BET method of 150 $m^2$/g), which is obtained by treating 100 parts of titanium oxide host particles with 30.00 parts of i-$C_4H_9Si(OCH_3)_3$, were mixed by using a Henschell mixer to obtain a cyan toner 30. Table 3 shows the internal addition prescription of the toner 30 whereas Table 4 shows the physical properties of the toner 30.

Toner Production Example 31

2,500 g of styrene, 300 g of n-butyl acrylate, 56 g of acrylic acid, 110 g of dodecanethiol, and 30 g of carbon tetrabromide were mixed to prepare an oil phase. In the meantime, 43 g of polyoxyethylene nonyl phenyl ether and 59 g of sodium alkylbenzene sulfonate were dissolved into 3,500 g of ion-exchanged water in a flask. Then, the above oil phase was dispersed into the solution for emulsification, therefore a emulsified liquid was obtained. And 700 g of ion-exchanged water into which 29 g of ammonium persulfate had been dissolved was added into the emulsified liquid over 10 minutes while the emulsified liquid was being slowly stirred. Then, air in the flask was substituted by nitrogen gas. After that, the contents in the flask were heated up to 70° C. in an oil bath while the flask was being stirred for 6 hours, therefore emulsion polymerization was performed. As a result, a dispersion liquid (1), containing dispersed anionic resin fine particles having an average particle size of 155 nm, was obtained.

1,940 g of styrene, 830 g of n-butyl acrylate, and 57 g of acrylic acid were mixed to prepare an oil phase. In the meantime, 43 g of polyoxyethylene nonyl phenyl ether and 90 g of sodium alkylbenzene sulfonate were dissolved into 3,500 g of ion-exchanged water in a flask. Then, the above oil phase was dispersed into the solution for emulsification, therefore a emulsified liquid was obtained. And 700 g of ion-exchanged water into which 15 g of ammonium persulfate had been dissolved were charged into the emulsified liquid over 10 minutes while the emulsified liquid was being slowly stirred. Then, air in the flask was substituted by nitrogen gas. After that, the contents in the flask were heated up to 70° C. in an oil bath while the flask was being stirred for 6 hours, therefore emulsion polymerization was performed. As a result, a dispersion liquid (2), containing dispersed anionic resin fine particles having an average particle size of 100 nm, was obtained.

210 g of C.I. Pigment Blue 15:3 and 42 g of sodium alkylbenzene sulfonate were dissolved into 1,400 g of water, and the resultant aqueous solution was allowed to pass through an ultrasonic disperser 10 times, thereby resulting in a pigment dispersion.

The mixture of 350 g of the wax A, 53 g of sodium alkylbenzene sulfonate, and 1,400 g of water was heated to 95° C., and was subjected to a dispersion treatment by using a homogenizer (manufactured by IKA Co., Ultratarax T50). Then, the resultant dispersion liquid was subjected to a dispersion treatment by means of a pressure discharge type homogenizer to obtain a wax dispersion liquid.

The mixture of 18 g of polyaluminum chloride (10 mass %) and 162 g of 0.1% aqueous solution of nitric acid was subjected to dispersion treatment for 5 minutes by using a homogenizer to obtain an aqueous dispersion liquid of flocculating reagent.

The mixture of 835 g of the dispersion liquid (1) 550 g of dispersion liquid (2), 210 g of the pigment dispersion liquid, 280 g of the wax dispersion liquid, and 4,300 g of water were sufficiently mixed at room temperature in a stirring tank equipped with a heating jacket. To the resultant mixture contained in the stirring tank, 180 g of the aqueous dispersion liquid of flocculating reagent was added over 3 minutes from an upper portion of the stirring tank. Furthermore the mixture was continuously stirred for 5 minutes, and subjected to a dispersion treatment for 6 minutes to prepare a dispersion liquid. The dispersed particles in the dispersion liquid had a weight average particle size of about 2.5 μm.

Furthermore, the dispersion was heated to 48° C. with the heating jacket of the stirring tank and held at the temperature for 60 minutes. At that time, the dispersed particles in the dispersion liquid had a weight average particle size of about 4.8 μm, and agglomerated particles were observed. A 430 g of dispersion liquid (1) were gently added to the resultant dispersion, and the mixture was held at the temperature of 48° C. for an additional 1 hour to observe agglomerated particles having a weight average particle size of about 5.4 μm. Subsequently, 150 g of 4% aqueous solution of sodium hydroxide were added to the resultant dispersion, and the mixture was heated to 97° C. Furthermore, 100 g of 2-mass % aqueous solution of nitric acid were added to the resultant mixture, and the mixture was held at the temperature of 97° C. for 6 hours to combine agglomerated particles, thereby resulting in combined particles. After that, the combined particles were cooled, filtered, sufficiently washed with water, and filtered through a 400-mesh sieve. After the filtration, the particles were dried with a vacuum drier to obtain toner base particles 31.

Furthermore, 100.00 parts of the toner base particles 31 and 1.50 parts of hydrophobic titanium oxide fine powder (having a specific surface area according to a BET method of 150 $m^2/g$), which is obtained by treating 100 parts of titanium oxide host particles with 30.00 parts of $i\text{-}C_4H_9Si(OCH_3)_3$, were mixed by using a Henschell mixer to obtain a cyan toner 31. Table 3 shows the internal addition prescription of the toner 31 whereas Table 4 shows the physical properties of the toner 31.

Toner Production Example 32

A magenta toner 32 was obtained in the same manner as in Toner Production Example 24 except that 6.00 parts of C.I. Solvent Red 1 were used instead of 4.00 parts of C.I. Pigment Blue 15:3. Table 3 shows the internal addition prescription of the toner 32 whereas Table 4 shows the physical properties of the toner 32.

Toner Production Example 33

A yellow toner 33 was obtained in the same manner as in Toner Production Example 24 except that 6.00 parts of C.I. Pigment Yellow 17 were used instead of 4.00 parts of C.I. Pigment Blue 15:3. Table 3 shows the internal addition prescription of the toner 33 whereas Table 4 shows the physical properties of the toner 33.

Toner Production Example 34

100.00 parts of the toner base particles 1 produced in Toner Production Example 1 and 1.50 parts of hydrophobic silica fine powder (having a specific surface area according to a BET method of 150 $m^2/g$) the surface of which had been treated with hexamethyldisilazane and silicone oil were mixed by using a Henschell mixer to obtain a cyan toner 34. Table 3 shows the internal addition prescription of the toner 34 whereas Table 4 shows the physical properties of the toner 34.

Toner Production Example 35

100.00 parts of the toner base particles 21 produced in Toner Production Example 21 and 1.50 parts of hydrophobic silica fine powder used in Toner Production Example 34 were mixed by using a Henschell mixer to obtain a magenta toner 35. Table 3 shows the internal addition prescription of the toner 35 whereas Table 4 shows the physical properties of the toner 35.

Toner Production Example 36

100.00 parts of the toner base particles 22 produced in Toner Production Example 22 and 1.50 parts of hydrophobic silica fine powder used in Toner Production Example 34 were mixed by using a Henschell mixer to obtain a yellow toner 36. Table 3 shows the internal addition prescription of the toner 36 whereas Table 4 shows the physical properties of the toner 36.

Toner Production Example 37

100.00 parts of the toner base particles 24 produced in Toner Production Example 24 and 1.50 parts of hydrophobic silica fine powder used in Toner Production Example 34 were mixed by using a Henschell mixer to obtain a cyan toner 37. Table 3 shows the internal addition prescription of the toner 37 whereas Table 4 shows the physical properties of the toner 37.

Toner Production Example 38

100.00 parts of the toner base particles 32 produced in Toner Production Example 32 and 1.50 parts of hydrophobic silica fine powder used in Toner Production Example 34 were mixed by using a Henschell mixer to obtain a magenta toner 38. Table 3 shows the internal addition prescription of the toner 38 whereas Table 4 shows the physical properties of the toner 38.

Toner Production Example 39

100.00 parts of the toner base particles 33 produced in Toner Production Example 33 and 1.50 parts of hydrophobic silica fine powder used in Toner Production Example 34 were mixed by using a Henschell mixer to obtain a yellow toner 39. Table 3 shows the internal addition prescription of the toner 39 whereas Table 4 shows the physical properties of the toner 39.

TABLE 3

| Toner Production Example | Binder resin: Hybrid resin A | Hybrid resin B | Polyester Resin C | Vinyl-based copolymer | Styrene acrylic resin | Organometallic compound | Wax |
|---|---|---|---|---|---|---|---|
| 1 | 104 parts(containing 4 parts of wax A) | — | — | — | — | Aluminum 3,5-di-t-butylsalicylate compound/2 parts | — |
| 2 | 104 parts(containing 4 parts of wax A) | — | — | — | — | Aluminum 3,5-di-t-butylsalicylate compound/2 parts | — |
| 3 | 104 parts(containing 4 parts of wax A) | — | — | — | — | Aluminum 3,5-di-t-butylsalicylate compound/2 parts | — |
| 4 | 104 parts(containing 4 parts of wax A) | — | — | — | — | Aluminum 3,5-di-t-butylsalicylate compound/2 parts | — |
| 5 | 104 parts(containing 4 parts of wax A) | — | — | — | — | Aluminum 3,5-di-t-butylsalicylate compound/2 parts | — |
| 6 | 78 parts(containing 3 parts of wax A) | 25 parts | — | — | — | Aluminum 3,5-di-t-butylsalicylate compound/2 parts | A/1 part |
| 7 | 78 parts(containing 3 parts of wax A) | — | 25 parts | — | — | Aluminum 3,5-di-t-butylsalicylate compound/2 parts | A/1 part |
| 8 | 78 parts(containing 3 parts of wax A) | — | — | 25 parts | — | Aluminum 3,5-di-t-butylsalicylate compound/2 parts | A/1 part |
| 9 | 52 parts(containing 2 parts of wax A) | 50 parts | — | — | — | Aluminum 3,5-di-t-butylsalicylate compound/2 parts | A/2 parts |
| 10 | 52 parts(containing 2 parts of wax A) | 50 parts | — | — | — | Aluminum 3,5-di-t-butylsalicylate compound/2 parts | A/2 parts |
| 11 | 52 parts(containing 2 parts of wax A) | — | 50 parts | — | — | Aluminum 3,5-di-t-butylsalicylate compound/2 parts | A/2 parts |
| 12 | 52 parts(containing 2 parts of wax A) | — | — | 50 parts | — | Aluminum 3,5-di-t-butylsalicylate compound/2 parts | A/2 parts |
| 13 | 52 parts(containing 2 parts of wax A) | 50 parts | — | — | — | Aluminum 3,5-di-t-butylsalicylate compound/2 parts | B/4 parts |
| 14 | 52 parts(containing 2 parts of wax A) | 50 parts | — | — | — | Aluminum 3,5-di-t-butylsalicylate compound/2 parts | A/2 parts |
| 15 | 52 parts(containing 2 parts of wax A) | 50 parts | — | — | — | Aluminum 3,5-di-t-butylsalicylate compound/2 parts | A/2 parts |
| 16 | 104 parts(containing 4 parts of wax A) | — | — | — | — | Aluminum 3,5-di-t-butylsalicylate compound/2 parts | A/8 parts |
| 17 | 52 parts(containing 2 parts of wax A) | 50 parts | — | — | — | Aluminum 3,5-di-t-butylsalicylate compound/2 parts | — |
| 18 | 52 parts(containing 2 parts of wax A) | 50 parts | — | — | — | — | A/2parts |
| 19 | 52 parts(containing 2 parts of wax A) | 50 parts | — | — | — | Aluminum 3,5-di-t-butylsalicylate compound/2 parts | A/4 parts |
| 20 | 52 parts(containing 2 parts of wax A) | 50 parts | — | — | — | Aluminum 3,5-di-t-butylsalicylate compound/2 parts | A/2 parts |
| 21 | 104 parts(containing 4 parts of wax A) | — | — | — | — | Aluminum 3,5-di-t-butylsalicylate compound/2 parts | — |
| 22 | 104 parts(containing 4 parts of wax A) | — | — | — | — | Aluminum 3,5-di-t-butylsalicylate compound/2 parts | — |

TABLE 3-continued

| Toner Production Example | Binder resin: Hybrid resin A | Hybrid resin B | Polyester Resin C | Vinyl-based copolymer | Styrene acrylic resin | Organometallic compound | Wax |
|---|---|---|---|---|---|---|---|
| 23 | — | — | 100 parts | — | — | Aluminum 3,5-di-t-butylsalicylate compound/2 parts | A/4 parts |
| 24 | — | 100 parts | — | — | — | Aluminum 3,5-di-t-butylsalicylate compound/2 parts | A/4 parts |
| 25 | — | — | 70 parts | 30 parts | — | Aluminum 3,5-di-t-butylsalicylate compound/2 parts | A/4 parts |
| 26 | — | — | 100 parts | — | — | Aluminum 3,5-di-t-butylsalicylate compound/2 parts | A/4 parts |
| 27 | — | — | — | 100 parts | — | Aluminum 3,5-di-t-butylsalicylate compound/2 parts | A/4 parts |
| 28 | 104 parts (containing 4 parts of wax A) | — | — | — | — | Zirconium 3,5-di-t-butylsalicylate compound/2 parts | A/15 parts |
| 29 | — | — | — | — | 100 parts | Aluminum 3,5-di-t-butylsalicylate compound/2 parts | D/10 parts |
| 30 | — | — | 100 parts | — | — | — | A/4 parts |
| 31 | — | — | — | — | 100 parts | — | A/4 parts |
| 32 | — | 100 parts | — | — | — | Aluminum 3,5-di-t-butylsalicylate compound/2 parts | A/4 parts |
| 33 | — | 100 parts | — | — | — | Aluminum 3,5-di-t-butylsalicylate compound/2 parts | A/4 parts |
| 34 | 104 parts (containing 4 parts of wax A) | — | — | — | — | Aluminum 3,5-di-t-butylsalicylate compound/2 parts | — |
| 35 | 104 parts (containing 4 parts of wax A) | — | — | — | — | Aluminum 3,5-di-t-butylsalicylate compound/2 parts | — |
| 36 | 104 parts (containing 4 parts of wax A) | — | — | — | — | Aluminum 3,5-di-t-butylsalicylate compound/2 parts | — |
| 37 | — | 100 parts | — | — | — | Aluminum 3,5-di-t-butylsalicylate compound/2 parts | A/4 parts |
| 38 | — | 100 parts | — | — | — | Aluminum 3,5-di-t-butylsalicylate compound/2 parts | A/4 parts |
| 39 | — | 100 parts | — | — | — | Aluminum 3,5-di-t-butylsalicylate compound/2 parts | A/4 parts |

TABLE 4-1

| Toner | C[01] | C[20] | C[90] | D | D × 0.2 | C[20] × 0.6 | C[90] × 0.8 |
|---|---|---|---|---|---|---|---|
| 1 | 0.205 | 0.238 | 0.248 | 0.595 | 0.119 | 0.143 | 0.198 |
| 2 | 0.209 | 0.235 | 0.248 | 0.594 | 0.119 | 0.141 | 0.198 |
| 3 | 0.202 | 0.234 | 0.248 | 0.594 | 0.119 | 0.140 | 0.198 |
| 4 | 0.203 | 0.231 | 0.248 | 0.595 | 0.119 | 0.139 | 0.198 |
| 5 | 0.204 | 0.235 | 0.246 | 0.591 | 0.118 | 0.141 | 0.197 |
| 6 | 0.168 | 0.225 | 0.240 | 0.598 | 0.120 | 0.135 | 0.192 |
| 7 | 0.152 | 0.225 | 0.235 | 0.591 | 0.118 | 0.135 | 0.188 |
| 8 | 0.155 | 0.220 | 0.237 | 0.587 | 0.117 | 0.132 | 0.190 |
| 9 | 0.115 | 0.210 | 0.231 | 0.589 | 0.118 | 0.126 | 0.185 |
| 10 | 0.115 | 0.211 | 0.231 | 0.589 | 0.118 | 0.127 | 0.185 |
| 11 | 0.109 | 0.222 | 0.240 | 0.588 | 0.118 | 0.133 | 0.192 |
| 12 | 0.112 | 0.222 | 0.250 | 0.588 | 0.118 | 0.133 | 0.200 |
| 13 | 0.129 | 0.201 | 0.321 | 0.872 | 0.174 | 0.121 | 0.257 |
| 14 | 0.099 | 0.211 | 0.242 | 0.593 | 0.119 | 0.127 | 0.194 |
| 15 | 0.125 | 0.238 | 0.251 | 0.593 | 0.119 | 0.143 | 0.201 |
| 16 | 0.453 | 0.516 | 0.721 | 1.810 | 0.362 | 0.310 | 0.577 |
| 17 | 0.083 | 0.123 | 0.183 | 0.295 | 0.059 | 0.074 | 0.146 |
| 18 | 0.112 | 0.210 | 0.231 | 0.593 | 0.119 | 0.126 | 0.185 |
| 19 | 0.081 | 0.113 | 0.155 | 0.302 | 0.060 | 0.068 | 0.124 |
| 20 | 0.165 | 0.235 | 0.248 | 0.594 | 0.119 | 0.141 | 0.198 |

TABLE 4-1-continued

| Toner | C[01] | C[20] | C[90] | D | D × 0.2 | C[20] × 0.6 | C[90] × 0.8 |
|---|---|---|---|---|---|---|---|
| 21 | 0.200 | 0.235 | 0.249 | 0.595 | 0.119 | 0.141 | 0.199 |
| 22 | 0.207 | 0.234 | 0.250 | 0.595 | 0.119 | 0.140 | 0.200 |
| 23 | 0.059 | 0.118 | 0.145 | 0.599 | 0.120 | 0.071 | 0.116 |
| 24 | 0.063 | 0.122 | 0.170 | 0.599 | 0.120 | 0.073 | 0.136 |
| 25 | 0.064 | 0.123 | 0.162 | 0.598 | 0.120 | 0.074 | 0.130 |
| 26 | 0.055 | 0.118 | 0.144 | 0.599 | 0.120 | 0.071 | 0.115 |
| 27 | 0.078 | 0.135 | 0.178 | 0.596 | 0.119 | 0.081 | 0.142 |
| 28 | 0.527 | 0.586 | 0.653 | 2.850 | 0.570 | 0.352 | 0.522 |
| 29 | 0.042 | 0.769 | 0.899 | 1.160 | 0.232 | 0.461 | 0.719 |
| 30 | 0.078 | 0.162 | 0.194 | 0.568 | 0.114 | 0.097 | 0.155 |
| 31 | 0.064 | 0.132 | 0.188 | 0.584 | 0.117 | 0.079 | 0.150 |
| 32 | 0.062 | 0.120 | 0.171 | 0.599 | 0.120 | 0.072 | 0.137 |
| 33 | 0.063 | 0.119 | 0.171 | 0.599 | 0.120 | 0.071 | 0.137 |
| 34 | 0.204 | 0.238 | 0.248 | 0.595 | 0.119 | 0.143 | 0.198 |
| 35 | 0.204 | 0.238 | 0.247 | 0.595 | 0.119 | 0.143 | 0.198 |
| 36 | 0.202 | 0.240 | 0.248 | 0.595 | 0.119 | 0.144 | 0.198 |
| 37 | 0.059 | 0.122 | 0.170 | 0.597 | 0.119 | 0.073 | 0.136 |
| 38 | 0.058 | 0.123 | 0.169 | 0.596 | 0.119 | 0.074 | 0.135 |
| 39 | 0.059 | 0.122 | 0.170 | 0.595 | 0.119 | 0.073 | 0.136 |

TABLE 4-2

| Toner | Degree of agglomeration: A (%) | B (%) | B/A | Transmissivity when dispersed into aqueous solution of methanol (%) | Peak temperature of highest endothermic peak (° C.) | Peak molecular weightMp | Mw/Mn | Weight average particle diameter (μm) | Ratio of particles each having a particle diameter of 4 μm or less (number %) | Ratio of particles each having a particle diameter of 10 μm or more (vol %) | Average circularity |
|---|---|---|---|---|---|---|---|---|---|---|---|
| 1 | 25 | 28 | 1.1 | 28 | 75 | 8800 | 730 | 7.3 | 13 | 5 | 0.930 |
| 2 | 20 | 22 | 1.1 | 34 | 75 | 8800 | 730 | 7.1 | 14 | 4 | 0.945 |
| 3 | 35 | 42 | 1.2 | 58 | 75 | 8800 | 730 | 7.1 | 12 | 4 | 0.958 |
| 4 | 28 | 31 | 1.1 | 21 | 75 | 8800 | 730 | 7.1 | 12 | 4 | 0.915 |
| 5 | 26 | 29 | 1.1 | 30 | 75 | 8900 | 1080 | 7.2 | 15 | 4 | 0.930 |
| 6 | 30 | 39 | 1.3 | 35 | 75 | 8800 | 730 | 7.3 | 15 | 4 | 0.929 |
| 7 | 35 | 56 | 1.6 | 40 | 75 | 8600 | 480 | 7.1 | 13 | 5 | 0.930 |
| 8 | 35 | 56 | 1.6 | 39 | 75 | 9000 | 250 | 7.0 | 12 | 4 | 0.931 |
| 9 | 38 | 61 | 1.6 | 52 | 75 | 8800 | 730 | 7.2 | 15 | 4 | 0.930 |
| 10 | 32 | 51 | 1.6 | 45 | 75 | 8800 | 730 | 7.2 | 14 | 4 | 0.916 |
| 11 | 40 | 72 | 1.8 | 76 | 75 | 8800 | 670 | 7.3 | 15 | 4 | 0.931 |

TABLE 4-2-continued

| Toner | Degree of agglomeration A (%) | B (%) | B/A | Transmissivity when dispersed into aqueous solution of methanol (%) | Peak temperature of highest endothermic peak (° C.) | Peak molecular weightMp | Mw/Mn | Weight average particle diameter (μm) | Ratio of particles each having a particle diameter of 4 μm or less (number %) | Ratio of particles each having a particle diameter of 10 μm or more (vol %) | Average circularity |
|---|---|---|---|---|---|---|---|---|---|---|---|
| 12 | 38 | 57 | 1.5 | 58 | 75 | 9000 | 72 | 7.3 | 13 | 5 | 0.929 |
| 13 | 45 | 81 | 1.8 | 72 | 68 | 8800 | 730 | 7.2 | 15 | 4 | 0.934 |
| 14 | 30 | 33 | 1.1 | 46 | 75 | 8800 | 710 | 9.6 | 12 | 15 | 0.927 |
| 15 | 45 | 72 | 1.6 | 55 | 75 | 8700 | 730 | 3.9 | 58 | 0 | 0.934 |
| 16 | 42 | 80 | 1.9 | 78 | 75 | 8800 | 480 | 7.2 | 13 | 5 | 0.931 |
| 17 | 20 | 22 | 1.1 | 21 | 75 | 8800 | 980 | 7.3 | 14 | 4 | 0.928 |
| 18 | 36 | 58 | 1.6 | 55 | 75 | 8500 | 35 | 7.2 | 13 | 5 | 0.938 |
| 19 | 35 | 53 | 1.5 | 56 | 120 | 8800 | 750 | 7.1 | 13 | 5 | 0.916 |
| 20 | 44 | 92 | 2.1 | 88 | 75 | 8700 | 730 | 7.0 | 13 | 5 | 0.964 |
| 21 | 25 | 28 | 1.1 | 28 | 75 | 8800 | 730 | 7.3 | 13 | 5 | 0.930 |
| 22 | 25 | 28 | 1.1 | 28 | 75 | 8800 | 730 | 7.3 | 13 | 5 | 0.930 |
| 23 | 38 | 95 | 2.5 | 96 | 75 | 8800 | 95 | 7.2 | 14 | 4 | 0.932 |
| 24 | 32 | 67 | 2.1 | 82 | 75 | 8700 | 680 | 7.3 | 13 | 5 | 0.913 |
| 25 | 35 | 77 | 2.2 | 85 | 75 | 8900 | 85 | 7.3 | 13 | 5 | 0.911 |
| 26 | 35 | 81 | 2.3 | 88 | 75 | 8800 | 95 | 7.3 | 13 | 4 | 0.914 |
| 27 | 33 | 40 | 1.2 | 45 | 75 | 9000 | 10 | 7.1 | 13 | 5 | 0.911 |
| 28 | 41 | 94 | 2.3 | 92 | 75 | 8800 | 675 | 7.2 | 14 | 5 | 0.914 |
| 29 | 9 | 10 | 1.1 | 2 | 78 | 35000 | 23 | 6.8 | 7 | 3 | 0.980 |
| 30 | 15 | 24 | 1.6 | 22 | 75 | 8000 | 12 | 7.8 | 13 | 5 | 0.980 |
| 31 | 35 | 56 | 1.6 | 28 | 75 | 5600 | 105 | 5.4 | 30 | 2 | 0.976 |
| 32 | 32 | 67 | 2.1 | 81 | 75 | 8700 | 680 | 7.2 | 14 | 5 | 0.913 |
| 33 | 32 | 67 | 2.1 | 83 | 75 | 8700 | 680 | 7.3 | 13 | 5 | 0.913 |
| 34 | 25 | 28 | 1.1 | 28 | 75 | 8800 | 730 | 7.3 | 13 | 5 | 0.930 |
| 35 | 25 | 28 | 1.1 | 28 | 75 | 8800 | 750 | 7.1 | 14 | 5 | 0.931 |
| 36 | 25 | 28 | 1.1 | 28 | 75 | 8800 | 730 | 7.3 | 13 | 4 | 0.930 |
| 37 | 32 | 67 | 2.1 | 82 | 75 | 8700 | 680 | 7.3 | 15 | 5 | 0.913 |
| 38 | 32 | 67 | 2.1 | 82 | 75 | 8700 | 690 | 7.3 | 13 | 5 | 0.914 |
| 39 | 32 | 67 | 2.1 | 82 | 75 | 8700 | 660 | 7.1 | 13 | 3 | 0.913 |

TABLE 4-3

| Toner | G' 80 (Pa) | G' 160 (Pa) | tanδ in the temperature range of 120 to 160° C. Minimum value | Maximum value | G' 50/G' 70 | G' 70/G' 90 | G' 90/G' 110 |
|---|---|---|---|---|---|---|---|
| 1 | 4.12E+06 | 6.98E+02 | 1.7 | 1.9 | 13.2 | 151.0 | 15.2 |
| 2 | 4.23E+06 | 6.99E+02 | 1.7 | 1.9 | 13.1 | 152.0 | 15.2 |
| 3 | 4.17E+06 | 6.99E+02 | 1.7 | 1.9 | 13.1 | 152.0 | 15.1 |
| 4 | 4.18E+06 | 7.02E+02 | 1.7 | 1.9 | 13.1 | 153.0 | 15.2 |
| 5 | 5.22E+06 | 2.05E+03 | 2.3 | 3.0 | 12.5 | 155.8 | 12.4 |
| 6 | 4.58E+06 | 7.32E+02 | 1.8 | 2.0 | 13.1 | 153.0 | 15.2 |
| 7 | 3.06E+06 | 6.01E+02 | 2.3 | 3.0 | 12.5 | 178.0 | 21.2 |
| 8 | 6.22E+06 | 7.98E+02 | 1.2 | 2.5 | 8.3 | 98.3 | 12.5 |
| 9 | 4.52E+06 | 7.23E+02 | 1.7 | 1.9 | 14.6 | 160.0 | 15.2 |
| 10 | 4.02E+06 | 7.18E+02 | 1.7 | 2.0 | 15.4 | 151.0 | 15.6 |
| 11 | 8.06E+05 | 1.25E+02 | 0.8 | 1.2 | 18.5 | 195.4 | 28.2 |
| 12 | 9.92E+06 | 2.80E+03 | 1.5 | 1.6 | 2.9 | 64.1 | 4.6 |
| 13 | 4.22E+06 | 7.03E+02 | 1.7 | 1.9 | 13.8 | 156.3 | 15.2 |
| 14 | 4.26E+06 | 6.93E+02 | 1.8 | 1.9 | 13.9 | 155.1 | 14.9 |
| 15 | 4.32E+06 | 7.03E+02 | 1.7 | 2.0 | 14.6 | 159.8 | 15.2 |
| 16 | 1.23E+06 | 4.78E+02 | 1.8 | 1.9 | 14.6 | 185.2 | 15.2 |
| 17 | 7.83E+06 | 8.99E+02 | 1.7 | 1.9 | 10.1 | 122.0 | 22.2 |
| 18 | 7.80E+05 | 1.05E+02 | 0.8 | 1.2 | 18.5 | 225.0 | 33.3 |
| 19 | 8.53E+06 | 9.59E+02 | 1.7 | 1.9 | 8.5 | 80.2 | 26.2 |
| 20 | 4.05E+06 | 6.78E+02 | 1.8 | 1.9 | 14.6 | 155.2 | 15.2 |
| 21 | 4.12E+06 | 6.66E+02 | 1.8 | 2.0 | 13.1 | 148.3 | 16.5 |
| 22 | 4.22E+06 | 7.35E+02 | 1.8 | 1.9 | 14.6 | 149.9 | 16.5 |
| 23 | 8.06E+04 | 1.20E+01 | 0.4 | 0.8 | 36.5 | 125.3 | 33.8 |
| 24 | 4.17E+06 | 7.02E+02 | 1.7 | 1.9 | 13.4 | 150.0 | 15.2 |
| 25 | 9.06E+04 | 1.20E+01 | 0.6 | 0.8 | 36.5 | 125.3 | 33.8 |
| 26 | 8.01E+04 | 1.10E+01 | 0.4 | 0.8 | 34.5 | 123.3 | 34.8 |
| 27 | 1.42E+07 | 1.30E+04 | 1.5 | 2.5 | 2.9 | 55.0 | 26.3 |
| 28 | 8.90E+05 | 4.70E+01 | 1.1 | 1.2 | 42.1 | 185.2 | 15.2 |
| 29 | 9.82E+06 | 1.20E+04 | 1.5 | 2.3 | 8.9 | 148.0 | 26.3 |
| 30 | 8.08E+04 | 1.20E+01 | 0.4 | 0.8 | 35.5 | 121.3 | 33.8 |
| 31 | 1.19E+06 | 1.02E+04 | 0.8 | 2.3 | 15.6 | 148.0 | 39.6 |
| 32 | 3.87E+06 | 5.96E+02 | 1.8 | 1.9 | 13.4 | 135.6 | 15.2 |
| 33 | 4.27E+06 | 7.52E+02 | 1.7 | 1.9 | 13.3 | 150.0 | 14.8 |

TABLE 4-3-continued

| Toner | G' 80 (Pa) | G' 160 (Pa) | tanδ in the temperature range of 120 to 160° C. Minimum value | Maximum value | G' 50/G' 70 | G' 70/G' 90 | G' 90/G' 110 |
|---|---|---|---|---|---|---|---|
| 34 | 4.12E+06 | 6.98E+02 | 1.7 | 1.9 | 13.2 | 151.0 | 15.2 |
| 35 | 4.12E+06 | 6.66E+02 | 1.8 | 2.0 | 13.1 | 148.3 | 16.5 |
| 36 | 4.22E+06 | 7.35E+02 | 1.8 | 1.9 | 14.6 | 149.9 | 16.5 |
| 37 | 4.17E+06 | 7.02E+02 | 1.7 | 1.9 | 13.4 | 150.0 | 15.2 |
| 38 | 3.87E+06 | 5.96E+02 | 1.8 | 1.9 | 13.4 | 135.6 | 15.2 |
| 39 | 4.27E+06 | 7.52E+02 | 1.7 | 1.9 | 13.3 | 150.0 | 14.8 |

<Preparation of Two-component Developer>

Each of the toners 1 to 33 produced in Toner Production Examples 1 to 33 and a resin-coated carrier obtained by coating the surface of magnetic ferrite particles with a silicone resin (having a weight average particle size of 50 μm, Mn—Mg ferrite) were mixed in such a manner that the toner concentration would be 6 mass %, to thereby prepare each of two-component developers 1 to 33.

Examples 1 to 17, Comparative Examples 1 to 12

An image forming apparatus used in the examples will be described below. FIG. 3 is a schematic drawing of the image forming apparatus to be applied to the examples. FIG. 4 is a schematic drawing of a developing unit of the image forming apparatus shown in FIG. 3 (FIG. 4, which shows only one developing unit for a photosensitive drum, specifically shows one of the developing units in FIG. 3.).

A photosensitive drum 1 has a substrate 1*b* and a photosensitive layer 1*a* having an organic optical semiconductor, the layer being placed on the substrate 1*b*. The photosensitive drum 1 rotates in the direction shown by an arrow. A charging roller 2 (including a conductive elastic layer 2*a* and a cored bar 2*b*), which is opposite to the photosensitive drum 1 and rotates in contact with the photosensitive drum 1, uniformly charges the photosensitive drum 1. Exposure 3 is turned on/off according to digital image information to form an electrostatic charge image on the photosensitive drum by means of a polygon mirror. Out of a group of developing units 4 consisting of developing units 4-1 to 4-4, for example, the developing unit 4-1 is used to develop the electrostatic charge image with a toner on the photosensitive drum 1 through reversal development. The toner image on the photosensitive drum 1 is transferred onto an intermediate transfer body 5. A transfer residual toner on the photosensitive drum 1 is recovered by a cleaner member 8 and placed into a residual toner container 9. The intermediate transfer body 5 is coated with an elastic layer 5*a*, which is obtained by sufficiently dispersing carbon black into nitrile-butadiene rubber (NBR), to a pipe-like cored bar 5*b*.

The toner image primarily transferred onto the intermediate transfer body 5 is secondarily transferred onto a transfer material 6 at a portion opposite to a transfer roller 7. A transfer residual toner, which has not been transferred at the time of secondary transfer and is remaining on the intermediate transfer body, is recovered by a cleaner member 10. The transfer roller 7 has an outer diameter of 20 mm. The transfer roller 7 has a cored bar 7*b* of 10 mm in diameter and an elastic layer 7*a* obtained by sufficiently dispersing carbon black into a foam of an ethylene-propylene-diene-based ternary copolymer (EPDM) and by applying the dispersion to the cored bar 7*b*.

The toner image transferred onto the transfer material is fixed by means of a fixing device. A heat roll type fixing device 11 having no oil application function was used as the fixing device. Each of an upper roller and a lower roller had a surface layer made of a fluorine-based resin, and had a diameter of 50 mm. A fixation temperature and a nip width were set at 180° C. and 4 mm, respectively.

Each of the above developers was charged into the developing unit, and the image forming apparatus including the developing unit was moved to a high-temperature and high-humidity environment (30° C., 80% RH) and left under the environment for 1 week. Then, hot offset resistance to be described later was evaluated. After that, 5,000 sheets of images each having an image area ratio of 12% were outputted in a monochrome mode and at a rate of 24 sheets (A4 size)/min by using plain paper for a copying machine (80 g/m$^2$, manufactured by Canon Inc.) as a transfer material, while a toner was sequentially replenished to keep a constant toner concentration. Next, the image forming apparatus including the developing unit was moved to a low-temperature and low-humidity environment (15° C., 10% RH) and left under the environment for 1 week. Then, low-temperature fixability to be described later was evaluated. After that, 5,000 sheets of images each having an image area ratio of 4% were outputted. After that, the image forming apparatus including the developing unit was moved to a room-temperature and room-humidity environment (23° C., 50% RH) and left under the environment for 1 week. After that, coloring power to be described later was evaluated, and then 5,000 sheets of images each having an image area ratio of 7% were outputted.

Next, each evaluation item will be described. Table 5 shows the results of evaluation.

(1) Low-Temperature Fixability

The following operations were performed under the low-temperature and low-humidity environment (15° C., 10% RH).

The fixing device was removed from the image forming apparatus. Then, by using cardboard "Plover Bond paper" (105 g/m$^2$, manufactured by Fox River Paper Co.) as a transfer material, 20 sheets of unfixed solid images each having a toner mounting amount on the paper in the range of 0.45 to 0.50 mg/cm$^2$ were prepared. Subsequently, the rate of the fixing device was set at 40 sheets (A4 size)/min (the fixation temperature was set at 180° C.), and the 20 sheets of unfixed images were continuously passed through the fixing device for fixation.

A portion distant from the rear end of the 20th fixed image by 5 cm was rubbed with soft thin paper (for example, trade name "Dusper", manufactured by Ozu Corporation) "to and fro" ("to and fro" is collectively counted as once. The same holds true for the following description.) 5 times while the portion was applied with a load of 4.9 kPa. The image density before the rubbing and the image density after the rubbing were measured to calculate a rate of reduction in image density ΔD1 (%) according to the following expression. The image density was measured with a color reflection densitometer X-Rite 404A.

$$\Delta D1\ (\%)=((\text{Image density before rubbing})-(\text{Image density after rubbing}))\times 100/(\text{Image density before rubbing})$$

Next, the image density of a central portion of the 20th fixed image was measured. A transparent adhesive tape made of polyester was affixed to the portion, and then the portion was rubbed with soft thin paper to and fro 5 times while the portion was applied with a load of 4.9 kPa from above the tape. After that, the tape was peeled off and the image density was measured. The image density before affixing the tape and the image density after affixing the tape were used to calculate a rate of reduction in image density ΔD2 (%) according to the following expression.

$$\Delta D2\ (\%)=((\text{Image density before affixing tape})-(\text{Image density after affixing tape}))\times 100/(\text{Image density before affixing tape})$$

Furthermore, the image density of a portion distant from the leading end of the 20th fixed image by 5 cm was measured. First, the portion was lightly folded in the vertical direction and was then rubbed with soft thin paper to and fro once while the portion was applied with a load of 4.9 kPa from above. After that, the folded fixed image was opened and then the portion distant from the leading end by 5 cm was folded in the horizontal direction and rubbed in the same manner as that described above. Next, the folded fixed image was opened and an intersection point of the vertical fold and the horizontal fold on the image was rubbed with soft thin paper to and fro 5 times while the portion was applied with a load of 4.9 kPa. The image density before the folding and the image density after the folding and the rubbing to and fro 5 times were measured to calculate a rate of reduction in image density ΔD3 (%) according to the following expression.

$$\Delta D3\ (\%)=((\text{Image density before folding})-(\text{Image density after folding and rubbing to and fro 5 times})\times 100/(\text{Image density before folding})$$

Then, the sum total ΔD (%) of ΔD1, ΔD2, and ΔD3 was calculated (ΔD=ΔD1+ΔD2+ΔD3). The low-temperature fixability was evaluated according to the following criteria on the basis of the calculated ΔD.

A: extremely good (less than 10%)

B: good (10% or more and less than 20%)

C: normal (20% or more and less than 30%)

D: bad (30% or more)

(2) Hot Offset Resistance

The following operations were performed under the high-temperature and high-humidity environment (30° C., 80% RH).

The fixing device was removed from the image forming apparatus. Then, by using recycled paper for a copying machine (68 g/m$^2$, manufactured by Canon Inc.) as a transfer material, 10 sheets of unfixed images each having a toner mounting amount on the paper of 1.5 mg/cm$^2$ were prepared. Subsequently, the rate of the fixing device was set at 8 sheets (A4 size)/min, and the 10 sheets of unfixed images were continuously passed through the fixing device. Immediately after that, one sheet of the recycled paper for a copying machine was passed through the fixing device. Finally, the worst value for the degree of whiteness of the recycled paper that had passed through the fixing device and the worst value for the degree of whiteness of unused recycled paper were measured, and the difference between them was calculated.

Subsequently, the hot offset resistance was evaluated according to the following criteria on the basis of the difference in degree of whiteness. The degree of whiteness was measured with a reflectometer having an amber filter ("REFLECTOMETER MODEL TC-6DS" manufactured by Tokyo Denshoku Co.).

A: extremely good (less than 0.5%)

B: good (0.5% or more and less than 1.0%)

C: normal (1.0% or more and less than 2.0%)

D: bad (2.0% or more)

(3) Coloring Power

The following operations were performed in the room-temperature and room-humidity environment (23° C., 50% RH).

By using plain paper for a color copying machine (80 g/m$^2$, manufactured by Canon Co.) as a transfer material, several kinds of solid images each having a toner mounting amount on the paper in the range of 0.2 to 0.8 mg/cm$^2$ were prepared. The image densities of the fixed solid images were measured with an X-Rite color reflection densitometer and the relationship between the toner amount on the transfer paper and the image density was graphed. Then, the image density when the toner mounting amount on the paper was 0.50 mg/cm$^2$ was read from the graph. Subsequently, the coloring power was relatively evaluated as follows.

A: extremely good (more than 1.40)

B: good (1.35 or more and less than 1.40)

C: normal (1.20 or more and less than 1.35)

D: bad (less than 1.20)

(4) Image Density

The image density of the solid image on the 3,000th sheet in the room-temperature and room-humidity environment was evaluated. The image density was measured with the X-Rite color reflection densitometer described above.

A: extremely good (more than 1.60)

B: good (1.40 or more and less than 1.60)

C: normal (1.20 or more and less than 1.40)

D: bad (less than 1.20)

(5) Fogging

After the image output under the high-temperature and high-humidity environment had been completed, a solid white image was outputted. During the formation of the white solid image, the image forming apparatus was forcedly stopped. A transparent adhesive tape made of polyester was placed on a solid white image portion of the photosensitive drum. After that, the tape is peeled from the photosensitive drum, and then affixed to white paper. An unused tape was affixed to the same white paper. The degree of whiteness of each tape was measured. Fogging was calculated from the difference in degree of whiteness. The degree of whiteness was measured with the reflectometer described above.

A: extremely good (less than 2.0%)

B: good (2.0% or more and less than 3.0%)

C: normal (3.0% or more and less than 5.0%)

D: bad (5.0% or more)

(6) Environmental Stability

The image density of the solid image on the 4,000th sheet under the low-temperature and low-humidity environment and that under the high-temperature and high-humidity environment were measured, and the difference between them was calculated. The difference in density was adopted as an indicator of environmental stability. The image density was measured with the X-Rite color reflection densitometer described above.

A: extremely good (less than 0.10)

B: good (0.10 or more and less than 0.15)

C: normal (0.15 or more and less than 0.25)

D: bad (0.25 or more)

(7) Endurance Stability

The image density of the solid image on the 1,000th sheet under the high-temperature and high-humidity environment and the image density of the solid image on the 4,000th sheet under the high-temperature and high-humidity environment were measured, and the difference between them was calculated. The difference in density was adopted as an indicator of endurance stability. The image density was measured with the X-Rite color reflection densitometer described above.

A: extremely good (less than 0.10)

B: good (0.10 or more and less than 0.15)

C: normal (0.15 or more and less than 0.25)

D: bad (0.25 or more)

(8) Gradation after Endurance

Figure 7:
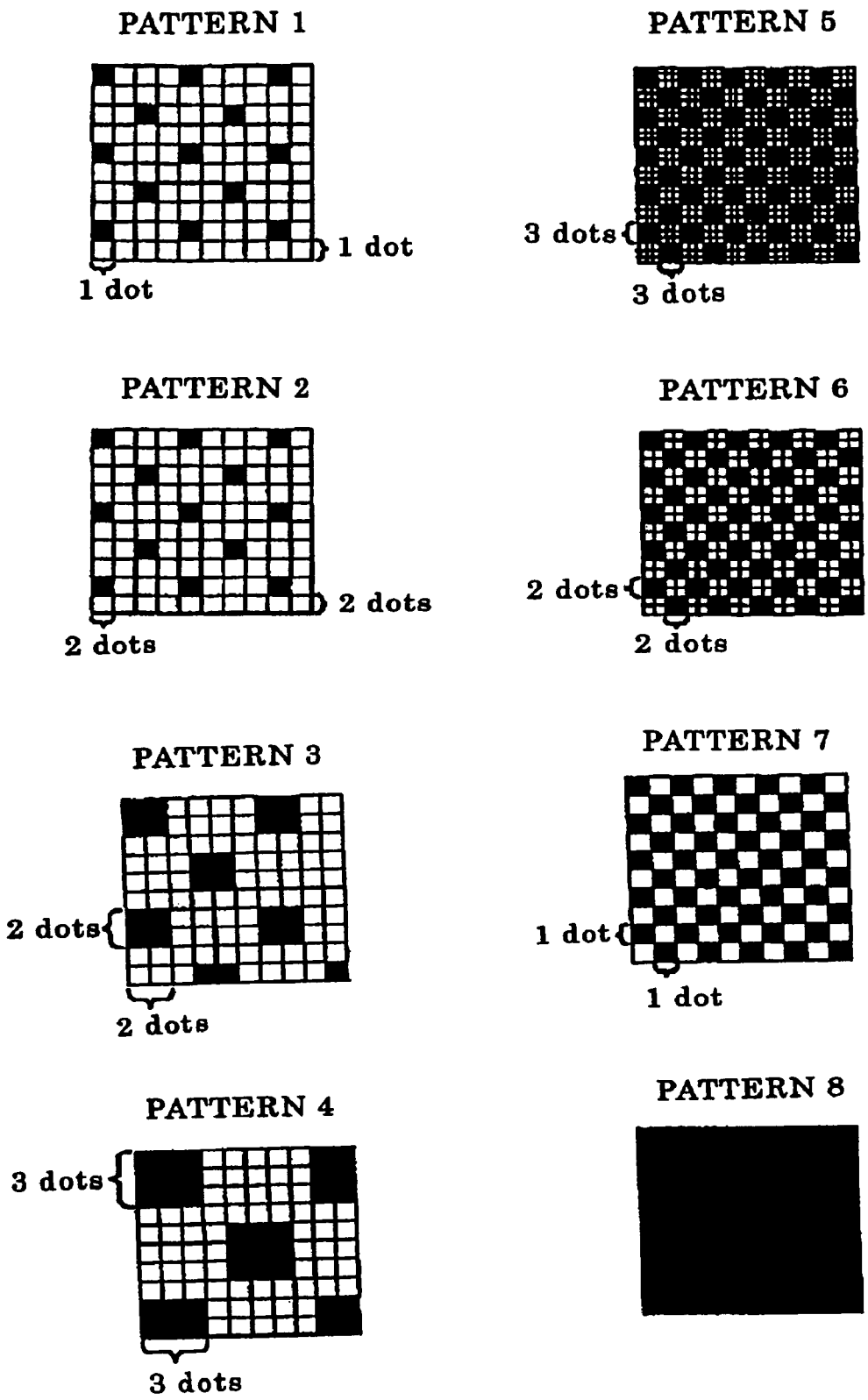
FIG. 7 is a drawing showing 8 kinds of image patterns used for evaluating gradation in examples.

Gradation after endurance was evaluated as follows. After the image output in the room-temperature and room-humidity environment had been completed, 8 kinds of images shown in FIG. 7 different from one another in pattern formation method were outputted by using plain paper for a color copying machine (80 g/m$^2$, manufactured by Canon Co.) as a transfer material. The image density of each image was measured with the X-Rite color reflection densitometer described above to judge gradation after endurance.

The density ranges of the respective pattern images are preferably in the following ranges in terms of gradation reproducibility. Then, whether the density ranges of the respective pattern images satisfied the following density ranges was investigated.

Pattern 1: 0.10 to 0.15

Pattern 2: 0.15 to 0.20

Pattern 3: 0.20 to 0.30

Pattern 4: 0.25 to 0.40

Pattern 5: 0.55 to 0.70

Pattern 6: 0.65 to 0.80

Pattern 7: 0.75 to 0.90

Pattern 8: more than 1.40

Gradation was evaluated according to the following criteria on the basis of the results.

A: extremely good (all pattern images satisfy the above density ranges)

B: good (one pattern image deviates from the above density ranges)

C: normal (two or three pattern images deviate from the above density ranges)

D: bad (four or more pattern images deviate from the above density ranges)

(9) Void after Endurance

Figure 6:
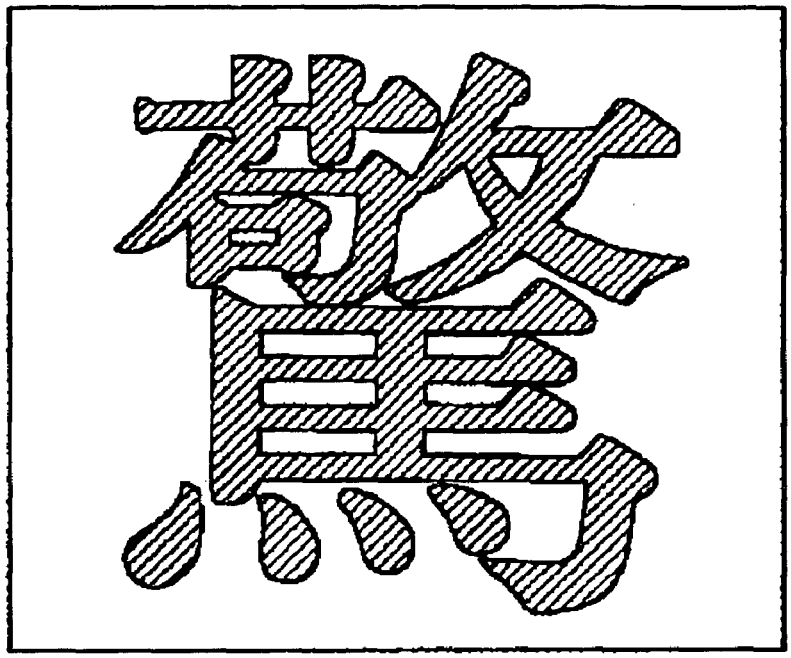
FIG. 6 is a schematic drawing showing a state of void of a letter image used for evaluating void after endurance in examples.
Figure 6:
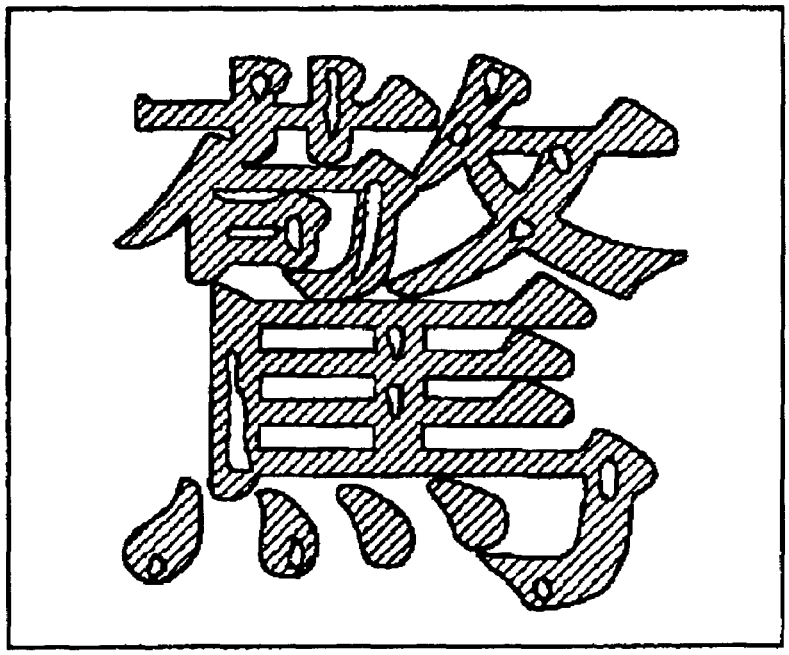

Void after endurance was evaluated as follows. After the image output in the room-temperature and room-humidity environment had been completed, image of a letter pattern shown in FIG. 6*a* was outputted by using plain paper for a color copying machine (80 g/m$^2$, manufactured by Canon Co.) as a transfer material. Then, the void of the letter pattern (the state as shown in FIG. 6*b*) was visually evaluated.

A: extremely good (nearly no void occurred)

B: good (a slight amount of void occurred)

C: normal (some degree of void occurred)

D: bad (a considerable amount of void occurred)

TABLE 5

| | Two-component developer | Low-temperature fixability | Hot offset resistance | Coloring power | Image density | Fogging | Environmental stability | Endurance stability | Gradation after endurance | Void after endurance |
|---|---|---|---|---|---|---|---|---|---|---|
| Example 1 | 1 | A (1.8%) | A (0.3%) | A (1.52) | A (1.65) | A (0.5%) | A (0.05) | A (0.08) | A | A |
| Example 2 | 2 | A (2.1%) | A (0.3%) | A (1.53) | A (1.65) | A (0.5%) | A (0.04) | A (0.07) | A | A |
| Example 3 | 3 | A (2.1%) | A (0.3%) | A (1.48) | A (1.60) | A (0.9%) | A (0.04) | B (0.12) | A | A |
| Example 4 | 5 | A (2.4%) | A (0.3%) | A (1.49) | A (1.64) | A (0.6%) | A (0.06) | A (0.08) | A | A |
| Example 5 | 6 | A (6.1%) | A (0.4%) | B (1.39) | A (1.62) | A (1.8%) | A (0.08) | B (0.12) | B | A |
| Example 6 | 7 | A (7.4%) | A (0.4%) | B (1.38) | A (1.62) | B (2.2%) | A (0.08) | B (0.12) | B | A |
| Example 7 | 8 | A (9.5%) | A (0.4%) | B (1.39) | A (1.62) | B (2.2%) | A (0.08) | B (0.12) | B | A |
| Example 8 | 9 | B (11%) | B (0.5%) | B (1.35) | A (1.60) | B (2.6%) | B (0.13) | C (0.17) | B | A |
| Example 9 | 11 | B (14%) | B (0.9%) | B (1.35) | B (1.53) | B (2.5%) | C (0.16) | C (0.19) | B | B |
| Example 10 | 12 | B (18%) | B (0.7%) | C (1.25) | B (1.56) | B (2.9%) | B (0.14) | C (0.19) | B | A |
| Example 11 | 13 | B (12%) | C (1.2%) | B (1.36) | A (1.61) | B (2.6%) | B (0.13) | C (0.17) | B | A |
| Example 12 | 14 | B (13%) | B (0.5%) | C (1.26) | B (1.53) | B (2.8%) | B (0.11) | B (0.12) | C | A |
| Example 13 | 15 | A (8.9%) | B (0.7%) | B (1.39) | B (1.56) | C (3.1%) | B (0.13) | C (0.22) | B | B |
| Example 14 | 16 | A (1.5%) | A (0.3%) | B (1.35) | A (1.60) | B (2.5%) | B (0.13) | C (0.24) | C | B |
| Example 15 | 17 | B (19%) | B (0.9%) | C (1.27) | C (1.25) | B (2.4%) | B (0.12) | B (0.11) | B | A |
| Example 16 | 18 | B (15%) | C (1.9%) | B (1.35) | B (1.59) | B (2.8%) | B (0.14) | C (0.23) | B | A |
| Example 17 | 20 | B (11%) | B (0.6%) | B (1.35) | A (1.61) | C (4.5%) | C (0.24) | C (0.19) | C | B |
| Comparative Example 1 | 4 | A (2.1%) | A (0.3%) | C (1.33) | C (1.34) | C (3.0%) | C (0.23) | C (0.19) | C | D |
| Comparative Example 2 | 10 | B (11%) | B (0.5%) | C (1.33) | C (1.33) | C (3.0%) | C (0.24) | C (0.19) | C | D |
| Comparative Example 3 | 19 | B (18%) | C (1.9%) | C (1.33) | C (1.32) | C (3.0%) | C (0.24) | C (0.17) | C | D |
| Comparative Example 4 | 23 | C (26%) | D (4.8%) | C (1.33) | C (1.31) | D (8.3%) | C (0.24) | D (0.32) | D | D |
| Comparative Example 5 | 24 | C (24%) | D (2.1%) | C (1.26) | B (1.39) | C (3.1%) | D (0.26) | D (0.28) | D | D |
| Comparative Example 6 | 25 | C (28%) | D (2.6%) | C (1.28) | B (1.37) | C (4.5%) | D (0.33) | D (0.33) | D | D |
| Comparative Example 7 | 26 | C (26%) | D (4.8%) | C (1.28) | B (1.38) | C (4.3%) | D (0.41) | D (0.32) | D | D |
| Comparative Example 8 | 27 | D (31%) | D (2.0%) | C (1.26) | B (1.35) | D (5.3%) | D (0.27) | D (0.26) | C | D |
| Comparative Example 9 | 28 | C (21%) | C (1.2%) | C (1.33) | C (1.34) | D (8.3%) | D (0.27) | D (0.40) | D | D |
| Comparative Example 10 | 29 | D (38%) | C (1.2%) | C (1.33) | C (1.34) | C (3.0%) | C (0.24) | C (0.16) | B | B |
| Comparative Example 11 | 30 | D (41%) | C (1.7%) | D (1.18) | D (1.18) | C (3.6%) | C (0.23) | C (0.23) | B | B |
| Comparative Example 12 | 31 | D (42%) | C (1.9%) | C (1.22) | C (1.32) | C (3.5%) | C (0.23) | C (0.22) | B | B |

Example 18 and Comparative Example 13

In Example 18, a commercially available full-color copying machine CLC1000 (manufactured by Canon Co.) was used without remodeling. Cyan, magenta, and yellow developing units were removed from the copying machine main body, and the developers inside the developing units were drawn out. Then, the two-component developer 1, the two-component developer 21, and the two-component developer 22 were charged into the cyan developing unit, the magenta developing unit, and the yellow developing unit, respectively (a two-component developer in the developing unit of the CLC1000 was directly used).

Then, by using plain paper for a color copying machine (80 g/m$^2$, manufactured by Canon Co.) as a transfer material, copy images were outputted by using a scene image (an original chart having strong green and blue colorations) and a person image (an original chart having strong skin, red, and yellow colorations). After that, the color reproducibility was visually evaluated.

In Comparative Example 13, the two-component developer 24 for comparison, the two-component developer 32 for comparison, and the two-component developer 33 for comparison were charged into the cyan developing unit, the magenta developing unit, and the yellow developing unit, respectively, and the evaluation was performed in the same manner as Example 18.

The resultant images were visually evaluated. As a result, the images obtained by using the two-component developers 1, 21, and 22 were vivid images excellent in reproducibility of intermediate colors such as a skin color and a blue-sky color.

On the other hand, the images obtained by using the two-component developers 24, 32, and 33 for comparison were images in which a skin color and a blue-sky color had become obscured.

Example 19 and Comparative Example 14

In Example 19, a color laser beam printer LBP-2040 (manufactured by Canon Co.) was remodeled and reset before use. The image forming apparatus has a fixing roller having no oil application mechanism, and employs a non-magnetic one-component jumping development method as its development method.

A rubber roller of 12 mm in diameter into which conductive carbon coated with a nylon resin was dispersed was used as a charging roller. A dark area potential VD of −650 V and a light area potential VL of −200 V were formed on a photosensitive drum through laser exposure. The traveling speed of a developing sleeve having a surface roughness Ra of 1.1 the surface of which was coated with a resin into which carbon black was dispersed, the developing sleeve serving as a toner carrier, was set to be 1.1 times as high as the traveling speed of the photosensitive drum surface. A gap between the photosensitive drum and the developing sleeve was set at 270 μm. A blade made of silicone rubber serving as a toner regulating member was brought into contact with the sleeve. An AC bias component was superimposed on a DC bias component (VDC=−450 V), and the resultant was used as a developing bias.

Cyan, magenta, and yellow cartridges were removed from the printer main body, and the toners inside the cartridges were drawn out. Then, the cyan toner 34, the magenta toner 35, and the yellow toner 36 were charged into the cyan cartridge, the magenta cartridge, and the yellow cartridge, respectively (a black cartridge in the LBP-2040 was directly used).

In each of the room-temperature and room-humidity environment (23° C., 50% RH), the high-temperature and high-humidity environment (30° C., 80% RH), and the low-temperature and low-humidity environment (15° C., 10% RH), 2,000 sheets of full-color images each having an image area ratio of 7% were printed out at a print out rate of 8 sheets/min (A4 size) by using plain paper for a color copying machine (80 g/m$^2$, manufactured by Canon Co.) as a transfer material.

In Comparative Example 14, the cyan toner 37 for comparison, the magenta toner 38 for comparison, and the yellow-toner 39 for comparison were charged into the cyan cartridge, the magenta cartridge, and the yellow cartridge, respectively, and the evaluation was performed in the same manner as that described above.

The resultant printed out image was visually evaluated. As a result, the images obtained by using the toners 34, 35, and 36 each had a small difference in density between the high-temperature and high-humidity environment and the low-temperature and low-humidity environment. In addition, even if a large number of sheets were printed out in any environment, the toners provided vivid images having small variations in image density and a low degree of fogging.

On the other hand, the printed out images obtained by using the toners 37, 38, and 39 for comparison each had a large difference in density between the high-temperature and high-humidity environment and the low-temperature and low-humidity environment, and showed large variations in image density due to endurance under the low-temperature and low-humidity environment. In addition, the degree of fogging under the high-temperature and high-humidity environment gradually increased as the printout proceeded. Furthermore, the transfer material was wound around the fixing roller.

Example 20 and Comparative Example 15

In Example 20, a color laser beam printer LBP-2160 (manufactured by Canon Co.) was remodeled, and the development method was changed to a nonmagnetic one-component contacting development method.

An elastic roller having a surface roughness Ra of 1.1 and having a base layer composed of NBR and a surface layer composed of ether urethane was used as a toner carrier. The toner carrier was designed to contact the photosensitive drum at the time of image formation, and was allowed to rotate at a circumferential speed of 204 mm/s, which is 1.7 times as high as the circumferential speed of the photosensitive drum (120 mm/s).

An elastic blade having a metal thin plate of phosphor bronze as a substrate and having urethane rubber bonded to the surface of the blade to contact the toner carrier was used as a toner regulating member. A toner supply roller was placed in a toner container in a state where the toner supply roller was in contact with the toner carrier. The toner supply roller was an elastic roller of 12 mm in diameter obtained by placing a polyurethane foam on a cored bar.

A dark area potential VD of −600 V and a light area potential VL of −200 V were formed on the photosensitive drum through laser exposure. A DC voltage (Vdc) of −470 V was applied to the toner carrier.

A fixing roller having no oil application mechanism was directly used as a fixing device.

Cyan, magenta, and yellow cartridges were removed from the printer main body, and the toners inside the cartridges were drawn out. Then, the cyan toner 34, the magenta toner 35, and the yellow toner 36 were charged into the cyan cartridge, the magenta cartridge, and the yellow cartridge, respectively (a black cartridge in the LBP-2160 was directly used).

In the room-temperature and room-humidity environment (23° C., 50% RH), 3,000 sheets of full-color images each having an image area ratio of 20% were printed out by using plain paper for a color copying machine (80 g/m$^2$, manufactured by Canon Co.) as a transfer material.

In Comparative Example 15, the cyan toner 37 for comparison, the magenta toner 38 for comparison, and the yellow toner 39 for comparison were charged into the cyan cartridge, the magenta cartridge, and the yellow cartridge, respectively, and the evaluation was performed in the same manner as that described above.

The resultant printed out image was visually evaluated. As a result, the images obtained by using the toners 34, 35, and 36 of the present invention showed small variations in image density and low degrees of fogging throughout the printout of 3,000 sheets. In addition, the images were vivid images excellent in color reproducibility and free of uneven brightness.

On the other hand, the images obtained by using the toners 37, 38, and 39 for comparison showed large variations in image density, and showed line-shaped image defects from the time when 2,300 sheets were printed out. In addition, uneven brightness was observed at the end portions of the images.

This application claims priority from Japanese Patent Application No. 2003-377289 filed Nov. 6, 2003, which is hereby incorporated by reference, herein.

What is claimed is:

1. A color toner, comprising at least a binder resin, a colorant, and a wax, wherein:

a wax concentration C[01] of an eluted wax extract being in a range of 0.080 to 0.500 mg/cm$^3$ and obtained by dispersing the toner into n-hexane at a concentration of 15 mg/cm$^3$ at 23° C. and by stirring the resultant dispersion at 23° C. for 1 minute to provide the eluted wax extract;

an average circularity of particles each having a circle-equivalent diameter of 3 μm or more in the toner is in a range of 0.925 to 0.965;

a content of the wax is in a range of 1 to 15 parts by mass with respect to 100 parts by mass of the binder resin; and the wax comprises a paraffin wax.

2. A color toner, comprising at least a binder resin, a colorant, and a wax, wherein:

a wax concentration C[01] of an eluted wax extract being in a range of 0.080 to 0.500 mg/cm$^3$ and obtained by dispersing the toner into n-hexane at a concentration of 15 mg/cm$^3$ at 23° C. and by stirring the resultant dispersion at 23° C. for 1 minute to provide the eluted wax extract;

an average circularity of particles each having a circle-equivalent diameter of 3 μm or more in the toner is in a range of 0.925 to 0.965;

a content of the wax is in a range of 1 to 15 parts by mass with respect to 100 parts by mass of the binder resin; and the binder resin comprises a resin having at least a polyester unit.

3. A color toner, comprising at least a binder resin, a colorant, and a wax, wherein:

a wax concentration C[01] of an eluted wax extract being in a range of 0.080 to 0.500 mg/cm$^3$ and obtained by dispersing the toner into n-hexane at a concentration of 15 mg/cm$^3$ at 23° C. and by stirring the resultant dispersion at 23° C. for 1 minute to provide the eluted wax extract;

an average circularity of particles each having a circle-equivalent diameter of 3 μm or more in the toner is in a range of 0.925 to 0.965;

a content of the wax is in a range of 1 to 15 parts by mass with respect to 100 parts by mass of the binder resin; and a storage elastic modulus at a temperature of 80° C. (G'80) of the toner is in a range of $1\times10^5$ to $1\times10^8$ (Pa).

4. A color toner, comprising at least a binder resin, a colorant, and a wax, wherein:

a wax concentration C[01] of an eluted wax extract being in a range of 0.080 to 0.500 mg/cm$^3$ and obtained by dispersing the toner into n-hexane at a concentration of 15 mg/cm$^3$ at 23° C. and by stirring the resultant dispersion at 23° C. for 1 minute to provide the eluted wax extract;

an average circularity of particles each having a circle-equivalent diameter of 3μm or more in the toner is in a range of 0.925 to 0.965; and a content of the wax is in a range of 1 to 15 parts by mass with respect to 100 parts by mass of the binder resin; and a storage elastic modulus at a temperature of 160° C. (G'160) of the toner is in a range of 10 to $1\times10^4$ (Pa).

5. A color toner, comprising at least a binder resin, a colorant, and a wax, wherein:

a wax concentration C[01] of an eluted wax extract being in a range of 0.080 to 0.500 mg/cm$^3$ and obtained by dispersing the toner into n-hexane at a concentration of 15 mg/cm$^3$ at 23° C. and by stuffing the resultant dispersion at 23° C. for 1 minute to provide the eluted wax extract;

an average circularity of particles each having a circle-equivalent diameter of 3μm or more in the toner is in a range of 0.925 to 0.965; and a content of the wax is in a range of 1 to 15 parts by mass with respect to 100 parts by mass of the binder resin; and a ratio (G"/G'=tan δ) of a loss elastic modulus (G") to a storage elastic modulus (G') of the toner is in a range of 0.5 to 5.0 at any temperature between 120 and 150° C.

* * * * *